US010476172B2

(12) United States Patent
Kosaka et al.

(10) Patent No.: US 10,476,172 B2
(45) **Date of Patent: *Nov. 12, 2019**

(54) ANTENNA, ANTENNA ARRAY, AND WIRELESS COMMUNICATION DEVICE

(71) Applicant: NEC CORPORATION, Tokyo (JP)

(72) Inventors: Keishi Kosaka, Tokyo (JP); Hiroshi Toyao, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 95 days.

This patent is subject to a terminal disclaimer.

(21) Appl. No.: 15/324,920

(22) PCT Filed: May 15, 2015

(86) PCT No.: PCT/JP2015/002457

§ 371 (c)(1),
(2) Date: Jan. 9, 2017

(87) PCT Pub. No.: WO2016/006148

PCT Pub. Date: Jan. 14, 2016

(65) Prior Publication Data

US 2017/0194717 A1 Jul. 6, 2017

(30) Foreign Application Priority Data

Jul. 10, 2014 (JP) ..... 2014-142484

(51) Int. Cl.
*H01Q 21/14* (2006.01)
*H01Q 1/52* (2006.01)
(Continued)

(52) U.S. Cl.
CPC ..... *H01Q 21/14* (2013.01); *H01Q 1/2291* (2013.01); *H01Q 1/521* (2013.01); *H01Q 1/523* (2013.01);
(Continued)

(58) Field of Classification Search
CPC .. H01Q 21/14; H01Q 21/0037; H01Q 9/0435; H01Q 9/0414; H01Q 7/00; H01Q 9/265; H01Q 1/521; H01Q 21/0006
See application file for complete search history.

(56) References Cited

U.S. PATENT DOCUMENTS

2002/0190909 A1* 12/2002 Yamamoto ..... H01Q 9/42 343/742
2012/0115548 A1 5/2012 Shimizu et al.
(Continued)

FOREIGN PATENT DOCUMENTS

JP 2006-352293 A 12/2006
JP 4073130 B2 4/2008
(Continued)

OTHER PUBLICATIONS

International Search Report for PCT/JP2015/002457, dated Jun. 30, 2015.
(Continued)

*Primary Examiner* — Hai V Tran
*Assistant Examiner* — Michael M Bouizza
(74) *Attorney, Agent, or Firm* — Sughrue Mion, PLLC

(57) ABSTRACT

Provided are an antenna, an antenna array, and a wireless communication device with which it is possible to achieve size reduction while suppressing degradation in radiation efficiency. This antenna comprises two antenna elements and a conductor reflection plate. The antenna element includes: a C-shaped conductor which is a substantially C-shaped conductor in which a split part is formed such that a portion of an annular conductor is made discontinuous; and a conductor power feed line that is electrically connected to one of the two parts of the C-shaped conductor that oppose one another across the split part, the conductor power feed line constituting an electric circuit for feeding power to the C-shaped conductor. The two antenna elements are arranged
(Continued)

substantially orthogonal to one another such that, when the elements are projected onto the conductor reflection plate, one antenna element and a portion of the other antenna element overlap one another.

20 Claims, 41 Drawing Sheets

(51) Int. Cl.

| | |
|---|---|
| ***H01Q 21/00*** | (2006.01) |
| ***H01Q 7/00*** | (2006.01) |
| ***H01Q 9/04*** | (2006.01) |
| ***H01Q 9/26*** | (2006.01) |
| ***H01Q 21/24*** | (2006.01) |
| ***H01Q 1/22*** | (2006.01) |
| ***H01Q 21/06*** | (2006.01) |

(52) U.S. Cl.
CPC ..... *H01Q 7/00* (2013.01); *H01Q 9/0414* (2013.01); *H01Q 9/0435* (2013.01); *H01Q 9/265* (2013.01); *H01Q 21/0006* (2013.01); *H01Q 21/0037* (2013.01); *H01Q 21/062* (2013.01); *H01Q 21/24* (2013.01)

(56) References Cited

U.S. PATENT DOCUMENTS

| | | | | |
|---|---|---|---|---|
| 2012/0169552 | A1* | 7/2012 | Lee | H01Q 9/285 343/727 |
| 2012/0218157 | A1* | 8/2012 | Endou | H01Q 7/00 343/741 |
| 2012/0287018 | A1* | 11/2012 | Parsche | H01Q 9/0435 343/897 |
| 2014/0203993 | A1 | 7/2014 | Toyao | |

FOREIGN PATENT DOCUMENTS

| | | | |
|---|---|---|---|
| JP | 2009-111662 | A | 5/2009 |
| JP | 2009-124403 | A | 6/2009 |
| JP | 2012-85262 | A | 4/2012 |
| JP | 2012-104982 | A | 5/2012 |
| WO | 2013/027824 | A1 | 2/2013 |
| WO | 2014/073703 | A1 | 5/2014 |

OTHER PUBLICATIONS

Written Opinion for PCT/JP2015/002457, dated Jun. 30, 2015.
Communication dated Dec. 11, 2018 from the Japanese Patent Office in counterpart Application No. 2016-532407.

* cited by examiner

ANTENNA, ANTENNA ARRAY, AND WIRELESS COMMUNICATION DEVICE

CROSS REFERENCE TO RELATED APPLICATIONS

This is a National Stage of International Application No. PCT/JP2015/002457 filed May 15, 2015, claiming priority based on Japanese Patent Application No. 2014-142484 filed Jul. 10, 2014, the contents of all of which are incorporated herein by reference in their entirety.

TECHNICAL FIELD

The present invention relates to an antenna, an antenna array, and a wireless communication device, and in particular, to an antenna that transmits/receives dual polarization waves, an antenna array, and a wireless communication device.

BACKGROUND ART

Over recent years, for example, for mobile communication base stations or as antenna devices for Wi-Fi communication equipment, to ensure a communication capacity, orthogonal dual polarization wave antennas and orthogonal dual polarization antenna arrays capable of performing MIMO (multi-input-multi-output) communication by polarization wave diversity have been put into practical use.

Many of the antennas are realized by two antenna elements disposed substantially vertically, and an antenna array is also realized by arraying antenna elements disposed in such a manner. Enhancement of a degree of integration of two elements has been desired for size reduction of a device.

Orthogonal dual polarization wave antennas are disclosed in, for example, Patent Literatures 1 to 3 (PTL1 to PTL3). In the orthogonal dual polarization wave antennas disclosed in these PTLs, techniques for realizing an orthogonal dual polarization wave antenna using a dipole antenna are disclosed.

CITATION LIST

Patent Literature

[PTL1] Japanese Patent No. 4073130

[PLT2] Japanese Patent Application Laid-Open No. 2006-352293

[PLT3] Japanese Patent Application Laid-open No. 2009-124403

SUMMARY OF INVENTION

Technical Problem

However, when used as described in the PTLs, it is necessary for a dipole antenna to have a size half a wavelength to maintain radiation efficiency, and therefore, it has been difficult to achieve size reduction.

An object of the present invention has been achieved to solve such a problem and is to provide an antenna, an antenna array, and a wireless communication device capable of achieving size reduction while suppressing degradation in radiation efficiency.

Solution to Problem

An antenna according to the present invention comprises two antenna elements; and a conductor reflection plate, each of the antenna elements including a C-shaped conductor that is a substantially C-shaped conductor formed with a split part so that a portion of an annular conductor is made discontinuous, and a conductor power feed line that is electrically connected to one part of both parts of the C-shaped conductor opposing each other across the split part and configures a current path for feeding power to the C-shaped conductor, the two antenna elements being disposed substantially orthogonally so that one of the antenna elements and the other of the antenna elements partially overlap each other when projected on the conductor reflection plate.

In addition, an antenna array according to the present invention comprises a plurality of the antennas.

In addition, wireless communication apparatus according to the present invention is mounted with the antenna or the antenna array.

Advantageous Effect of Invention

According to the present invention, it is possible to provide an antenna, an antenna array, and a wireless communication device capable of achieving size reduction while suppressing degradation in radiation efficiency.

DESCRIPTION OF EMBODIMENTS

Hereinafter, example embodiments of the present invention will be described with reference to the drawings. However, in the following example embodiments, technically preferable limitations are made to carry out the present invention, but these limitations do not limit the scope of the invention to the following. Further, in the following description, positions of respective components may be described with expressions such as upper, lower, left, and right on the basis of the drawings, but these are intended for description and do not limit any direction upon carrying out the present invention.

First Example Embodiment

Figure 1:
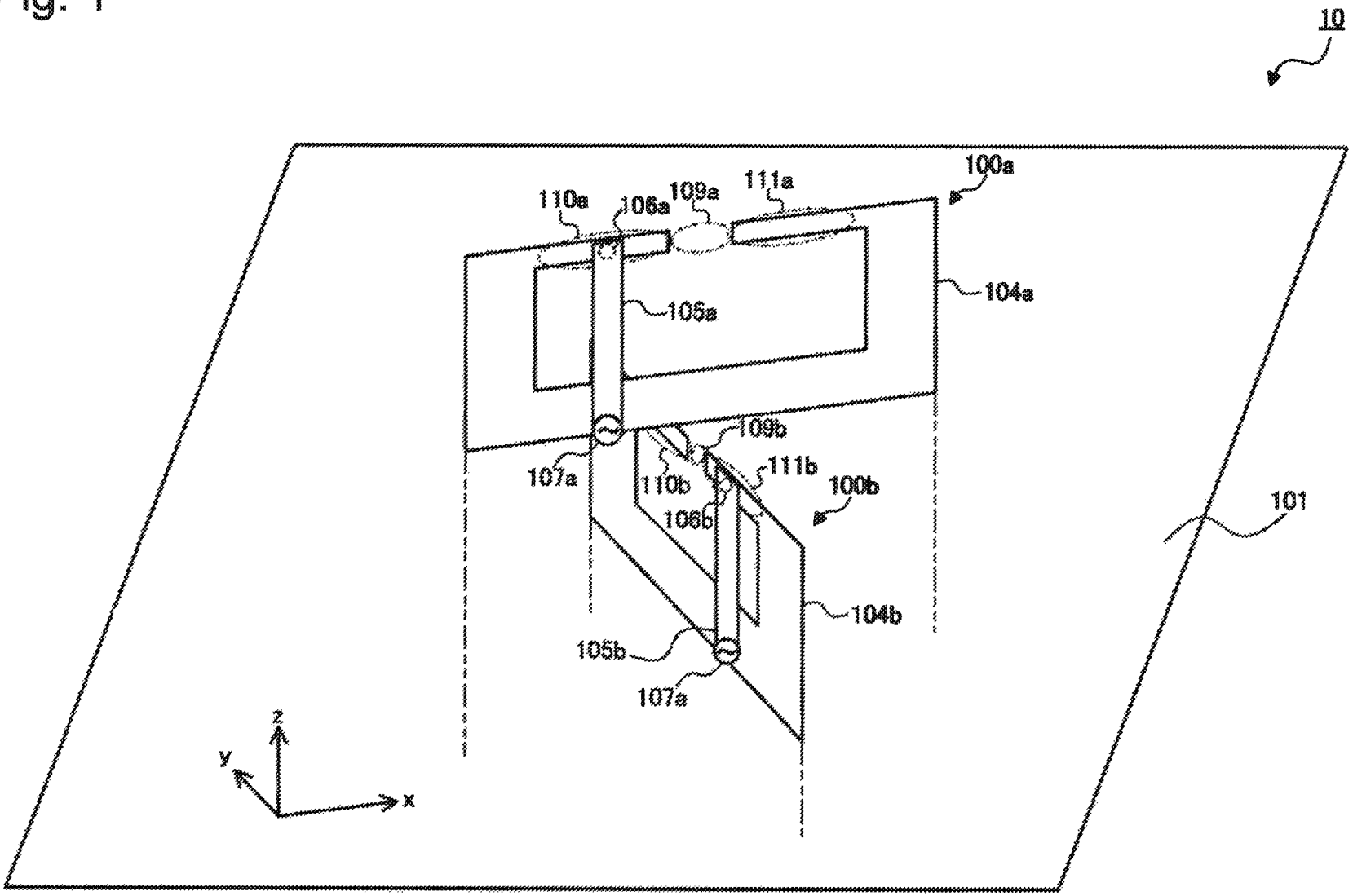
FIG. 1 is a perspective view of an antenna 10 according to a first example embodiment.
Figure 2:
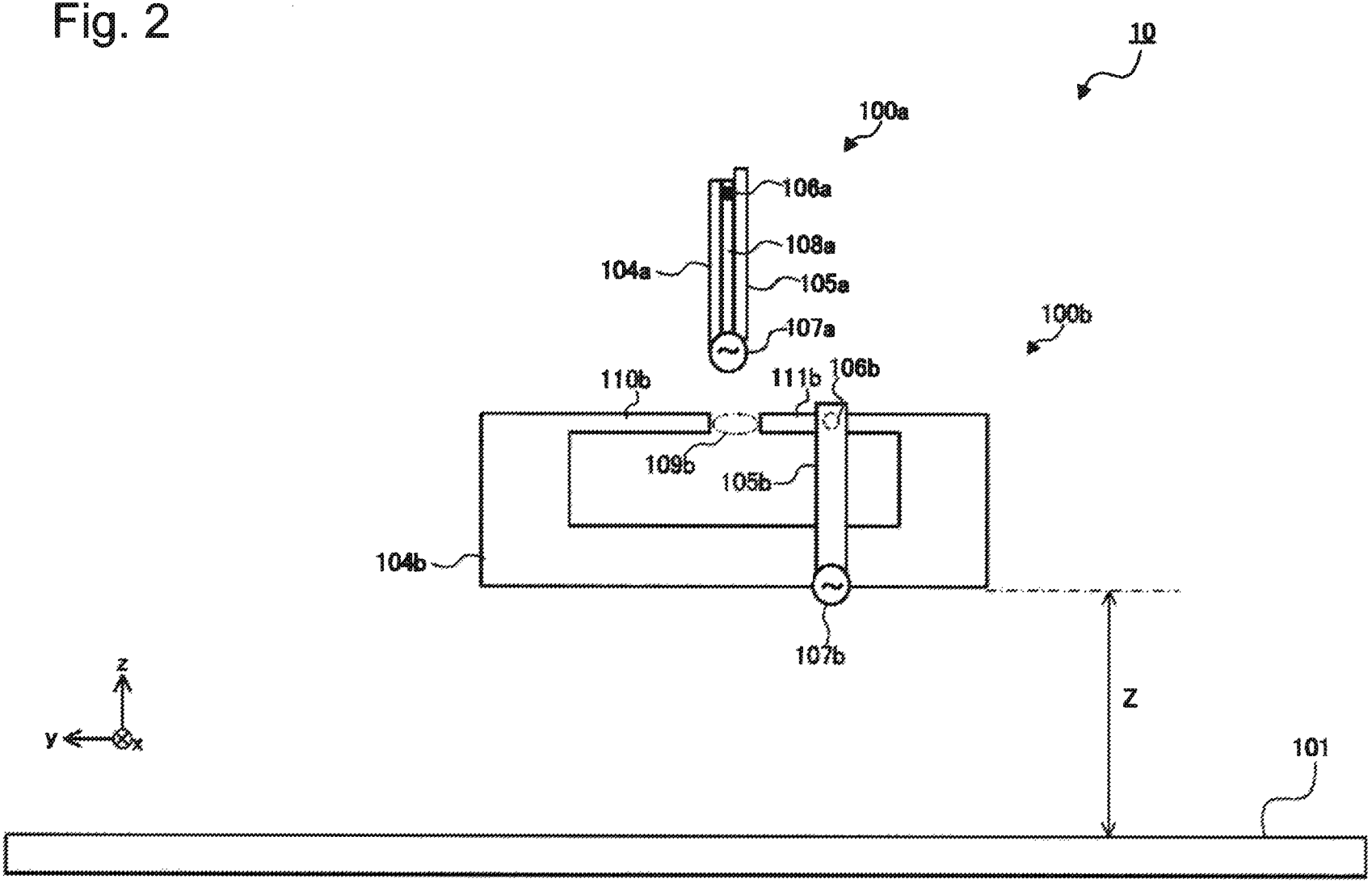
FIG. 2 is a front view of the antenna 10 according to the first example embodiment.
Figure 3:
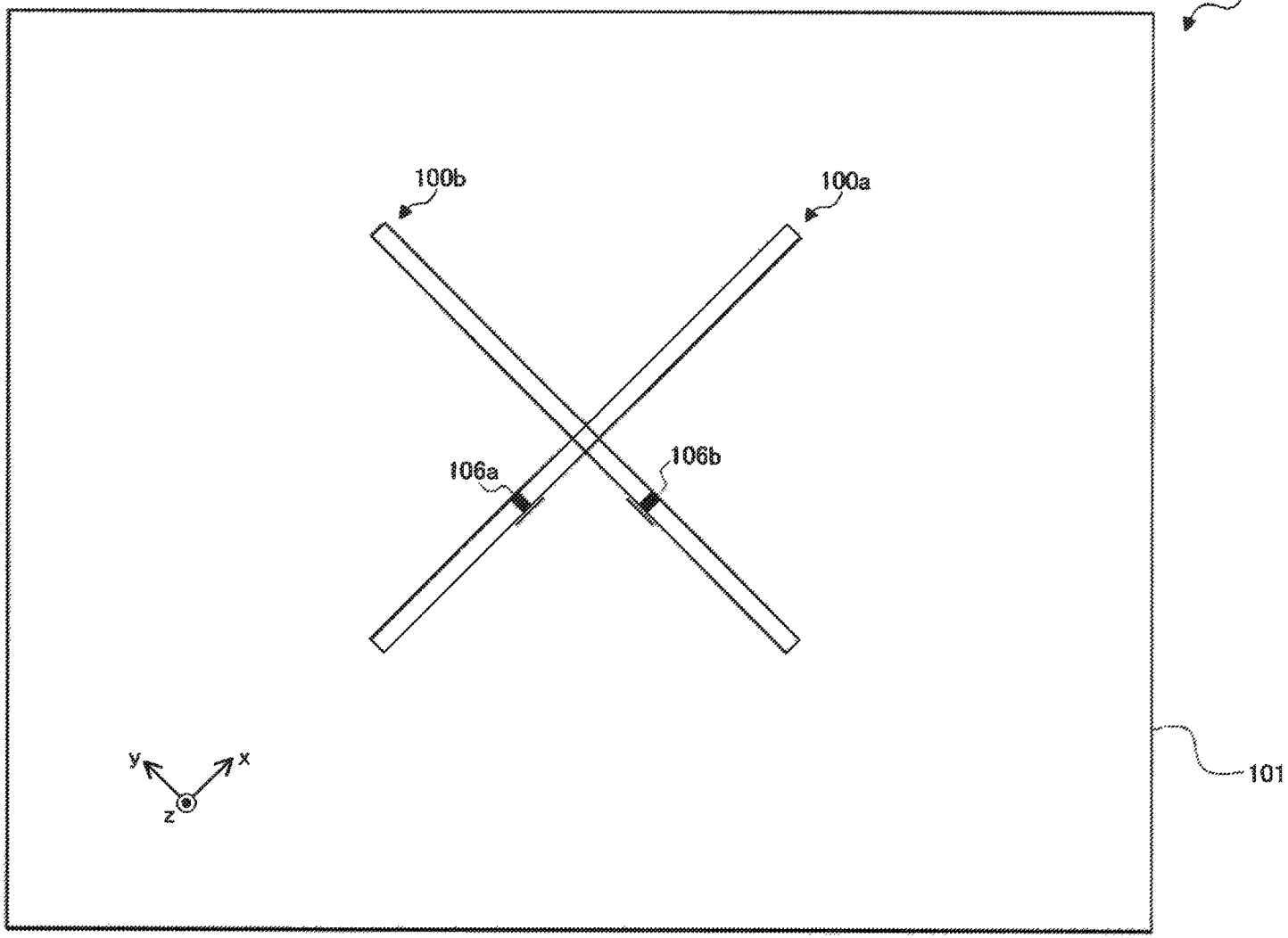
FIG. 3 is a plan view of the antenna 10 according to the first example embodiment.

An antenna 10 according to a first example embodiment of the present invention will be described. FIG. 1 is a perspective view of the antenna 10, FIG. 2 is a front view of the antenna 10, and FIG. 3 is a plan view of the antenna 10. In FIGS. 1 to 3, for description, an x axis and a y axis are defined on a plane created by a conductor reflection plate 101 to be described later, and a z axis is defined for a perpendicular line directed to an upper side of the plane created by the conductor reflection plate 101. Note that x, y, and z axes illustrated in other figures to be described later are also defined in the same manner.

The antenna 10 comprises an antenna element 100*a* as a first antenna element, an antenna element 100*b* as a second antenna element, and a conductor reflection plate 101. The first antenna element 100*a*, the second antenna element 100*b*, and the conductor reflection plate 101 are disposed in order of the conductor reflection plate 101, the second antenna element 100*b*, and the first antenna element 100*a* in the z-axis direction, as illustrated in FIGS. 1 to 3.

Note that in the following description, when any one of the first antenna element 100*a* and the second antenna element 100*b* is not specified, it may simply be referred to as an antenna element 100. Further, also regarding other components to be described later, when any one of a component provided for the antenna element 100*a* and a component provided for the antenna element 100*b* is not specified, description will be made by omitting reference signs a and b. Further, regarding components of the antenna element 100, when clearly specified for either the antenna element 100*a* or the antenna element 100*b*, a component will be discriminated by attaching any one of the reference sings a and b thereto.

Further, as illustrated in FIG. 3, the first antenna element 100*a* and the second antenna element 100*b* are disposed substantially orthogonally so that the first antenna element 100*a* and the second antenna element 100*b* partially overlap each other when projected on the conductor reflection plate 101. In other words, the first antenna element 100*a* is disposed above the second antenna element 100*b* with a rotation of substantially 90 degrees with respect to the second antenna element 100*b*. In examples illustrated in FIGS. 1 to 3, the first antenna element 100*a* is disposed in the x-axis direction, and the second antenna element 100*b* is disposed in the y-axis direction. Note that in the examples illustrated in FIGS. 1 to 3, the first antenna element 100*a* and the second antenna element 100*b* are disposed so that central axes of the first antenna element 100*a* and the second antenna element 100*b* are located along a certain perpendicular line in the conductor reflection plate 101.

A configuration of the antenna element 100 will be described. As illustrated in FIG. 1 and FIG. 2, the antenna element 100 includes, for example, a C-shaped conductor 104, a conductor power feed line 105, a conductor via 106, a power feed point 107, and a dielectric layer 108. Note that an illustration of the dielectric layer 108 is omitted in FIG. 1 to easily understand dispositions of other components. Further, in FIG. 2, the dielectric layer 108 is illustrated for the first antenna element 100*a*, but an illustration thereof is omitted for the second antenna element 100*b*, which, however, includes the dielectric layer 108 in the same manner as the first antenna element 100*a*. In figures to be described later, an illustration of the dielectric layer 108 will also be omitted, as appropriate.

The C-shaped conductor 104 is a conductor that functions as a split ring resonator, and is a substantially C-shaped conductor formed with a split part 109 so that a portion of an annular conductor is made discontinuous. In the examples illustrated FIG. 1 and FIG. 2, the C-shaped conductor 104 has a substantially rectangular shape, and on a long side thereof, the split part 109 is formed. The split part 109 is a portion in which an annular conductor is cut off. In other words, the split part 109 is a gap formed so that one end and the other end of the C-shaped conductor 104 oppose each other. A length of a longitudinal direction (equivalent to the x-axis direction with respect to the antenna element 100*a* and equivalent to the y-axis direction with respect to the antenna element 100*b*) of the C-shaped conductor 104 is, for example, approximately $\lambda/4$. Note that $\lambda$ indicates a wavelength observed when an electromagnetic wave, a frequency of which is a resonance frequency of an antenna element, travels in a material with which an area is filled.

The conductor power feed line 105 is a conductor that feeds power from the power feed point 107 to the C-shaped conductor 104. Therefore, the conductor power feed line 105 configures a current path for feeding power to the C-shaped conductor 104. The conductor power feed line 105 is, as illustrated in FIG. 1 and FIG. 2, for example, a conductor having a length substantially equal to a length of the z-axis direction of the C-shaped conductor 104.

Further, the dielectric layer 108 is a plate-like dielectric material. The dielectric layer 108 is, for example, a layer of a dielectric material configuring a board. The dielectric layer 108 is a layer between a layer where the C-shaped conductor 104 exists and a layer where the conductor power feed line 105 exists.

The C-shaped conductor 104 is disposed on one face side of the dielectric layer 108. Further, the conductor power feed line 105 is disposed on the other face side of the dielectric layer 108 and opposes the C-shaped conductor 104 across the dielectric layer 108 by leaving a gap.

The conductor via 106 is a via that electrically connects one conductor part of both conductor parts 110 and 111 of the C-shaped conductor 104 opposing each other in a circumferential direction across the split part 109 and one end of the conductor power feed line 105. In the examples illustrated in FIG. 1 and FIG. 2, the conductor via 106 is a via that electrically connects the conductor part 110 on a long side of a far side (a side where a coordinate of the z axis is larger) from the conductor reflection plate 101 in the long side of the C-shaped conductor 104 and one end of the conductor power feed line 105.

The power feed point 107 is a point to which high frequency power is fed from a power feed source that is not illustrated. More specifically, the power feed point 107 is a power feed point capable of electrically performing excitation between the other end (a side that is not connected to the conductor via 106) of the conductor power feed line 105 and a portion of the C-shaped conductor 104 near the other end. In the examples illustrated in FIG. 1 and FIG. 2, the power feed point 107 can electrically perform excitation between a portion of the C-shaped conductor 104 at a position opposing the conductor part 110 in the z-axis direction and the other end of the conductor power feed line 105. In this manner, the antenna element 100 is configured to feed high frequency power to the conductor part 110 or 111 of the C-shaped conductor 104 and a conductor part on the C-shaped conductor 104 opposing the conductor part 110 or 111 in an inward direction of the C-shaped conductor 104 by leaving a gap. The power feed point 107 is connected to, for example, a wireless communication circuit, not illustrated, or a transmission line that transmits wireless signals from a wireless communication circuit, not illustrated, and can thereby transfer wireless communication signals between the wireless communication circuit and the antenna 10 via the power feed point 107.

Further, in the present example embodiment, the antenna element 100*a* and the antenna element 100*b* are disposed separately from each other by a predetermined gap in the z-axis direction. Further, the antenna element 100 and the conductor reflection plate 101 are disposed separately from each other by a predetermined gap (a distance Z illustrated in FIG. 2) in the z-axis direction. The conductor reflection plate 101 becomes a short-circuited plane, and therefore, the distance Z is preferably substantially $\lambda/4$ to suppress an influence on resonance characteristics of the antenna element.

Note that the conductor reflection plate 101, the C-shaped conductor 104, the conductor power feed line 105, the conductor via 106, and those expressed as conductors in the following description are configured using, for example, metal such as copper, silver, aluminum, and nickel, or other good conductor materials.

Further, the C-shaped conductor 104, the conductor power feed line 105, the conductor via 106, and the dielectric layer 108 are generally produced in a common board production process for printed circuit boards, semiconductor boards, and the like, but may be produced using other methods.

Further, the conductor via 106 is generally formed by plating a through-hole formed by drilling a hole in the dielectric layer 108, but any via is employable when interlayer connection can be electrically made. The conductor via 106 may be configured using a laser via formed with a laser or may be configured using copper wire or the like.

Further, the dielectric layer 108 may be omitted. Further, it is possible that the dielectric layer 108 is configured using only a supporting member that is partially dielectric, and at least a portion thereof is hollow.

Further, the conductor reflection plate 101 is generally formed using sheet-metal or copper foil stuck to a dielectric substrate and may be formed using other materials as long as the materials are conductive.

Next, actions and effects of the present example embodiment will be described.

According to the antenna element 100 of the present example embodiment, the C-shaped conductor 104 functions as an LC series resonator in which an inductance resulting from current flowing along a ring and a capacitance generated between conductors opposing each other in the split part 109 are connected in series. In other words, the C-shaped conductor 104 functions as a split ring resonator. In a resonance frequency vicinity of the split ring resonator, large current flows in the C-shaped conductor 104, which, thereby, operates as an antenna by a fact that a portion of current components contributes to radiation.

At this time, in the current flowing in the C-shaped conductor 104, current mainly contributing to radiation is a current component of a longitudinal direction (equivalent to the x-axis direction with respect to the antenna element 100*a* and equivalent to the y-axis direction with respect to the antenna element 100*b*) of the antenna element 100. Therefore, when a length of a longitudinal direction of the C-shaped conductor 104 is increased, excellent radiation efficiency can be achieved. The length of the longitudinal direction (equivalent to the x-axis direction with respect to the antenna element 100*a* and equivalent to the y-axis direction with respect to the antenna element 100*b*) of the C-shaped conductor 104 is, for example, approximately $\lambda/4$, and therefore, size reduction can be achieved, compared with when a dual polarization wave antenna is configured using a dipole antenna.

The C-shaped conductor 104 of the antenna element 100 illustrated in FIG. 1 and FIG. 2 has a substantially rectangular shape, but even when the antenna elements 100*a* and 100*b* have another shape, an essential effect of the present invention is not affected when dispositions of the antenna elements 100*a* and 100*b* are the dispositions illustrated in FIGS. 1 to 3 as described above. A shape of the antenna elements 100*a* and 100*b* may be, for example, a square, a circle, a triangle, or a bow-tie shape.

Further, regarding the resonance frequency of the above-described split ring resonator, when inductance is increased by increasing a ring size of the split ring (the C-shape conductor 104) and extending a current path or capacitance is increased by narrowing a gap between conductors opposing each other in the split part 109, frequency reduction can be achieved. Specifically, a method for narrowing a gap between conductors opposing each other in the split part 109 is suitable for size reduction, since while a loss is increased due to concentration of an electric field in the split part 109, frequency reduction can be performed for an operation frequency without increasing the entire size.

As described above, when above the conductor reflection plate 101, two C-shaped conductors 104 that have a small size and achieve excellent radiation efficiency are disposed substantially orthogonally so that portions thereof overlap each other in a projection drawing to the conductor reflection plate 101, it is possible to provide a dual polarization wave antenna smaller than a conventional antenna while maintaining radiation efficiency.

Note that when the antenna elements 100*a* and 100*b* resonate electromagnetically, a vicinity of both ends thereof of a longitudinal direction (equivalent to the x-axis direction with respect to the antenna element 100*a* and equivalent to the y-axis direction with respect to the antenna element 100*b*) becomes an electrically open plane, resulting in strong electric field intensity and weak magnetic field intensity. A vicinity of a substantially central portion in the longitudinal direction of the antenna elements 100*a* and 100*b* becomes an electrically short-circuited plane, resulting in strong magnetic field intensity and weak electric field intensity.

Therefore, upon disposing the antenna elements 100*a* and 100*b* substantially orthogonally in a projection drawing to the conductor reflection plate 101, when the antenna elements 100*a* and 100*b* are disposed so that substantially central portions thereof overlap each other as illustrated in FIG. 3, portions having strong electric field intensity are not close to each other, and a rotational symmetry of substantially 90° is created for a magnetic field. Therefore, coupling of the antenna elements can be suppressed.

Note that the split part 109 of the C-shaped conductor 104 is a central portion of the antenna element, but strong electric field intensity is achieved during resonance as descried above. However, only in a portion of a space sandwiched by the conductor parts 110 and 111 opposing each other, strong electric field intensity is achieved, and upon moving away from the split part 109, the electric field intensity rapidly decreases and therefore, an effect of suppressing coupling of the antenna elements is not inhibited.

The antenna 10 of the present example embodiment may be appropriately incorporated as an antenna unit in, for example, a radar, a wireless communication device such as Wi-Fi, and a mobile communication base station.

Figure 4:
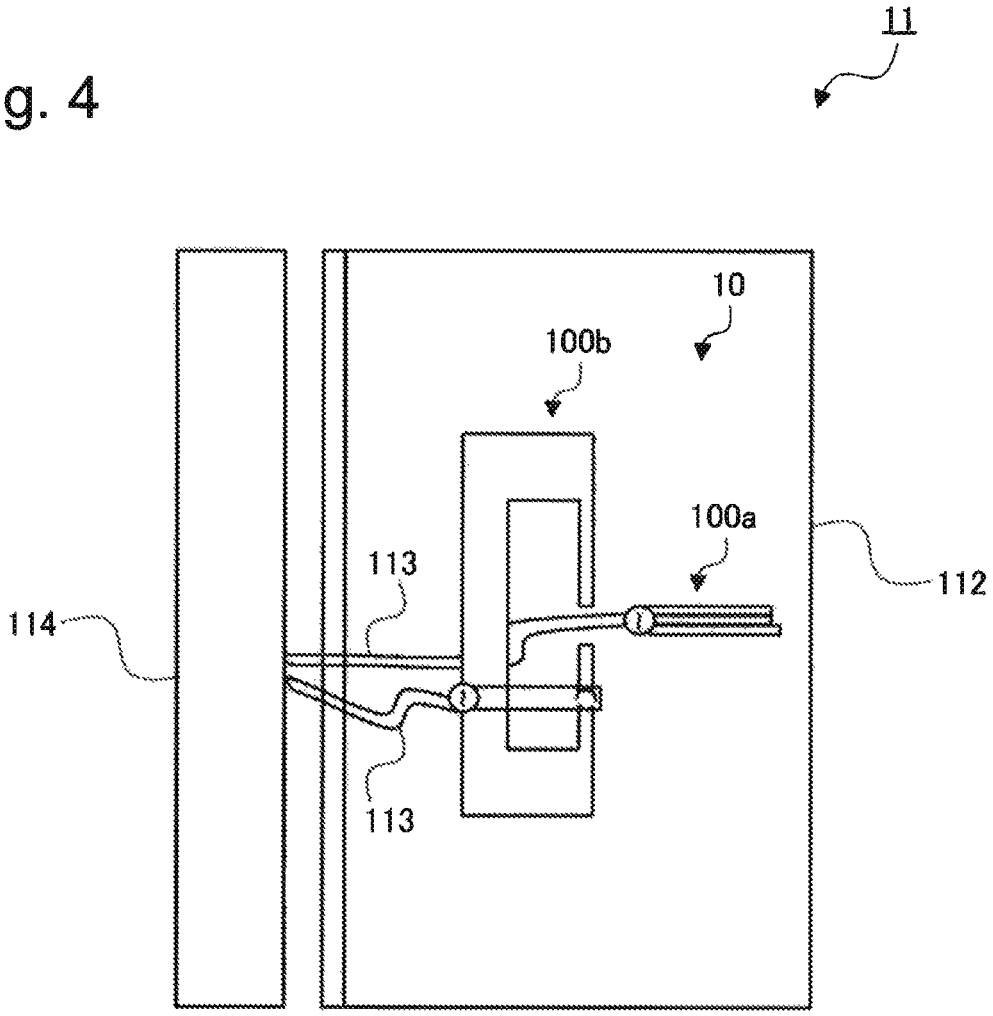
FIG. 4 is a schematic diagram illustrating a wireless communication device 11 including the antenna 10 according to the first example embodiment.

FIG. 4 illustrates a wireless communication device 11 that is one example of a wireless communication device including the antenna 10. The wireless communication device 11 illustrated in FIG. 4 comprises an antenna 10, a dielectric radome 112 that mechanically protects the antenna 10, a wireless communication circuit unit 114, and a transmission line 113 that transmits wireless signals between an antenna element 100 in the antenna 10 and the wireless communication circuit unit 114. Note that in FIG. 4, the dielectric radome 112 is illustrated as a transparent radome to simplify the illustration. Such a configuration makes it possible to achieve size reduction for a wireless communication device using a dual polarization wave antenna while maintaining radiation efficiency.

Figure 5:
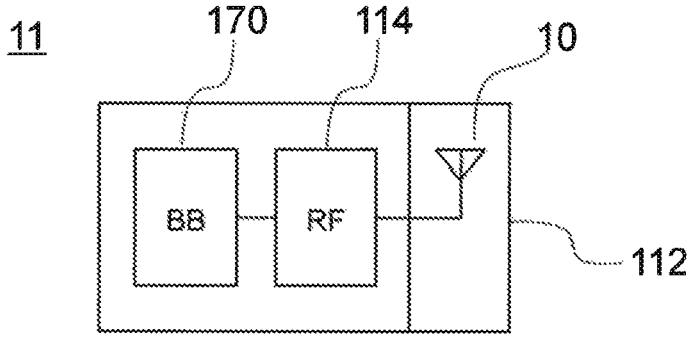
FIG. 5 is a schematic diagram illustrating another example of the wireless communication device 11 including the antenna 10 according to the first example embodiment.

Further, the wireless communication device 11 may further include, for example, a baseband circuit 170 that executes signal processing, as illustrated in FIG. 5.

Figure 6:
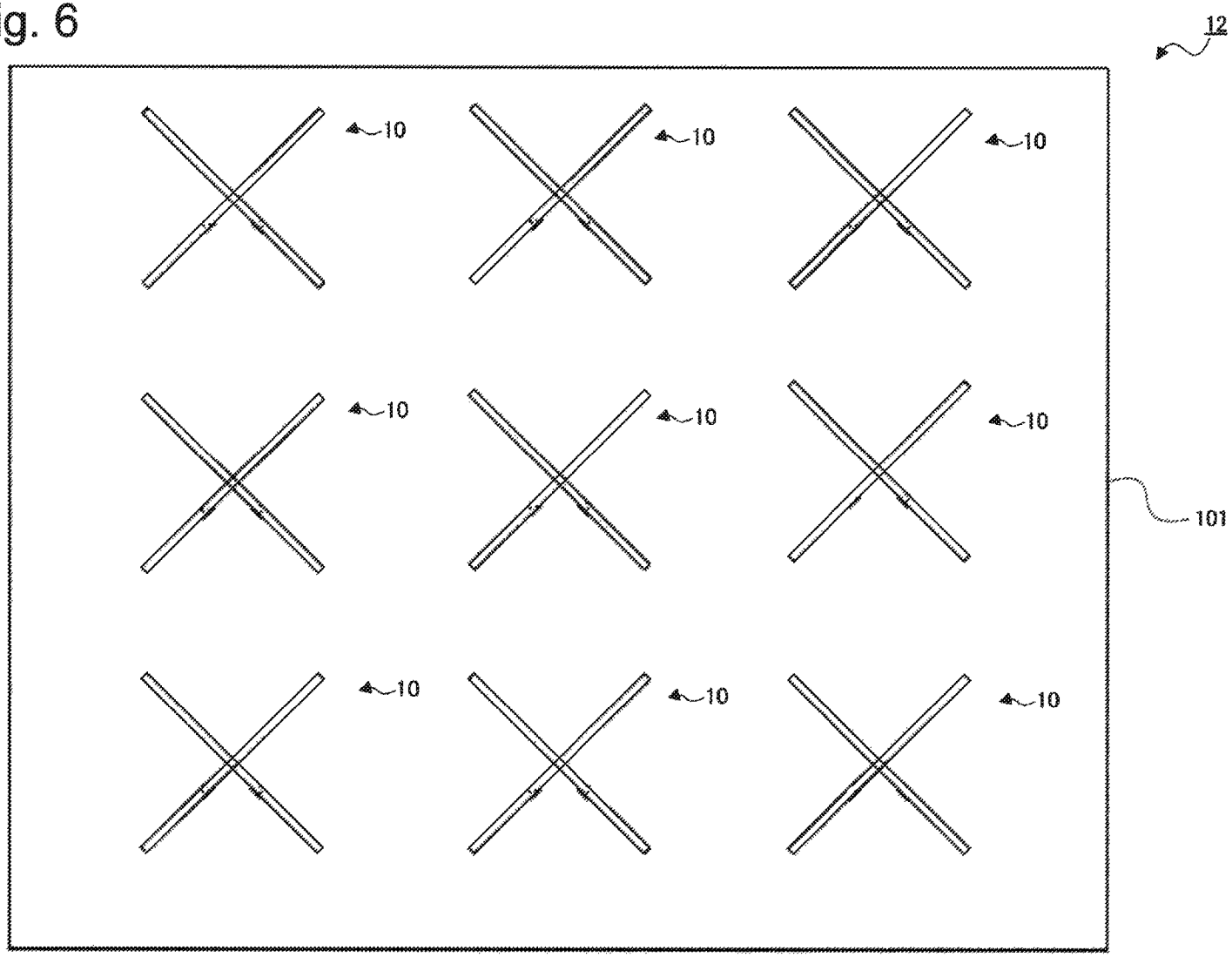
FIG. 6 is a schematic diagram illustrating an antenna array 12 including a plurality of the antennas 10 according to the first example embodiment.

Further, an antenna array may be configured using a plurality of the above-described antennas 10. FIG. 6 is a diagram illustrating an antenna array 12 that is one example of an antenna array configured using a plurality of antennas 10. The antenna array 12 has a configuration in which, for example, a plurality of antennas 10 are arrayed separately from each other at intervals of approximately half a wavelength of an electromagnetic wave having a frequency that is a resonance frequency of the antenna element 100. Such a configuration makes it possible to provide an antenna array mounted with a dual polarization wave antenna reduced in size while maintaining radiation efficiency. Note that when a configuration in which a plurality of antenna elements are arrayed separately from each other at intervals of approximately half the wavelength as described above is made, size reduction can be achieved for an external shape of an antenna array by at least a size reduction portion of an antenna disposed on the outermost side. In FIG. 6, one conductor reflection plate 101 coupled with all the antennas 10 is provided without limitation thereto. The conductor reflection plate 101 may be provided, for example, for each antenna 10. Further, when a plurality of antennas 10 are arrayed, it is not always necessary for the antennas 10 to be arrayed at regular intervals or in a translationally symmetrical manner, and it is possible for the antennas 10 to be arrayed rotationally in irregular intervals.

Figure 7:
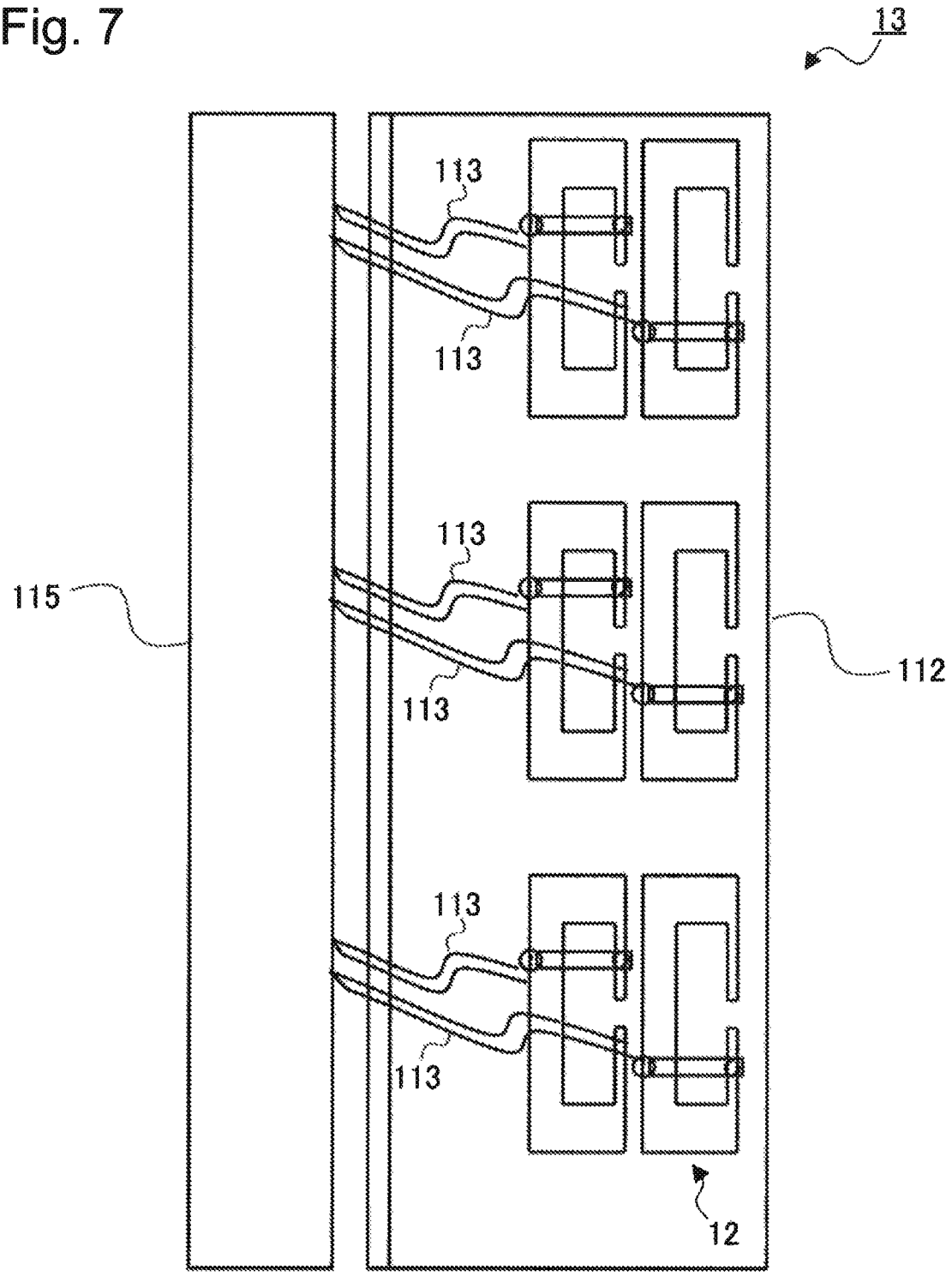
FIG. 7 is a schematic diagram illustrating a base station device 13 configured using the antenna array 12.

Further, a base station device may be configured using the above-described antenna array 12. FIG. 7 is a diagram illustrating a base station device 13 that is one example of a base station device configured using the antenna array 12. Note that in the same manner as in FIG. 4, the dielectric radome 112 is illustrated as a transparent radome to simplify the illustration. The base station device 13 includes an antenna array 12, a dielectric radome 112, a transmission line 113, and a wireless communication circuit unit 115. Note that the base station device 13 may include, in addition thereto, for example, a baseband circuit 170 that executes signal processing in the same manner as a wireless communication device of FIG. 5, and may perform beam forming control using the antenna array 12, the wireless communication circuit unit 115, and the baseband circuit 170. Such a configuration makes it possible to provide a base station mounted with a dual polarization wave antenna reduced in size while maintaining radiation efficiency. Note that in the same manner as the above-described antenna array 12, size reduction can be achieved for an external shape of the base station by at least a size reduction portion of an antenna disposed on the outermost side.

Further, various types of modified examples of the present example embodiment will be described. Various types of modified examples to be described below may be appropriately combined.

Figure 8:
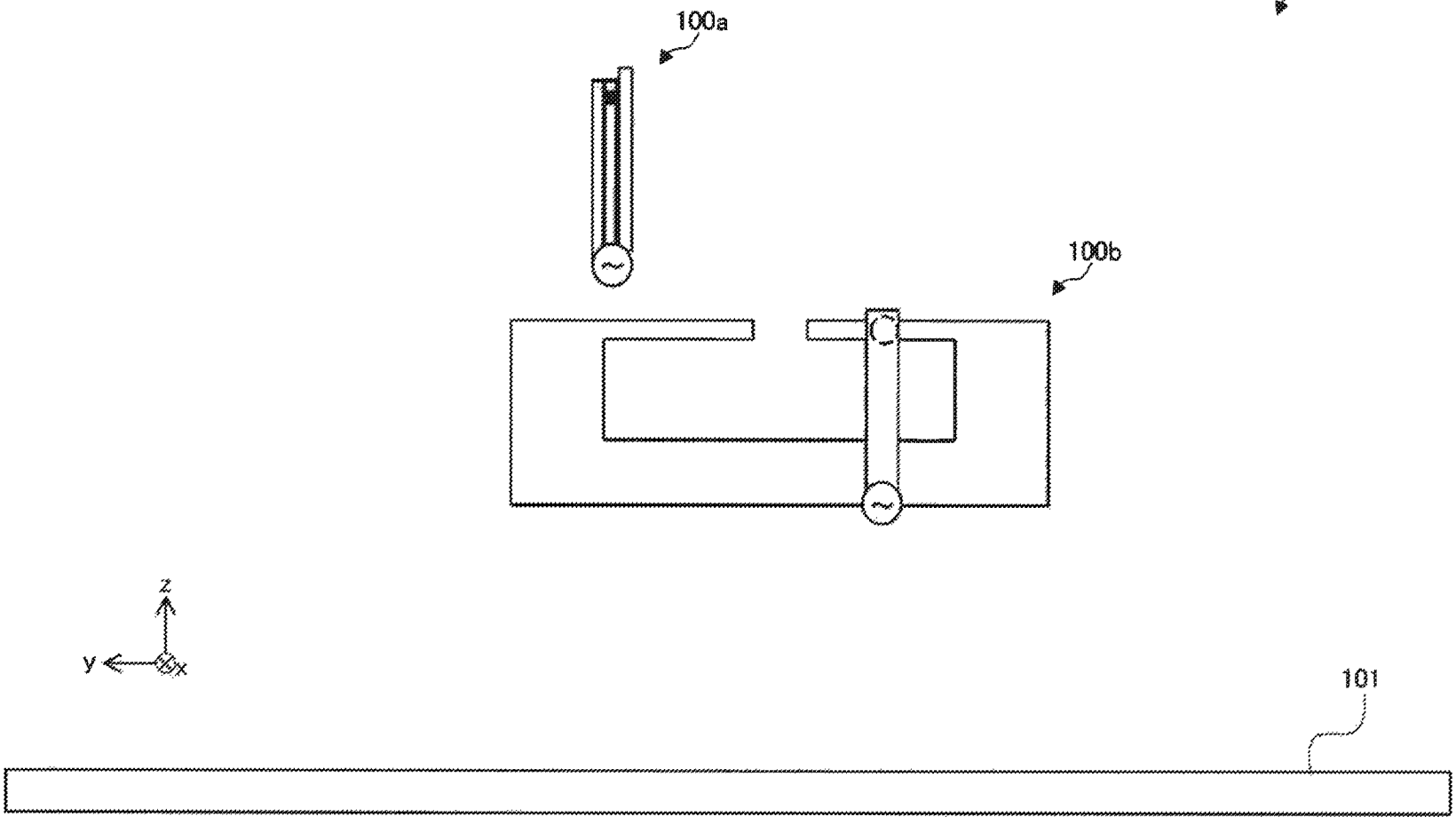
FIG. 8 is a front view of the antenna 10 in which an intersection position of an antenna element 100 is changed.
Figure 9:
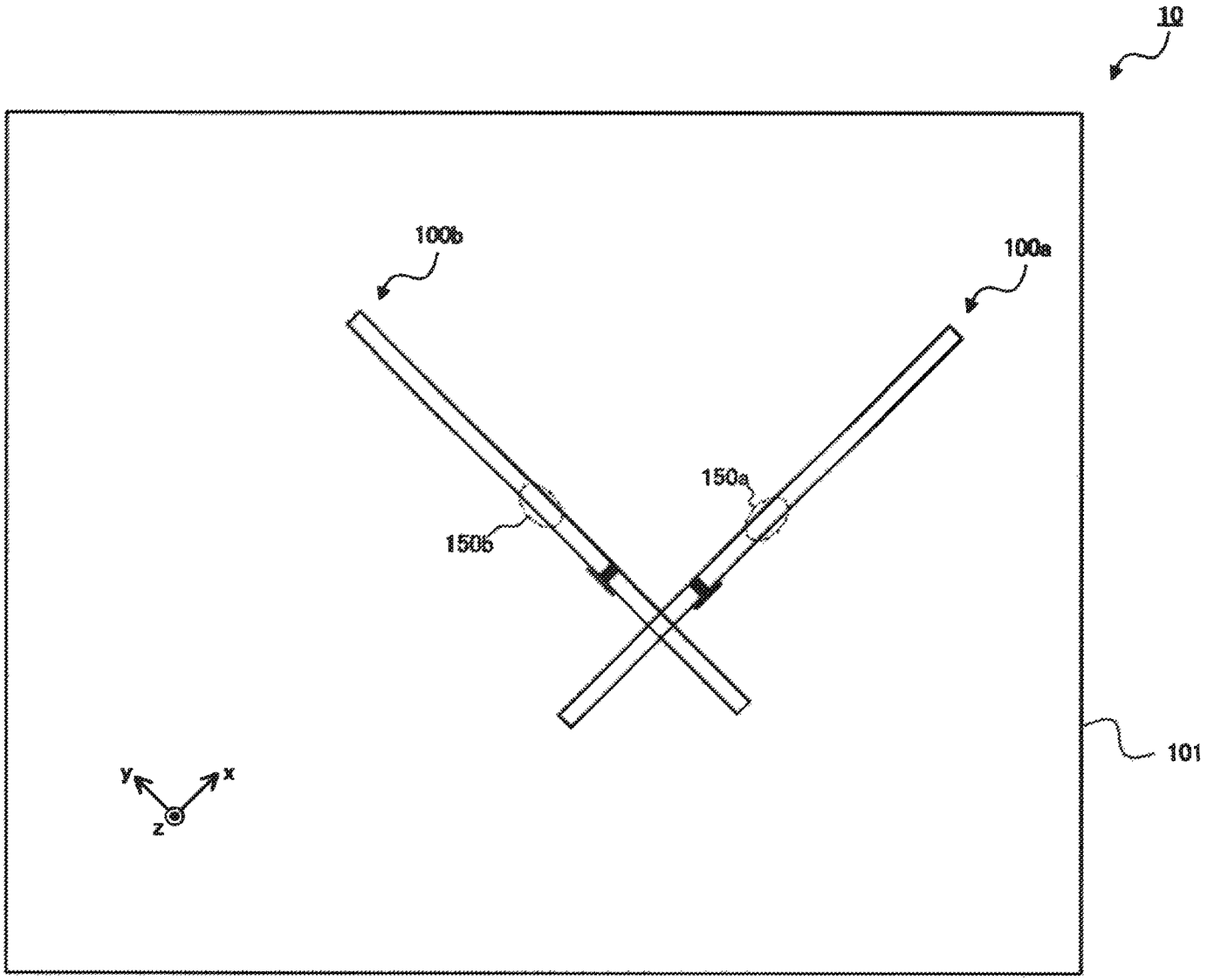
FIG. 9 is a plan view of the antenna 10 in which an intersection position of the antenna element 100 is changed.

As described above, to suppress coupling between antenna elements, the antenna elements 100*a* and 100*b* are preferably disposed so that substantially central portions thereof overlap each other as illustrated in FIG. 3, but it is not always necessary for these antenna elements to be disposed so that the substantially central portions overlap each other. FIG. 8 and FIG. 9 are diagrams illustrating another disposition example. FIG. 8 is a front view of the antenna 10 in another disposition example, and FIG. 9 is a plan view thereof. In an example illustrated in FIG. 8 and FIG. 9, the antenna elements 100*a* and 100*b* are disposed so that the antenna elements 100*a* and 100*b* overlap each other at a position shifted from a substantially central portion 150 in a longitudinal direction of each of these antenna elements in a projection drawing to the conductor reflection plate 101. In this manner, a disposition may be made to make an overlap at a position other than the substantially central portion 150.

Figure 10:
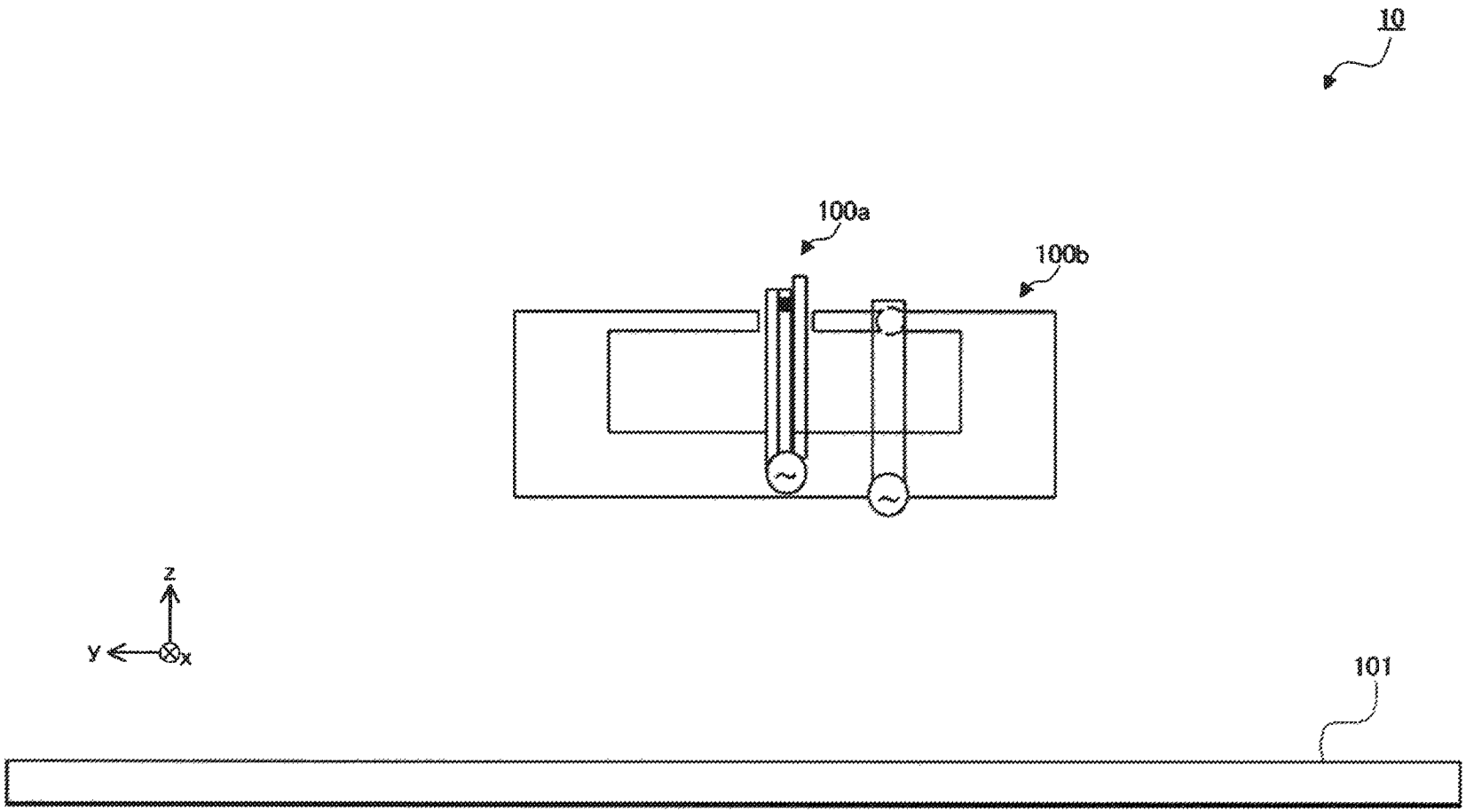
FIG. 10 is a front view of the antenna 10 in which a disposition of the z-axis direction is changed.

Further, in a disposition of the antenna elements 100*a* and 100*b* in a direction (z-axis direction) vertical to the conductor reflection plate 101, it is preferable that mutual resonance characteristics of the antenna elements be not changed to a large extent and distances from the conductor reflection plate 101 be the same as much as possible. Therefore, as illustrated in FIG. 2, the antenna elements 100*a* and 100*b* preferably become as close as possible to each other without overlapping each other. However, it is not always necessary for the antenna element 100*a* and the antenna element 100*b* to be disposed by leaving a gap. A disposition may be made, for example, as illustrated in FIG. 10. In an example illustrated in FIG. 10, the antenna element 100*a* and the antenna element 100*b* are disposed by overlapping each other in the z-axis direction. In this manner, it is possible that, for example, a cut is made in one antenna element and antenna elements are disposed so as to be close to each other or be in contact with each other.

Figure 11:
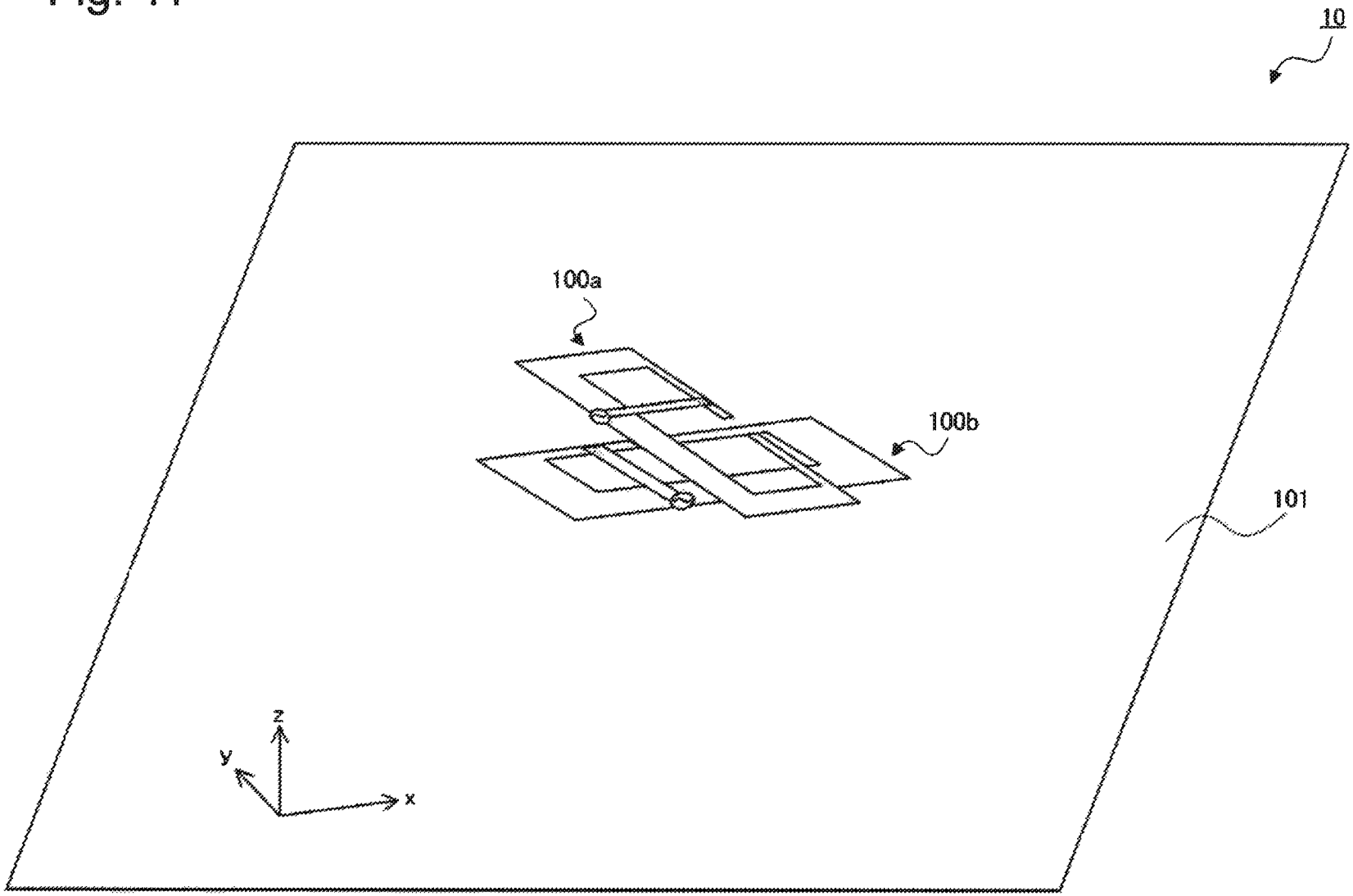
FIG. 11 is a perspective view of the antenna 10 in which a posture of the antenna element 100 with respect to a conductor reflection plate 101 is changed.
Figure 12:
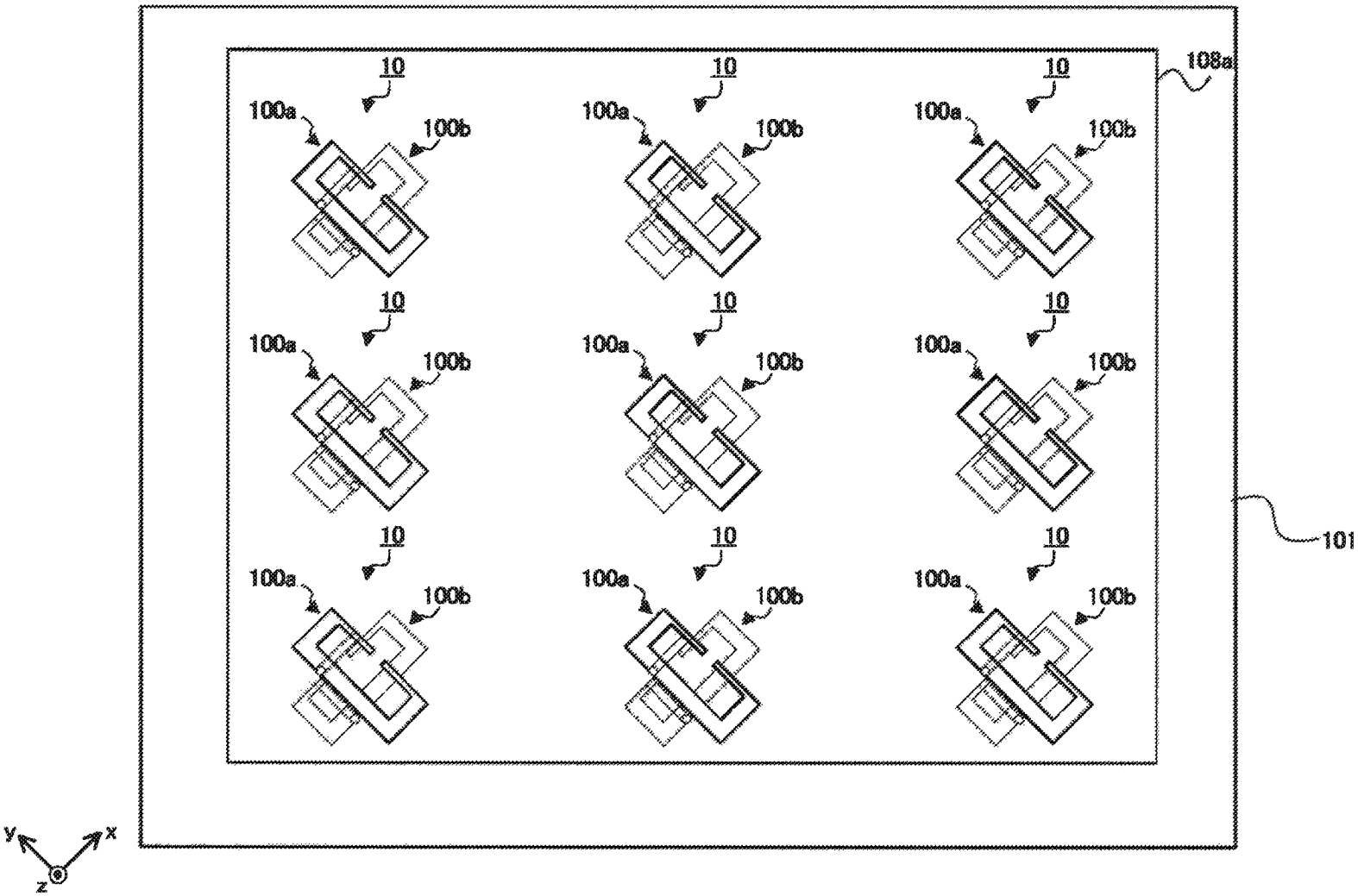
FIG. 12 is a plan view illustrating one example of an array antenna including the antenna 10 in which a posture of the antenna element 100 with respect to the conductor reflection plate 101 is changed.

Further, in the above-described example embodiment, as illustrated in FIG. 1 and FIG. 2, the antenna elements 100*a* and 100*b* have been disposed in a posture inverted to the conductor reflection plate 101, but the present invention is not limited thereto. As illustrated in FIG. 11, for example, the antenna elements 100*a* and 100*b* may be disposed in a posture parallel to the conductor reflection plate 101. In FIG. 11, an illustration of the dielectric layer 108 is omitted to simplify description. Further, in this case, the antenna elements 100*a* and 100*b* may be formed in layers of the same board, respectively, to form an integrated board. Further, when an array antenna in which a plurality of antennas 10 are arrayed is configured, the plurality of antennas 10 may be produced in the same board. Such a configuration makes it possible to reduce man-hours for positioning a plurality of antenna elements, resulting in easy assembling. Further, as illustrated in FIG. 12, when an array antenna in which a plurality of antennas 10 are arrayed is configured, the dielectric layer 108 may be shared by the antennas 10. At this time, for the antenna element 100*a* of each antenna 10, a first dielectric layer 108*a* is shared, and for the antenna element 100*b* of each antenna 10, a second dielectric layer 108*b* is shared. In FIG. 12, to simplify description, a situation where the first dielectric layer 108*a* is shared by the respective antenna elements 100*a* is illustrated, but the second dielectric layer 108*b* is also shared by the respective antenna elements 100*b* in the same manner.

Figure 13:
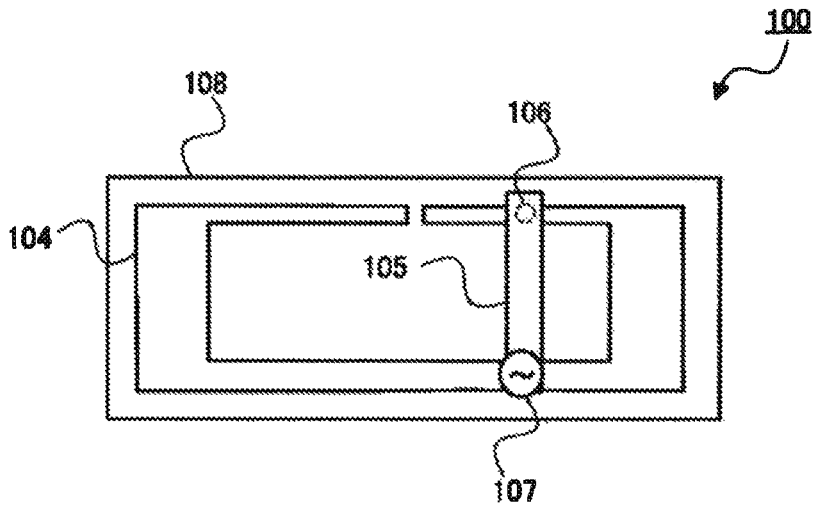
FIG. 13 is a front view illustrating a modified example of a configuration of the antenna element 100.

Further, it is not always necessary for the antenna element 100 to have the configuration illustrated in FIGS. 1 and 2, and further arrangement/improvement may be made on the configuration. FIG. 13 to FIG. 17 are diagrams illustrating various types of modified examples of the configuration of the antenna element 100. For example, as illustrated in FIG. 13, the dielectric layer 108 may be formed with a size larger to that of the C-shaped conductor 104. In this manner, when the dielectric layer 108 is allowed to be larger than the C-shaped conductor 104, it is possible to prevent degradation in dimension accuracy of the C-shaped conductor 104 due to cutting of an edge of the dielectric layer 108 associated with formation of the dielectric layer 108.

Figure 14:
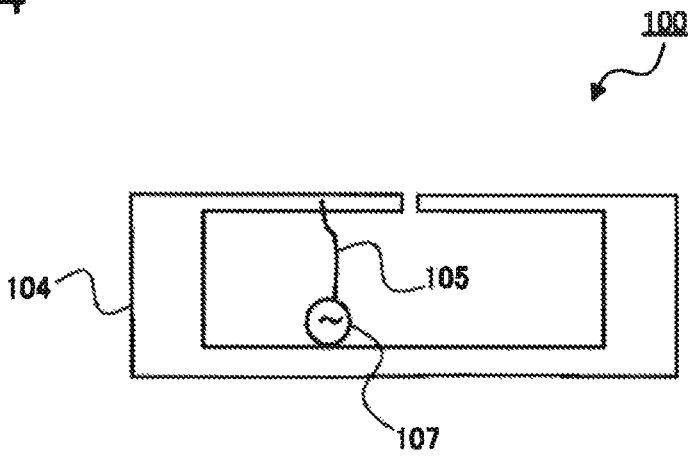
FIG. 14 is a plan view illustrating a modified example of the configuration of the antenna element 100.

Further, it is possible that one end of the conductor power feed line 105 is directly coupled by electric conduction with a portion (the conductor part 110 or 111) on a long side of a far side from the conductor reflection plate 101 of the C-shaped conductor 104 and the conductor via 106 is omitted. Further, as illustrated in FIG. 14, for example, the conductor power feed line 105 may be a liner conductor such as copper wire.

Figure 15:
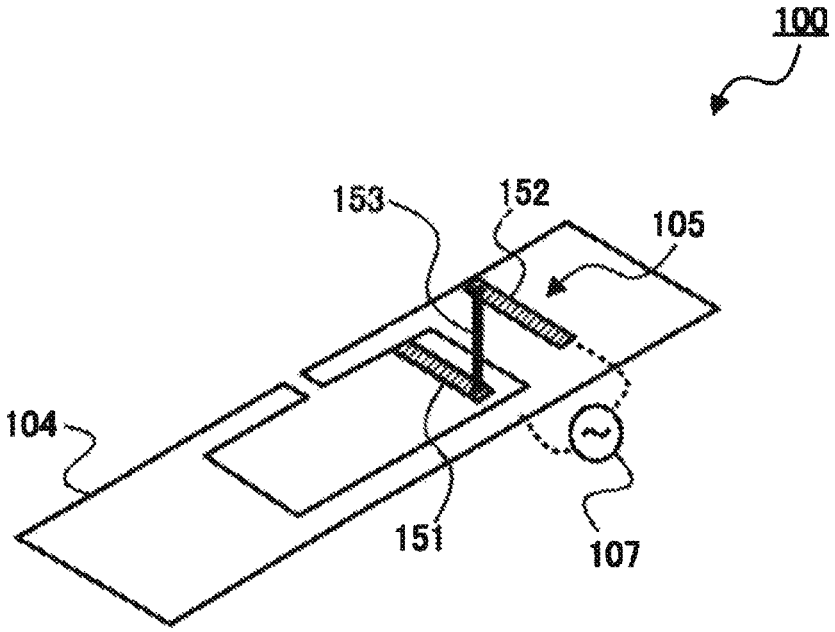
FIG. 15 a perspective view illustrating a modified example of the configuration of the antenna element 100.

Further, to avoid contact between the other end of the conductor power feed line 105 and the C-shaped conductor 104, the antenna element 100 may be configured using a plurality of conductor power feed lines. As illustrated in FIG. 15, for example, conductor power feed lines 151 and 152 and a conductor via 153 may be provided. The conductor power feed line 151 is located in the same layer as the C-shaped conductor 104, and the conductor power feed line 152 is located in a layer different from the C-shaped conductor 104. Further, one end of the conductor power feed line 151 is electrically connected to the conductor part 110 or 111 of the C-shaped conductor 104. Further, one end of the conductor power feed line 152 is electrically connected to the power feed point 107. In addition, the other end of the conductor power feed line 151 and the other end of the conductor power feed line 152 are electrically connected to each other via the conductor via 153. In the figure, dotted lines extending from the power feed point 107 indicate current paths to the conductor power feed line and the C-shaped conductor.

Figure 16:
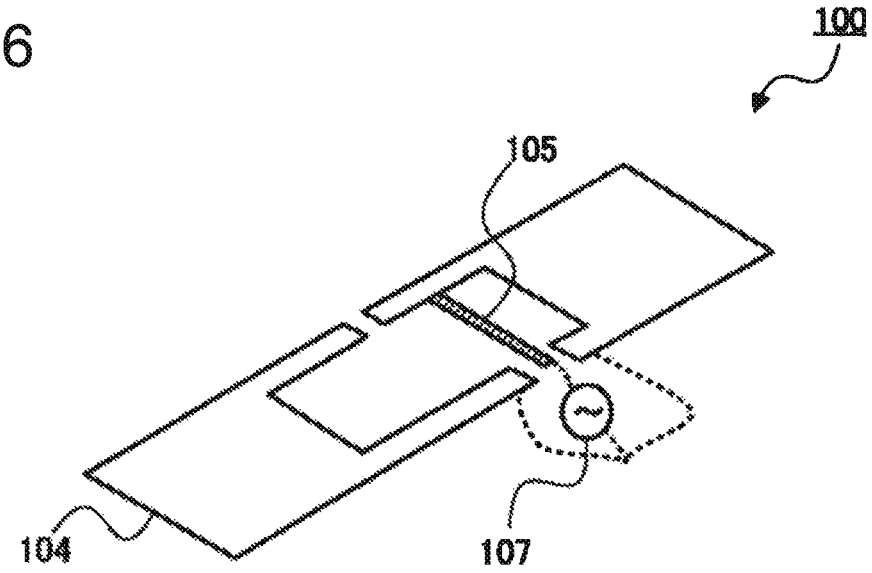
FIG. 16 a perspective view illustrating a modified example of the configuration of the antenna element 100.
Figure 17:
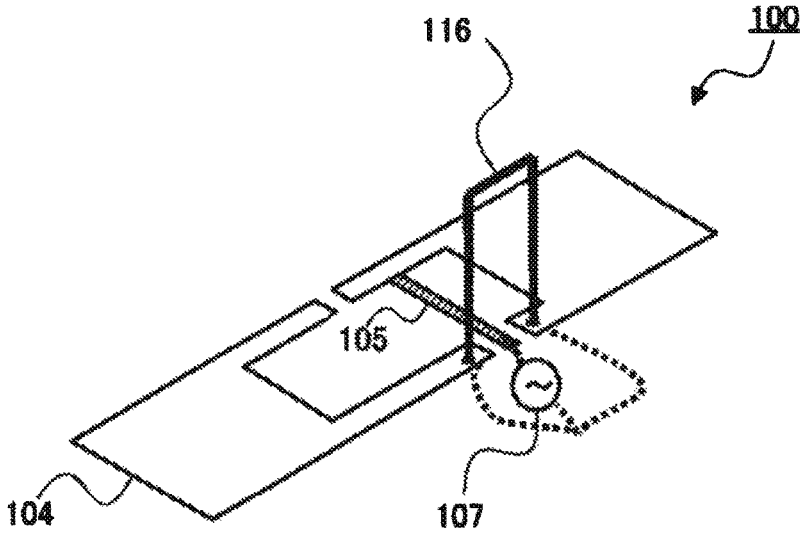
FIG. 17 a perspective view illustrating a modified example of the configuration of the antenna element 100.

Further, a configuration may be made as illustrated in FIG. 16. In an example illustrated in FIG. 16, a cut is made in a portion of the C-shaped conductor 104 on a long side which is a side near to the conductor reflection plate 101. In addition, the conductor power feed line 105 is passed through the cut portion. Further, the power feed point 107 is provided so as to electrically perform excitation between the conductor power feed line 105 and an C-shaped conductor 140 edge where the cut is formed. In the case of such a configuration, the C-shaped conductor 104 and the conductor power feed line 105 can be formed in the same layer, and therefore, production can be performed easily. However, further arrangement/improvement can be made to compensate for the degradation in radiate characteristics of the split ring resonator due to a cut in the C-shaped conductor 104. As illustrated in FIG. 17, the antenna element 100 may include, for example, a cross-linked conductor 116 to cause a cut portion of the split ring resonator to be electrically conductive to the conductor power feed line 105 without contact therewith.

In addition, for the antenna element 100, further arrangement/improvement can be made to enhance electric characteristics.

Figure 18:
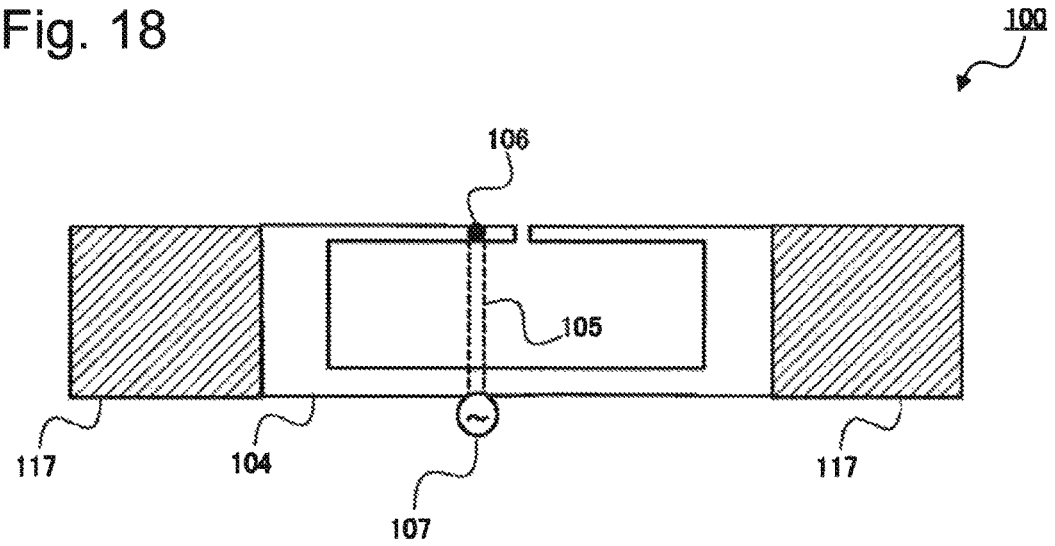
FIG. 18 is a front view of the antenna element 100 modified to provide a conductor radiation unit for a C-shaped conductor 104.

As described above, in current flowing into the C-shaped conductor 104, current mainly contributing to radiation is a current component of a longitudinal direction (equivalent to the x-axis direction with respect to the antenna element 100*a* and equivalent to the y-axis direction with respect to the antenna element 100*b*) of the antenna element 100. Therefore, as illustrated in FIG. 18, the antenna element 100 may include, for example, a conductor radiation unit 117 that is conductive on both ends of a longitudinal direction of the C-shaped conductor 104. In other words, the conductor radiation unit 117 is electrically connected to an outer edge located in both ends of the C-shaped conductor 104 in a direction where both conductor ports 110 and 111 oppose each other. Note that the conductor radiation unit 117 is a conductor and may be the same material as the C-shaped conductor 104. Such a configuration makes it possible to guide a current component of a longitudinal direction of the C-shaped conductor 104 contributing radiation to the conductor radiation unit 117, and therefore, radiation efficiency can be enhanced. Note that the conductor radiation unit 117 may be disposed only in one end of the C-shaped conductor 104.

Figure 19:
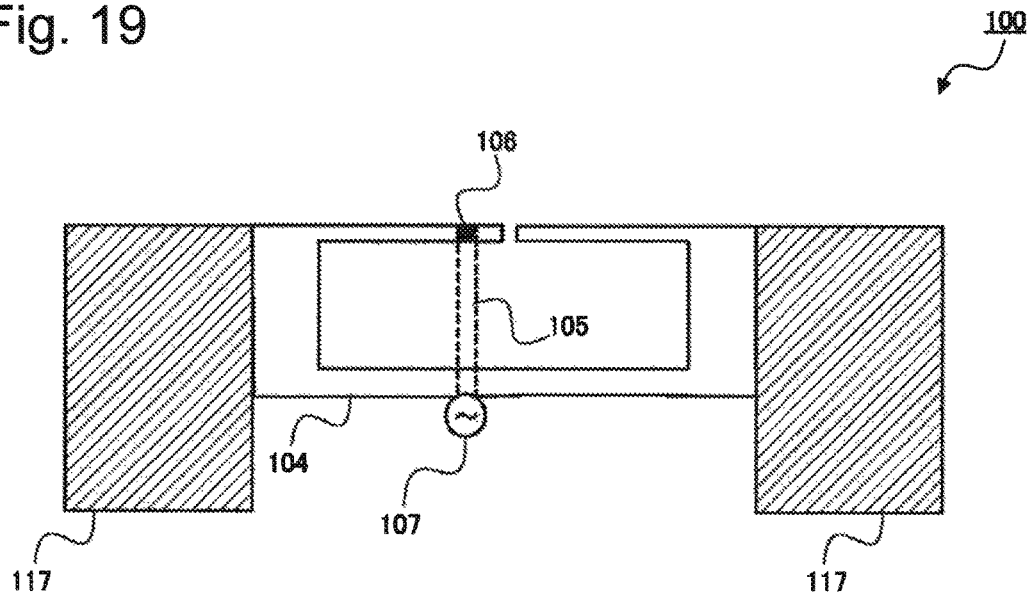
FIG. 19 is a front view of the antenna element 100 modified to provide a conductor radiation unit for the C-shaped conductor 104.
Figure 20:
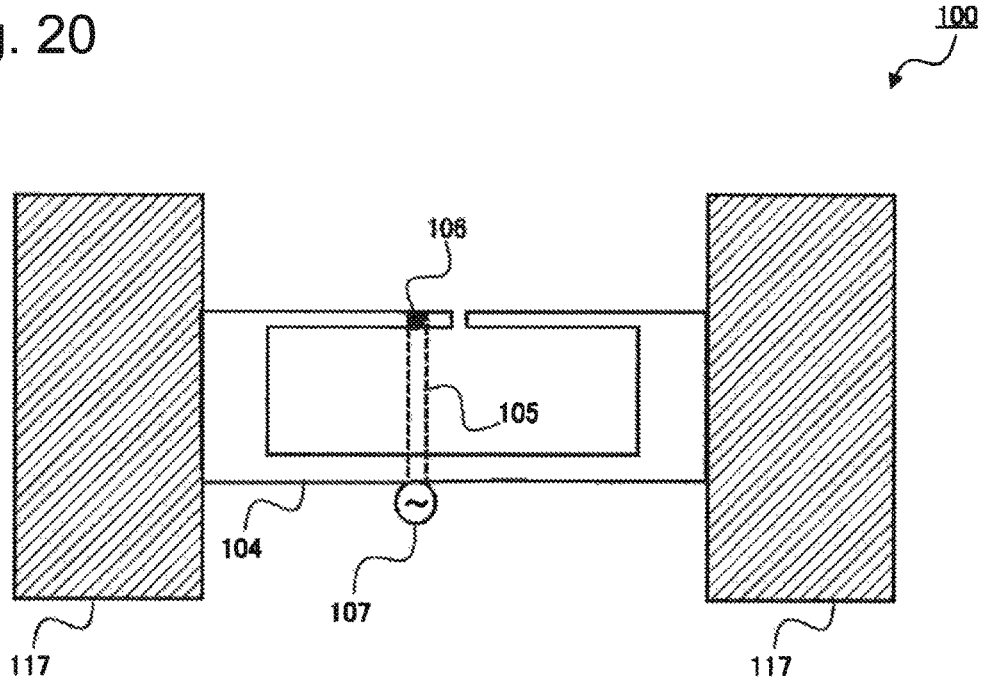
FIG. 20 is a front view of the antenna element 100 modified to provide a conductor radiation unit for the C-shaped conductor 104.
Figure 21:
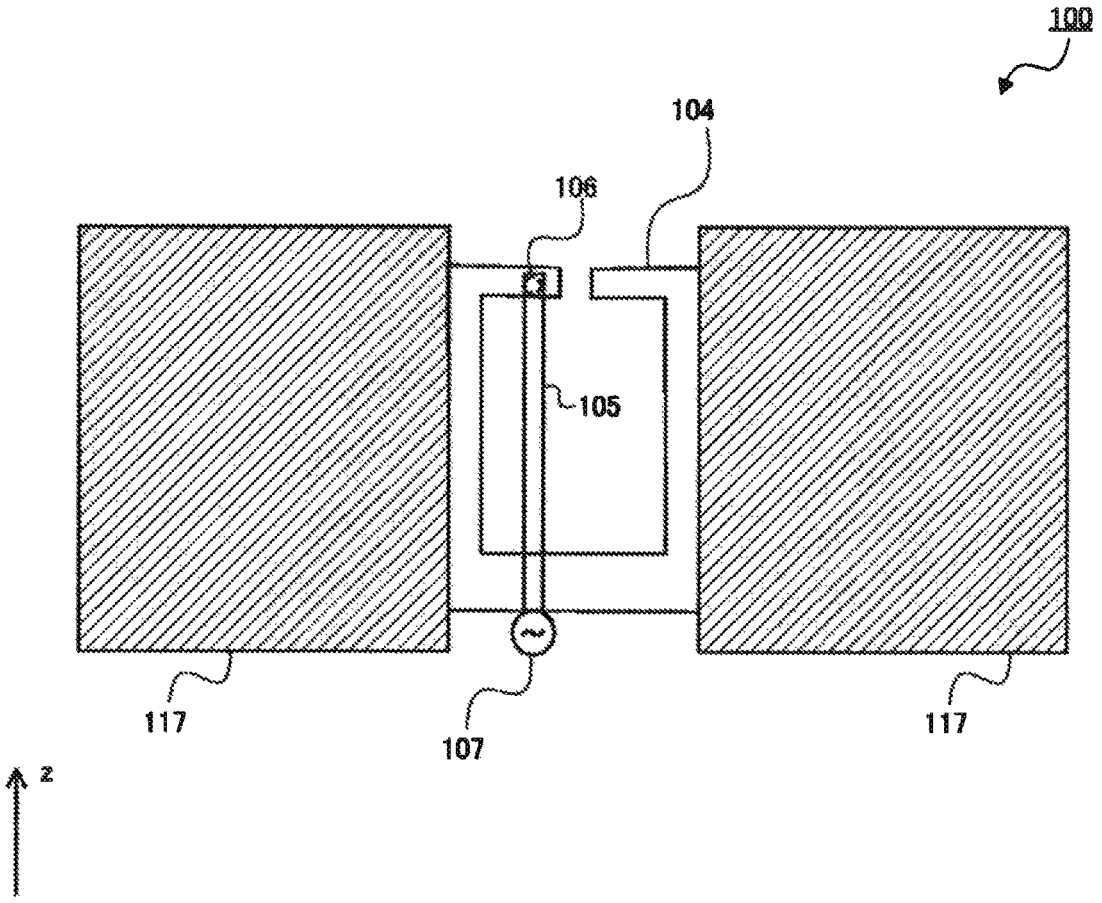
FIG. 21 is a front view of the antenna element 100 modified to provide a conductor radiation unit for the C-shaped conductor 104.

A shape of the conductor radiation unit 117 may be variously modified without limitation to the shape illustrated in FIG. 18. For example, it is illustrated in FIG. 18 that a shape in which lengths of respective sides of a portion where the conductor radiation unit 117 and the C-shaped conductor 104 are coupled with each other coincide with each other, but the shape of the conductor radiation unit 117 is not limited thereto. For example, lengths of respective sides in the portion where the conductor radiation unit 117 and the C-shaped conductor 104 are coupled with each other may be different. As illustrated in FIG. 19 and FIG. 20, for example, a configuration in which a side of the conductor radiation unit 117 is larger than a side of the C-shaped conductor 104 may be made. In the case of a configuration including the conductor radiation unit 117, a conductor part of a longitudinal direction of the antenna element 100 is extended by the C-shaped conductor 104 and the conductor radiation unit 117, and therefore, more excellent radiation efficiency is achieved. At this time, it is possible that a longitudinal direction of the C-shaped conductor 104 and a longitudinal direction of the antenna element 100 do not coincide with each other. As illustrated in FIG. 21, for example, a shape of the C-shaped conductor 104 may be a rectangle having a long side in the z-axis direction. Further, without limitation to a rectangle, the conductor radiation unit 117 may be a shape such as a square, a circle, and a triangle.

Further, as described above, regarding a resonance frequency of the split ring resonator, when inductance is increased by increasing a ring size of the split ring and extending a current path or capacitance is increased by narrowing a gap between conductors opposing each other in the split part 109, frequency reduction can be achieved.

Figure 22:
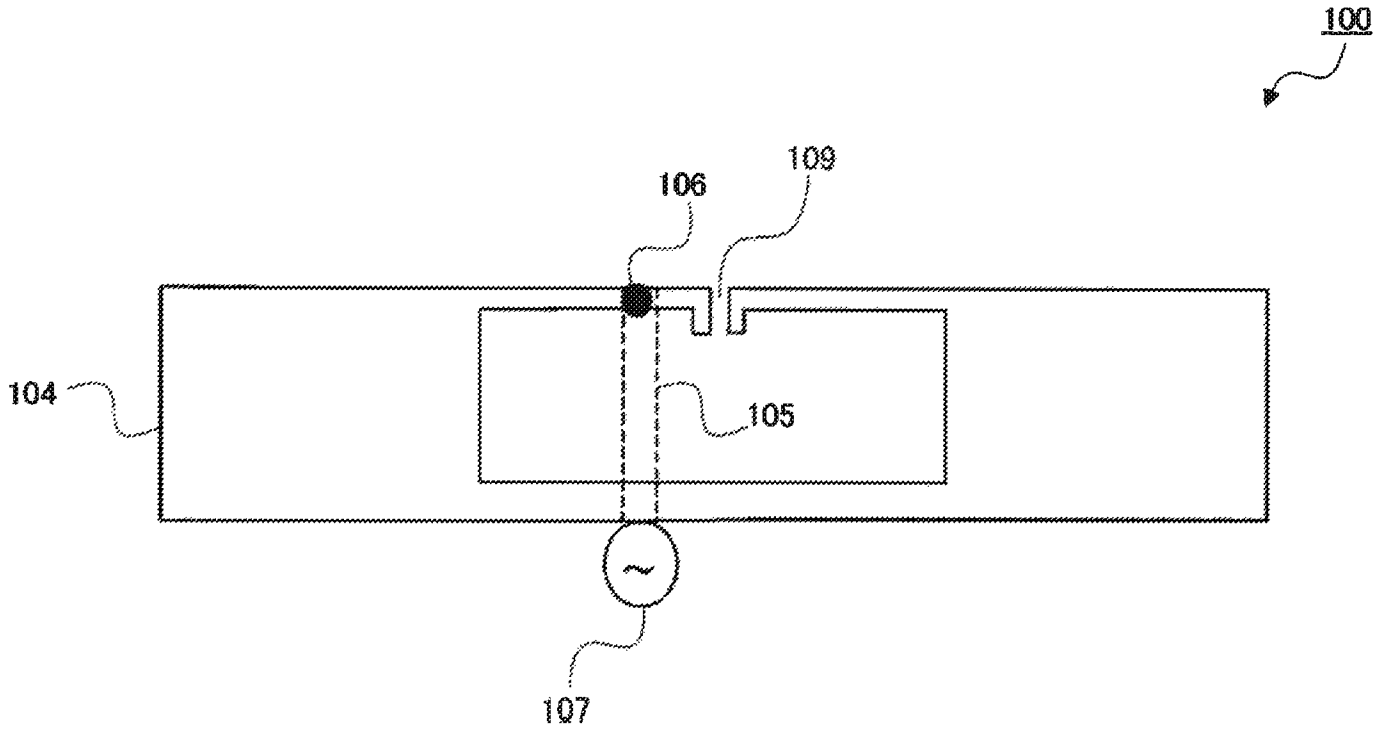
FIG. 22 is a front view of the antenna element 100 modified to increase capacitance.

At this time, as another method for increasing capacitance, a modification may be made to increase an area of the C-shaped conductor 104 opposing the split part 109. In an example illustrated in FIG. 22, both ends of the C-shaped conductor 104 opposing each other across the split part 109 are bent in a direction substantially orthogonal to a direction where the both sides oppose each other, and therefore an area of the C-shaped conductor 104 opposing the split part 109 is increased.

Figure 23:
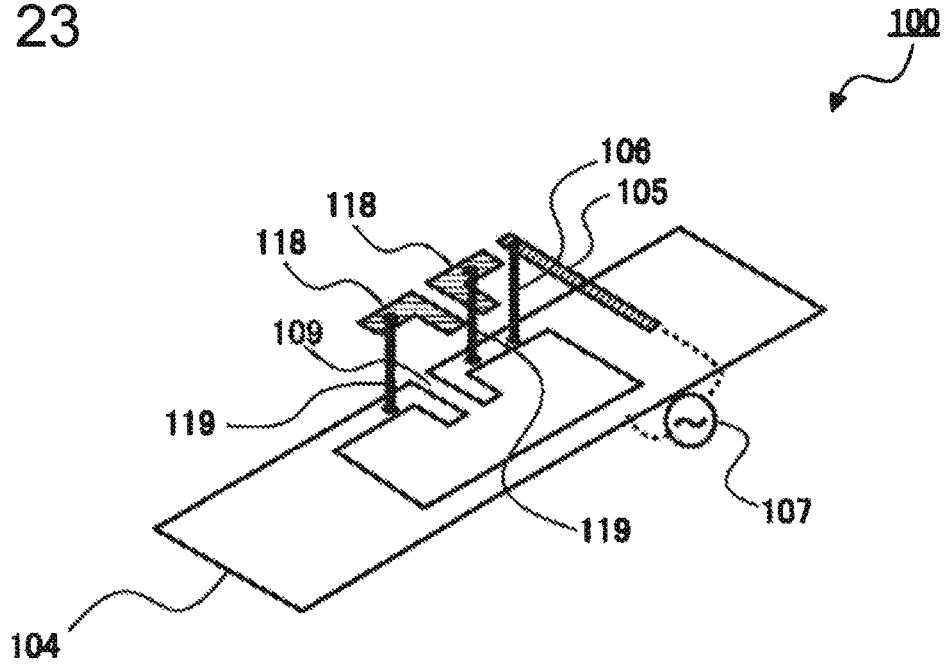
FIG. 23 is a perspective view of the antenna element 100 modified to increase capacitance.
Figure 24:
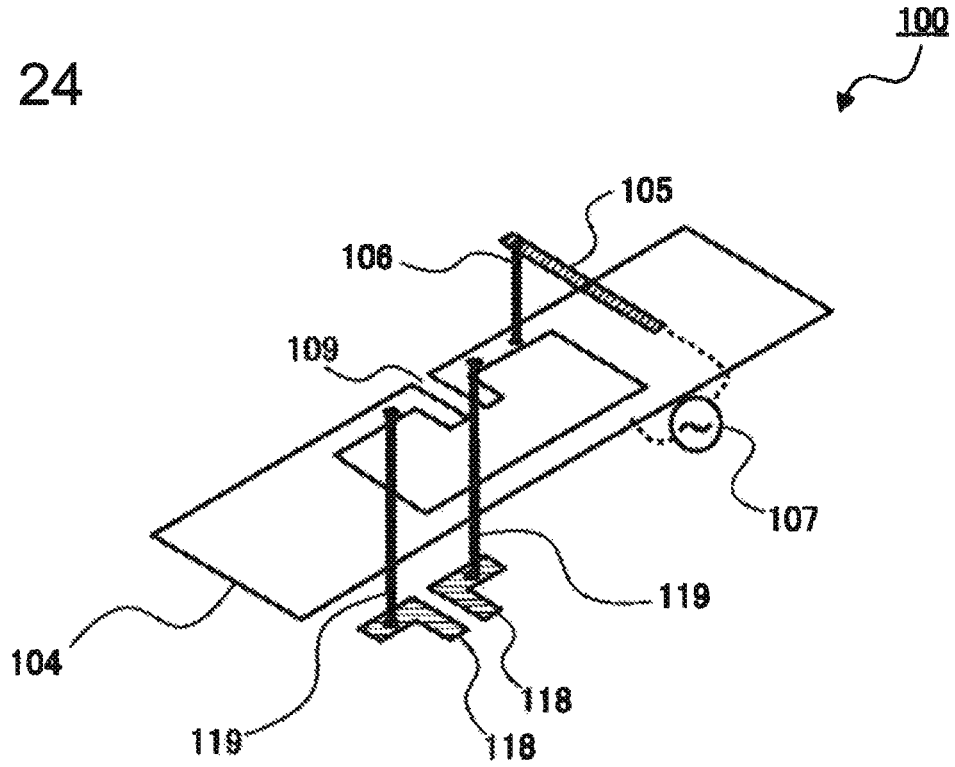
FIG. 24 is a perspective view of the antenna element 100 modified to increase capacitance.

Further, in addition thereto, as illustrated in FIG. 23 and FIG. 24, it is possible that an auxiliary conductor pattern is disposed in a layer different from a layer where the C-shaped conductor 104 exists to increase a conductor area opposing the split part 109. In examples illustrated in FIG. 23 and FIG. 24, two auxiliary conductor patterns 118 are disposed in a layer different from a layer where the C-shaped conductor 104 exists, and using conductor vias 119, the respective auxiliary conductor patterns 118 and vicinities of respective ends of the C-shaped conductor 104 opposing each other across the split unit 109 are electrically connected. In the examples illustrated in FIG. 23 and FIG. 24, more specifically, the two auxiliary conductor patterns 118 have, to oppose bent ends of the C-shaped conductor 104, respectively, a bent shape in the same manner. By using such a configuration, a conductor area opposing the split part 109 in the split ring resonator may be increased.

Note that in the example illustrated in FIG. 23, the two auxiliary conductor patterns 118 are disposed in the same layer as the conductor power feed line 105. Further, in the example illustrated in FIG. 24, the two auxiliary conductor patterns 118 are disposed in a layer different from both the C-shaped conductor 104 and the conductor power feed line 105.

Figure 25:
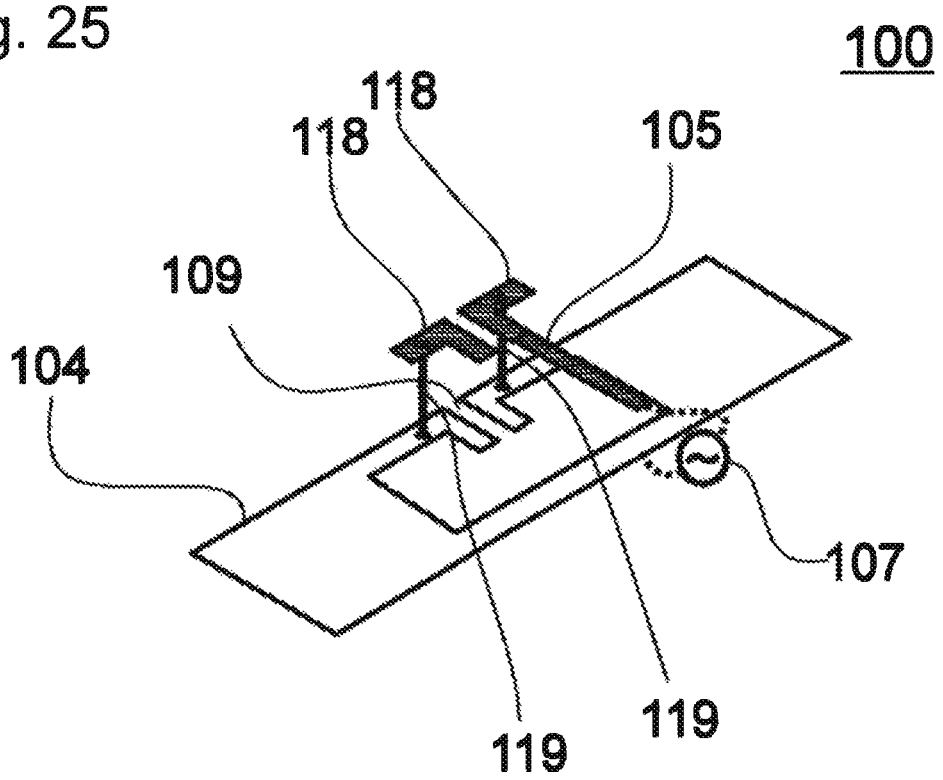
FIG. 25 is a perspective view of the antenna element 100 modified to increase capacitance.

Further, as illustrated in FIG. 25, a configuration is conceivable in which in the configuration of FIG. 23, the conductor power feed line 105 is directly connected to the auxiliary conductor pattern 118. This makes it possible to achieve structure simplification by omitting the conductor via 106.

Figure 26:
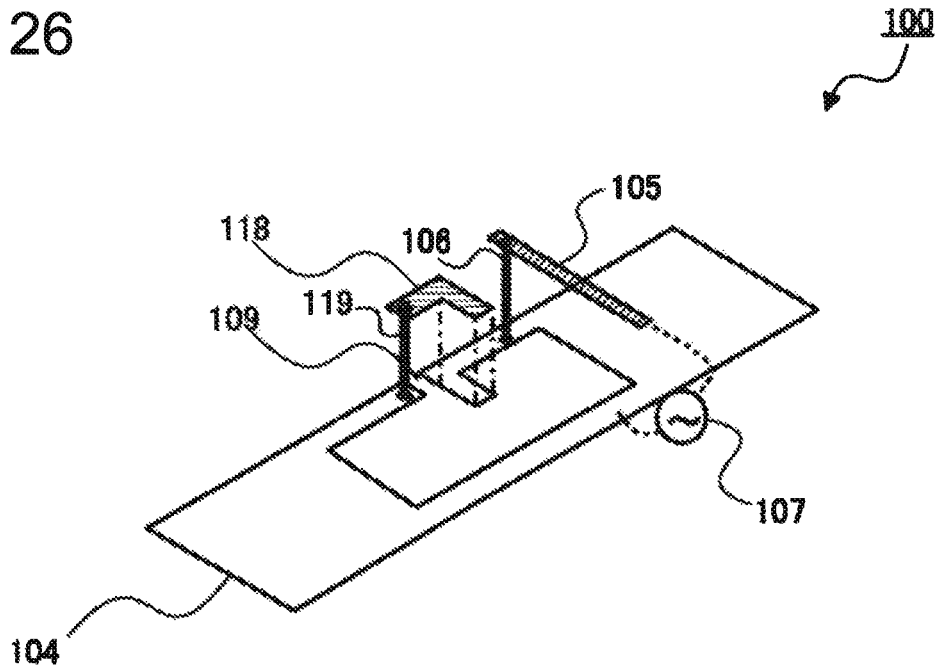
FIG. 26 is a perspective view of the antenna element 100 modified to increase capacitance.

Further, as illustrated in FIG. 26, the antenna element 100 may include at least one auxiliary conductor pattern 118 that is electrically connected to one part of both parts of the C-shaped conductor 104 opposing each other across the split part 109 and opposes the other part. Note that in an example illustrated in FIG. 26, by using the conductor via 119, the auxiliary conductor pattern 118 is electrically connected to the C-shaped conductor 104. While in the examples illustrated in FIG. 23 and FIG. 24, the auxiliary conductor pattern 118 has been provided for each of both conductor parts opposing each other across the split part 109, the auxiliary conductor pattern 118 is provided only for one conductor part in the example illustrated in FIG. 26. The auxiliary conductor pattern 118 and at least a portion of the other conductor part oppose each other between a layer of the C-shaped conductor 104 and a layer of the auxiliary conductor pattern 118, and therefore, a conductor area opposing the split part 109 is increased.

Figure 27:
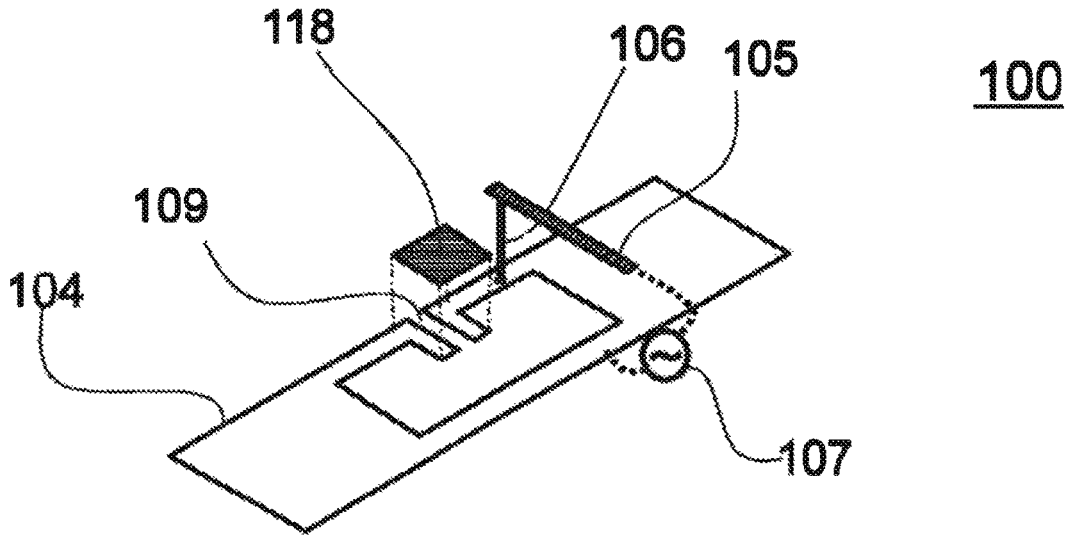
FIG. 27 is a perspective view of the antenna element 100 modified to increase capacitance.

Further, as illustrated in FIG. 27, a configuration is conceivable in which the conductor via 119 is not included, and the auxiliary conductor pattern 118 and both conductor parts opposing each other across the split part 109 are disposed so as to overlap each other when viewed from a direction vertical to a plane created by the C-shaped conductor 104. Accordingly, an opposing conductor area can be further increased, and therefore, capacitance can be increased without increasing a size of the entire resonator.

Note that in the example illustrated in FIG. 26, the auxiliary conductor pattern 118 and the conductor power feed line 105 are disposed in the same layer, but may be disposed in different layers. Further, in the examples illustrated in FIG. 23 to FIG. 26, both ends of the C-shaped conductor 104 and the auxiliary conductor pattern 118 have a bent shape but may have a shape that is not bent or another shape.

Further, when a connection position of the conductor via 106 (one end of the conductor power feed line 105 when the conductor via 106 is omitted) and the C-shaped conductor 104 is changed, an input impedance of the split ring resonator viewed from the power feed point 107 can be changed. When an impedance of a wireless communication circuit or a transmission line, not illustrated, located in an anterior of the power feed point 107 is matched with an input impedance of the split ring resonator, wireless communication signals can be fed to the antenna without reflection. However, also in the case of no impedance matching, an essential effect of the present invention is not affected.

Figure 28:
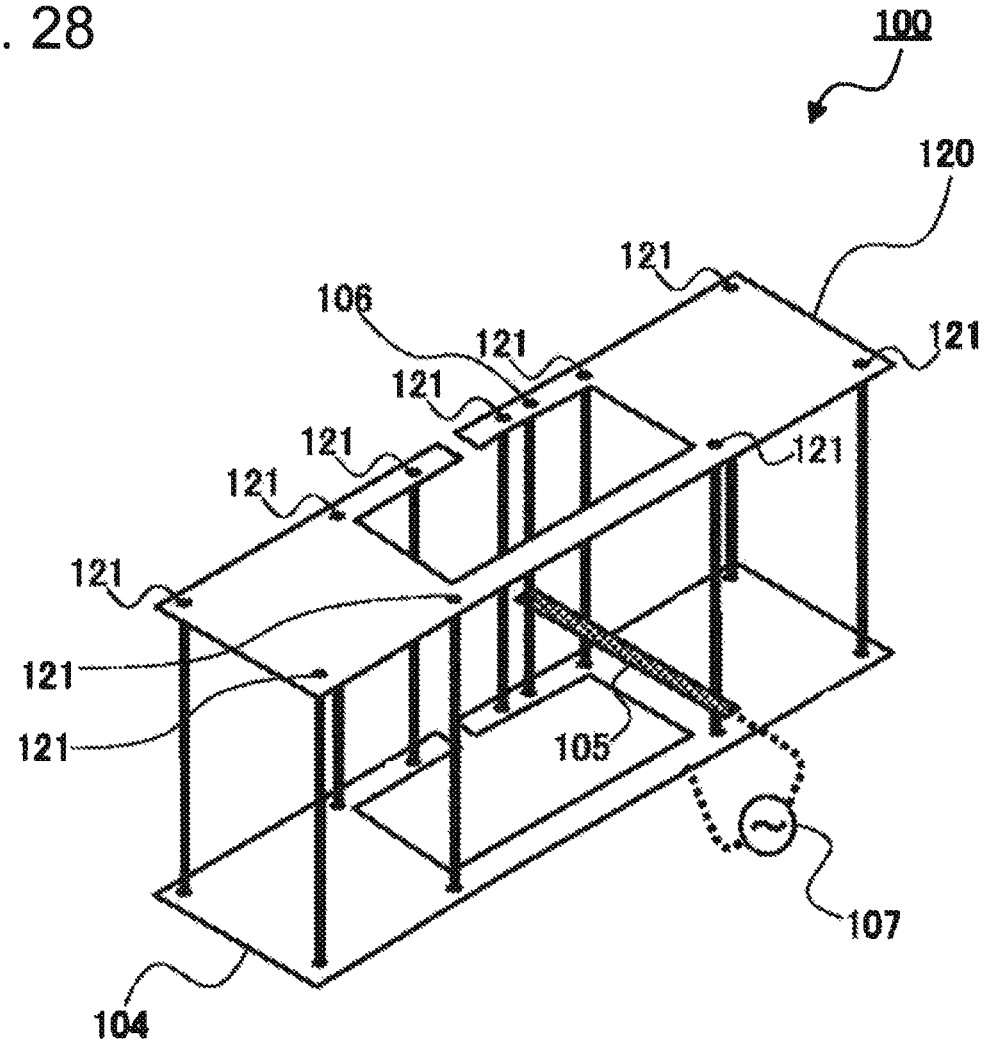
FIG. 28 is a perspective view of the antenna element 100 including two C-shaped conductors opposing each other.

Further, as illustrated in FIG. 28, the antenna element 100 may be configured by providing, in addition to the C-shaped conductor 104, a C-shaped conductor 120 having the same configuration as the C-shaped conductor 104. In an example illustrated in FIG. 28, in a layer different from the C-shaped conductor 104 and the conductor power feed line 105, the C-shaped conductor 120 that is a second C-shaped conductor is disposed. More specifically, a configuration is made so that a layer of the C-shaped conductor 104 and a layer of the C-shaped conductor 120 sandwich a layer of the conductor power feed line 105. The C-shaped conductor 104 and the C-shaped conductor 120 are electrically connected by a plurality of conductor vias 121. In this case, the C-shaped conductor 104 and the C-shaped conductor 120 operate as a single split ring resonator. At this time, a large circumferential portion of the conductor power feed line 105 is surrounded by the C-shaped conductors 104 and 120 which are conductors that are conductive to each other and a plurality of conductor vias 121. Accordingly, radiation of unnecessary signal electromagnetic waves from the conductor power feed line 105 can be reduced.

Figure 29:
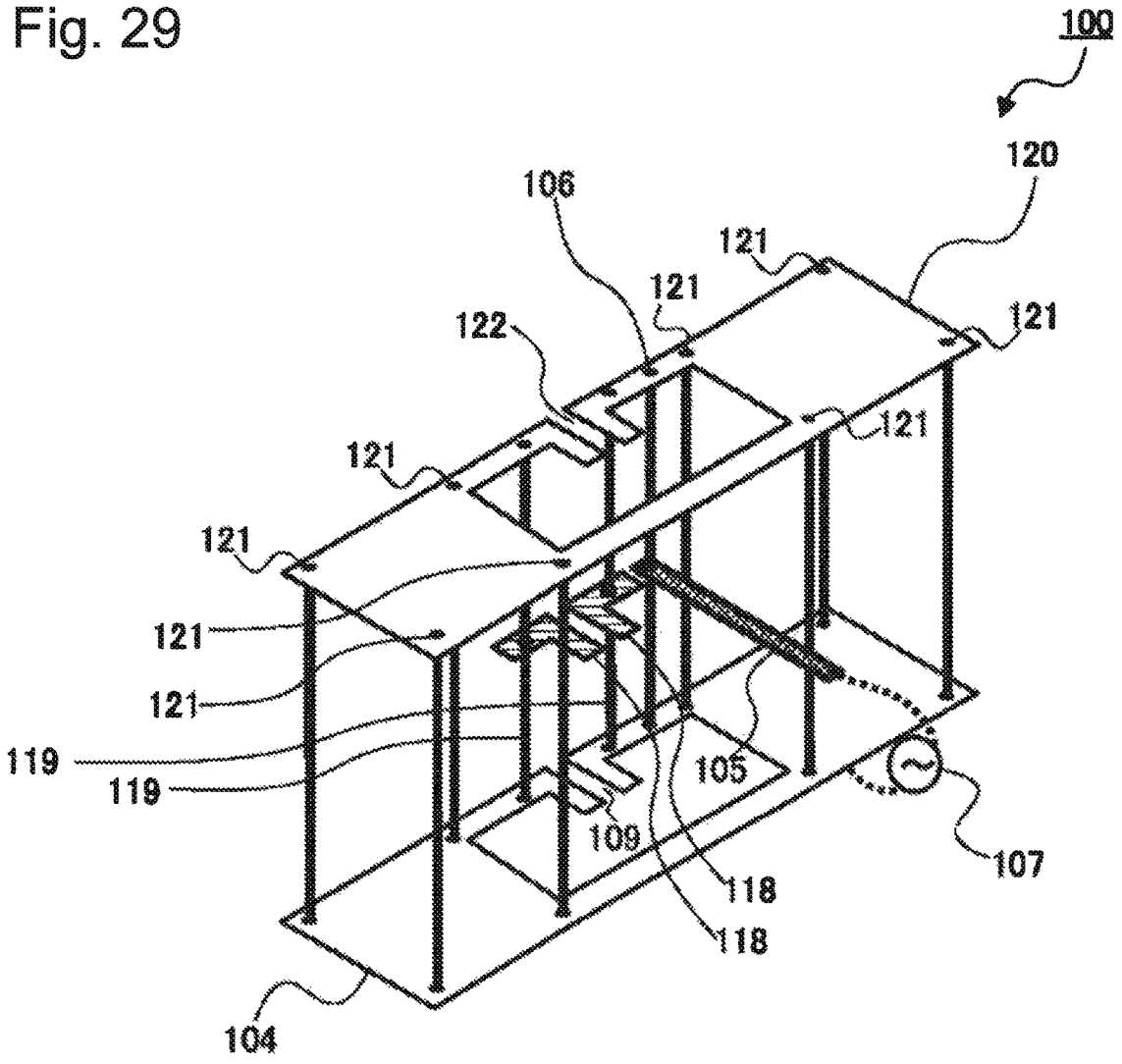
FIG. 29 is a perspective view of the antenna element 100 including two C-shaped conductors opposing each other and an auxiliary conductor pattern.

Further, as illustrated in FIG. 29, the auxiliary conductor pattern 118 may be provided in the same manner as in FIG. 23. Specifically, in an example illustrated in FIG. 29, in a layer different from the C-shaped conductor 104 and the C-shaped conductor 120 (in a layer sandwiched by a layer of the C-shaped conductor 104 and a layer of the C-shaped conductor 120), the auxiliary conductor pattern 118 is disposed. Further, by using the conductor via 119, the auxiliary conductor pattern 118 is electrically connected to a conductor part near the split part 109 in the C-shaped conductor 104 and a conductor part near a split part 122 in the C-shaped conductor 120. According to such a configuration, the auxiliary conductor pattern 118 increases conductor areas opposing the split part 109 of the C-shaped conductor 109 and the split part 122 of the C-shaped conductor 120, and therefore, capacitance can be increased without increasing a size of the entire resonator.

Second Example Embodiment

Figure 30:
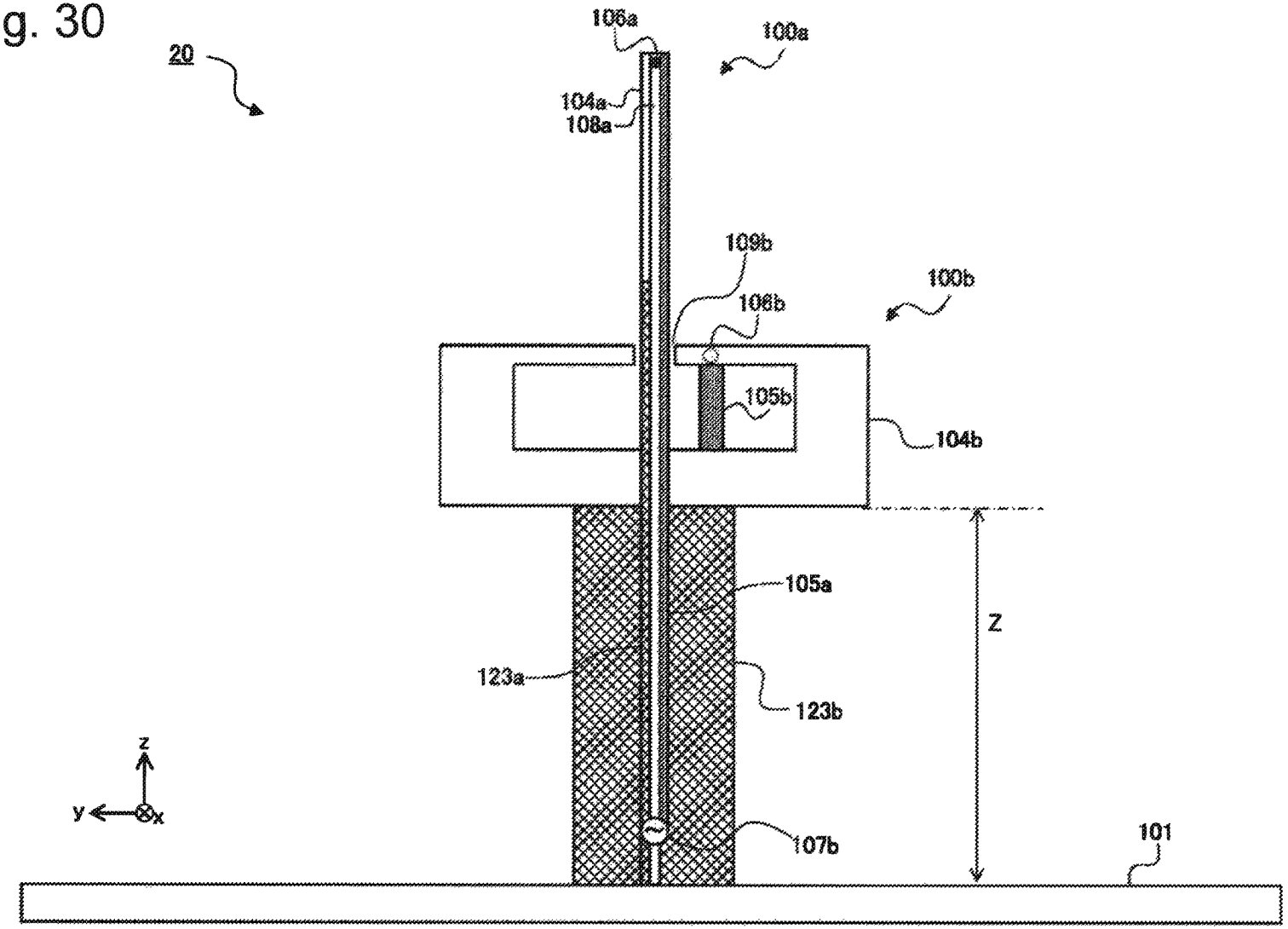
FIG. 30 is a front view of an antenna 20 according to a second example embodiment.
Figure 31:
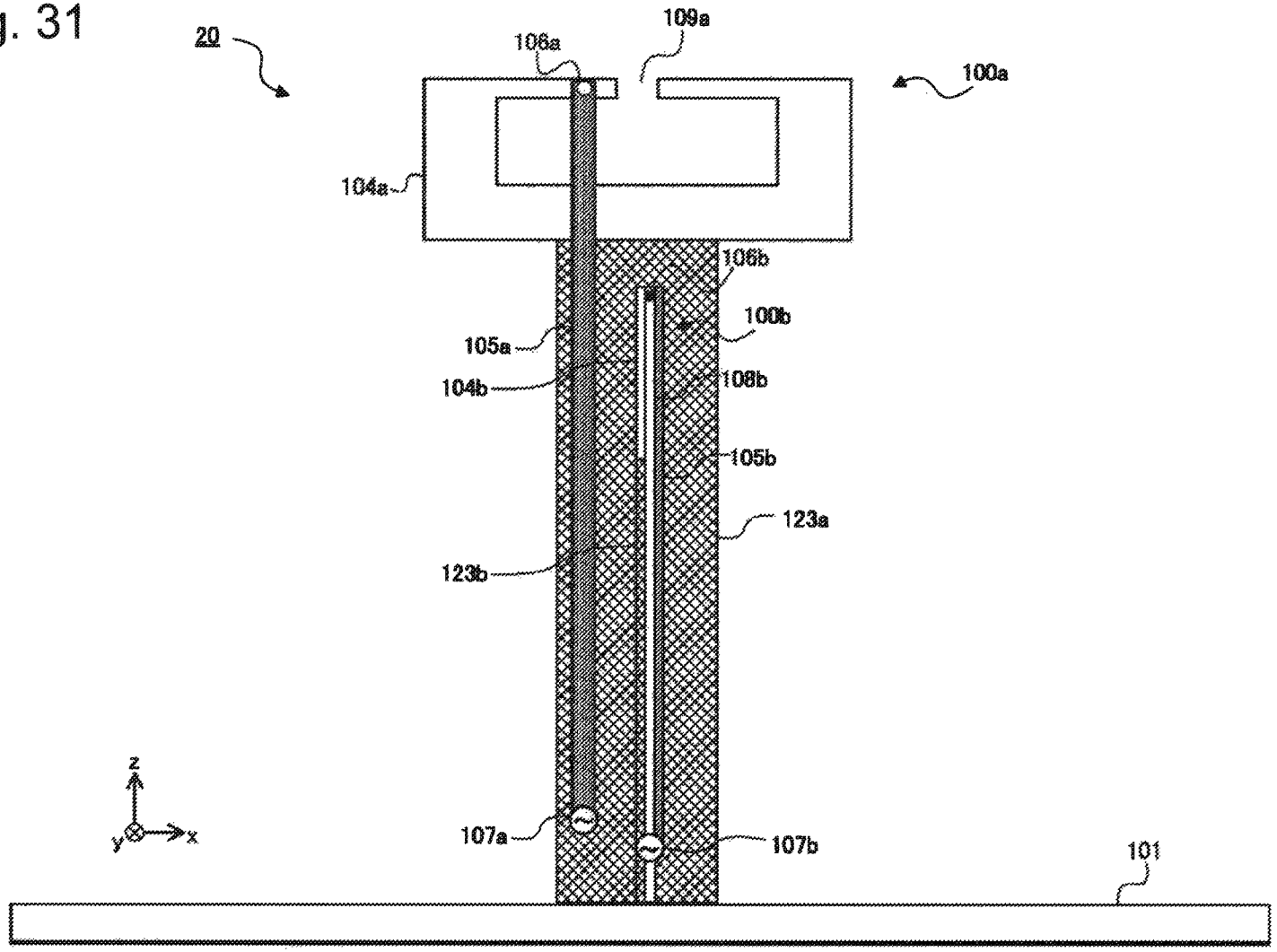
FIG. 31 is a side view of the antenna 20 according to the second example embodiment.

Next, an antenna 20 according to a second example embodiment of the present invention will be described. Note that in the following description, the same components as the above-described components will be assigned with the same reference sings, and description thereof will be omitted as appropriate. FIG. 30 is a front view of the antenna 20, and FIG. 31 is a side view of the antenna 20. Note that regarding a dielectric layer 108, to easily understand dispositions of other components, an illustration of a dielectric layer **108*b* of an antenna element 100*b* is omitted in FIG. 30, and an illustration of a dielectric layer 108*a* of an antenna element 100*a* is omitted in FIG. 31**.

The antenna 20 is different from the antenna 10 in a point that a conductor power feed unit 123 is further included, in which one end thereof is coupled with an outer edge portion of a C-shaped conductor 104 and the other end thereof is coupled with a conductor reflection plate 101. In the antenna 20, conductor power feed units **123*a* and 123*b* are provided for the antenna elements 100*a* and 100*b* configuring the antenna 20, respectively. The conductor power feed unit 123 is a conductor configuring a current path for feeding power to the C-shaped conductor 104. One end of the conductor power feed unit 123 is coupled with a position vicinity opposing a split part 109 in the outer edge portion of the C-shaped conductor 104 and the other end thereof is coupled with the conductor reflection plate 101. More specifically, the conductor power feed unit 123 is couples with, in the outer edge portion of the C-shaped conductor 104, a portion located in a vicinity of a central portion of the C-shaped conductor 104 (with respect to a C-shaped conductor 104*a*, a central portion of the C-shaped conductor 104*a* in the x-axis direction, and with respect to a C-shaped conductor 104*b*, a central portion of the C-shaped conductor 104*b* in the y-axis direction). In this manner, in a position in a predetermined range from the central portion of the C-shaped conductor 104, the C-shaped conductor 104 and the conductor power feed unit 123** are coupled with each other.

Further, in the antenna 20, a conductor power feed line 105 is extended to a conductor reflection plate 101 side. Further, in the antenna 20, a dielectric layer 108 is also extended to the conductor reflection plate 101 side. The conductor power feed unit 123 is disposed side-by-side with the extended conductor power feed line 105. More specifically, the conductor power feed unit 123 is disposed side-by-side so as to oppose the conductor power feed line 105. In this manner, in the second example embodiment, the antenna element 100 is fixed to the conductor reflection plate 101 by the conductor power feed unit 123.

Further, a power feed point 107 is disposed in a one-end portion vicinity of a side (i.e. a conductor reflection plate 101 side) to which the conductor power feed line 105 is extended. The power feed point 107 can electrically perform excitation between a one-end portion of the side to which the conductor power feed line 105 is extended and the conductor power feed unit 123 in a disposition position vicinity of the power feed point 107. Note that on a back side of the conductor reflection plate 101, i.e. an inverse side to a side where the antenna 20 exists, for example, a power feed source including a resonator and an amplifier, not illustrated, may be configured. In this case, the power feed point 107 is fed with power from the power feed source of the back side of the conductor reflection plate 101.

The antenna element **100*a* and the antenna element 100*b* of the antenna 20 according to the second example embodiment are substantially vertically disposed so as to partially overlap each other in a projection drawing to the conductor reflection plate 101, in the same manner as the antenna element 100*a* and the antenna element 100*b*** of the antenna 10 according to the first example embodiment. Therefore, as illustrated in FIG. 30 and FIG. 31, the conductor power feed unit 123*a* coupled with the antenna element 100*a* existing on an upper side in the z-axis direction has a shape in which a portion where the antenna element 100*b* existing on a lower side exists is hollowed. The antenna element 100*b* of the lower side is disposed so as to pass through the hollowed conductor power feed unit 123. The antenna element 100*b* may be in contact with the conductor power feed unit 123*a* of the antenna element 100*a*.

In the above-described points, the antenna 20 is different from the antenna 10 of the first example embodiment, but other configurations are the same as in the antenna 10. Note that the conductor power feed unit 123 is coupled with the conductor reflection plate 101 in the example illustrated in FIG. 30 and FIG. 31, but does not always need to be coupled with the conductor reflection plate 101. Further, in FIG. 30 and FIG. 31, a position of the conductor power feed line 105*b* of the antenna element 100*b* with respect to the C-shaped conductor 104*b* is mirror-symmetrical to the position illustrated in FIG. 2 but this is a change as a matter of convenience for easing the illustrations, and therefore, any position of the conductor power feed line 105*b* does not affect an essential effect of the present invention.

Hereinafter, an effect of the antenna 20 according to the second example embodiment will be described.

When a transmission line that transmits wireless signals is connected to an antenna element via a power feed point, a resonator is coupled with a conductor, and therefore, a disposition or shape of the transmission line in an antenna element vicinity may change resonance characteristics of the antenna element.

In the antenna 20 according to the present example embodiment, a portion where the conductor power feed unit 123 is coupled with the antenna element 100 is located in a substantially central portion of the antenna element 100. This location is, as described in the first example embodiment, a portion becoming an electrically short-circuited plane during resonance and then having weak electric field intensity in the C-shaped conductor 104. Therefore, when the conductor power feed unit 123 is coupled as described above, the conductor power feed unit 123 does not increase an excessive capacitance or inductance that may affect resonance characteristics. As a result, resonance characteristics of the antenna elements 100*a* and 100*b* hardly change. The present inventors have found the above.

In the present example embodiment, the extended conductor power feed line 105 and the conductor power feed unit 123 disposed side-by-side therewith form a transmission line coupled with the antenna element. According to the transmission line, an influence on resonance characteristics can be suppressed. Further, when the power feed point 107 is disposed on a far side from the antenna element 100 in the transmission line, a distance between the transmission line linked to an anterior of the power feed point 107 and the antenna element 100 can be increased. As a result, an influence of the transmission line on the antenna element 100 can be reduced.

The conductor power feed unit 123 is preferably coupled, as described above, with an outer edge of the antenna element 100 corresponding to a substantially central portion of the antenna element 100 that is an electrically short-circuited plane during resonance. More specifically, a plane including a central portion of the antenna element 100 and being a plane vertical to a longitudinal direction (equivalent to the x-axis direction with respect to the antenna element 100*a* and equivalent to the y-axis direction with respect to the antenna element 100*b*) of the antenna element 100 becomes an electrically short-circuited plane during resonance. In other words, for example, in FIG. 30 and FIG. 31, regarding the antenna element 100*a*, a yz plane including a central portion of the antenna element 100*a* is an electrically short-circuited plane during resonance, and regarding the antenna element 100*b*, an xz plane including a central portion of the antenna element 100*b* is an electrically short-circuited plane during resonance.

A plane in a range of a quarter of a size (when the radiation unit 117 is included as a modified example, the size includes this unit) of a longitudinal direction 100 (the x-axis direction with respect to the antenna element 100*a* and the y-axis direction with respect to the antenna element 100*b*) of the antenna element from the electrically short-circuited plane can be regarded as a substantially short-circuited plane.

A plane in a range of a quarter of a size of the antenna element (when the radiation unit 117 is included as a modified example, the size includes this unit) from the electrically short-circuited plane in a longitudinal direction 100 (the x-axis direction with respect to the antenna element 100*a* and the y-axis direction with respect to the antenna element 100*b*) can be regarded as a substantially short-circuited plane.

Therefore, the conductor power feed unit 123 is preferably located in the range, i.e. a range half a size (when the radiation unit 117 is included as a modified example, the size includes this unit) of a longitudinal direction of the antenna element 100 around the center of the antenna element 100. Therefore, a size of the conductor power feed unit 123 viewed in the longitudinal direction of the antenna element 100 is preferably equal to or smaller than half the size of the longitudinal direction of the antenna element 100.

However, even when the conductor power feed unit 123 is located in a range other than the above, an essential effect of the present invention is not affected. Further, even when a size of the conductor power feed unit 123 viewed in the longitudinal direction of the antenna element 100 is a size other than the above, an essential effect of the present invention is not affected.

As described above, it is possible to provide a dual polarization wave antenna in which an influence of a transmission line on resonance characteristics of an antenna element is suppressed, in addition to the effect according to the first example embodiment. Further, when a wireless communication device, an antenna array, or a base station device is configured using the antenna 20 in the same manner as in the first example embodiment, it is possible to provide a wireless communication device, an antenna array, or a base station device in which an influence of a transmission line on resonance characteristics of an antenna element is suppressed.

All the modified examples of the antenna element 100 described in the first example embodiment are appropriately applied also in the antenna element 100 of the present example embodiment.

Note that as in FIG. 11, when the antenna elements 100*a* and 100*b* are postured parallel to the conductor reflection plate 101, the antenna 20 may be configured as follows. In different layers in the same board, the antenna elements 100*a* and 100*b* and the conductor reflection plate 101 are configured, respectively. Further, each of the conductor power feed units 123*a* and 123*b* is connected down to a layer of the conductor reflection plate 101 using a conductor via in the board, and each of the conductor power feed lines 105*a* and 105*b* is connected down to the layer of the conductor reflection plate using another conductor via in the board. In this manner, the entire antenna 20 may be produced as an integrated board.

Further, various modified examples of the second example embodiment will be described. Various modified examples to be described below may be appropriately combined.

Figure 32:
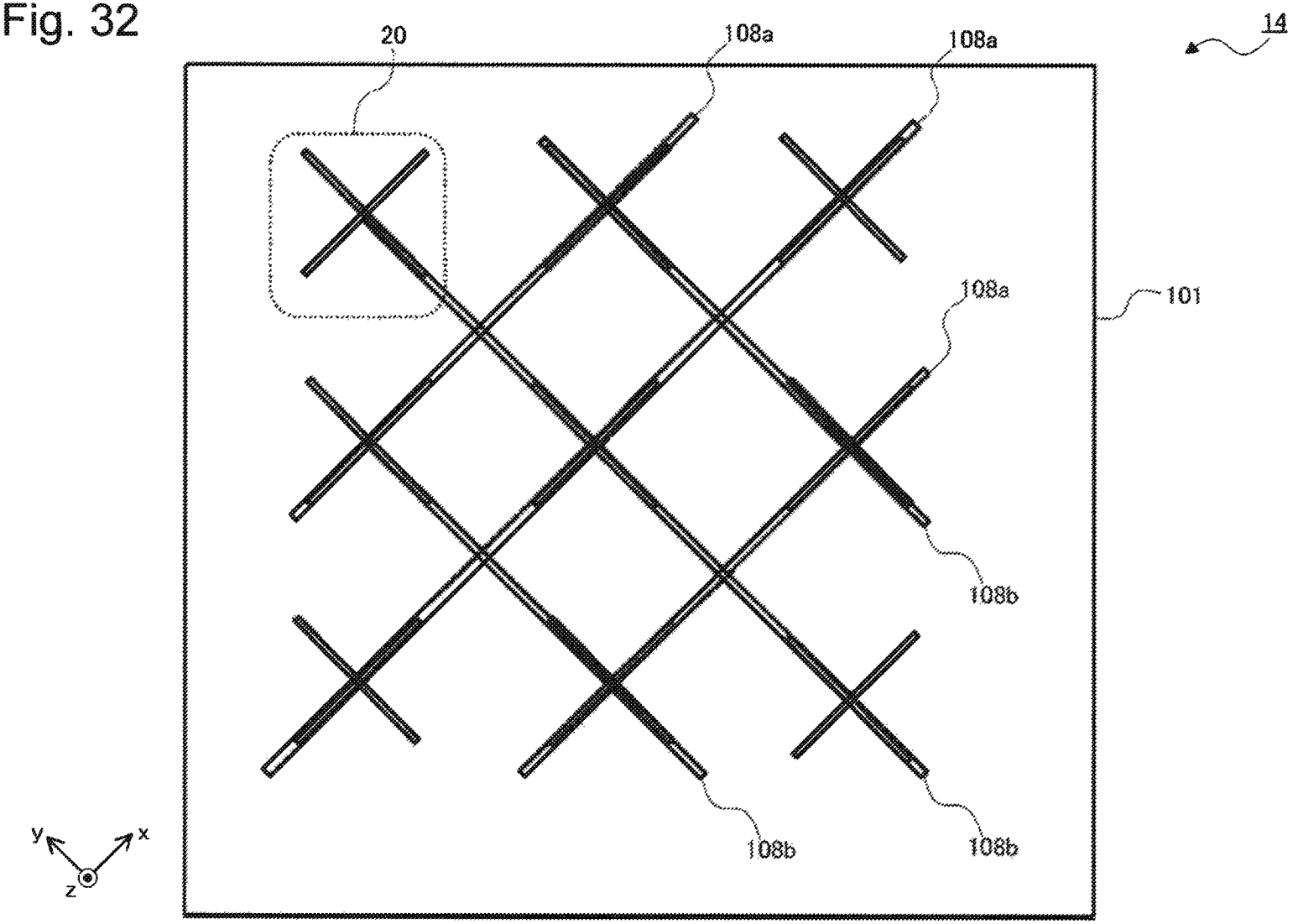
FIG. 32 is a plan view of an antenna array 14 configured so that a dielectric layer 108 is shared by a plurality of antennas 20.

When a plurality of antennas 20 are arrayed to configure an array antenna, a configuration in which a dielectric layer 108 is shared by the plurality of antennas 20 may be made, as illustrated in FIG. 32. In an antenna array 14 illustrated in FIG. 32, of respective antenna elements 100*a* and respective conductor power feed units 123*a* coupled with the antenna elements 100*a* in a plurality of antennas 20, those arrayed in the same plane manner are formed on an integrated dielectric layer 108*a*. Further, for respective antenna elements 100*b* and respective conductor power feed units 123*b* coupled with the antenna elements 100*b* in the plurality of antennas 20, the same formation is also made. When an array antenna is configured in this manner, man-hours for positioning a plurality of antenna elements 100 and a plurality of conductor power feed units 123 can be reduced. As a configuration of a portion where the dielectric layers 108 vertically intersect with each other, a configuration in which, for example, a cut is made in one dielectric layer 108 may be employed. Further, without limitation to the example illustrated in FIG. 32, only the antenna elements 100*a* and the conductor power feed units 123*a* may be formed on an integrated dielectric layer 108, or only the antenna elements 100*b* and the conductor power feed units 123*b* may be formed on an integrated dielectric layer 108.

Figure 33:
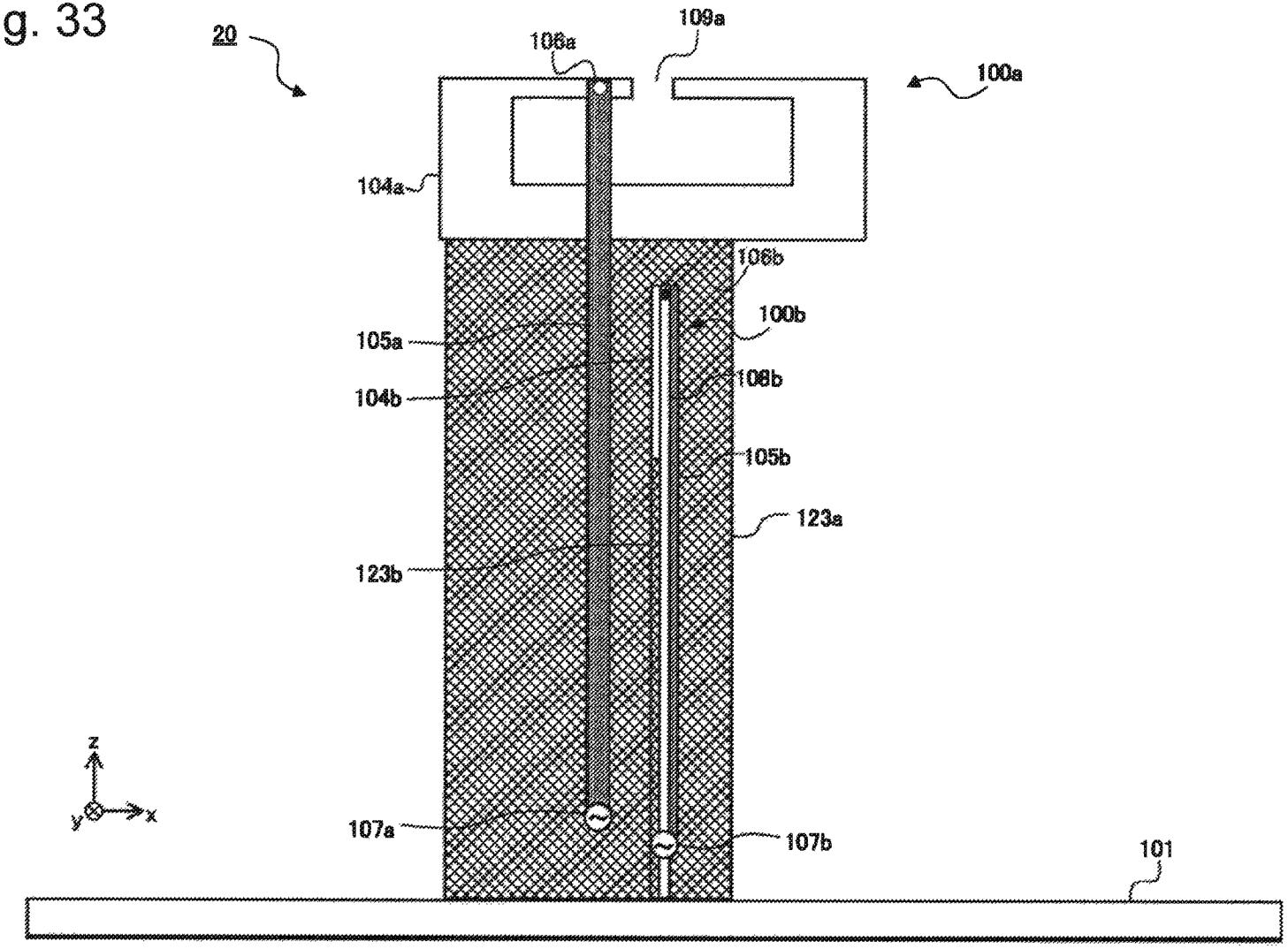
FIG. 33 is a side view of the antenna 20 in which a coupling position of a conductor power feed unit 123 with respect to the C-shaped conductor 104 is changed.

Further, in the above-described example embodiments, one end of the conductor power feed unit 123 is coupled with an end vicinity opposing the split part 109 in the C-shaped conductor 104, but a coupling position of the conductor power feed unit 123 may be appropriately modified in an allowable range of an influence on resonance characteristics of the antenna element 100. As illustrated in FIG. 33, for example, the conductor power feed unit 123 may be coupled with the C-shaped conductor 104 by reaching a portion other than the end vicinity opposing the split part 109 in the C-shaped conductor 104. Note that in FIG. 33, an illustration of the dielectric layer 108*a* of the antenna element 100*a* is omitted to easily understand dispositions of other components. Further, also in FIGS. 34 to 36 to be described later, an illustration of the dielectric layer 108*a* of the antenna element 100*a* is omitted in the same manner.

Further, in the same manner as in the modified examples of the first example embodiment, it is not necessary to dispose the antenna elements 100*a* and 100*b* in the z-axis direction by leaving a gap, and, for example, by making a cut in one of the antenna elements 100, the antenna elements 100 may be disposed so as to be in contact with each other or close to each other.

Figure 34:
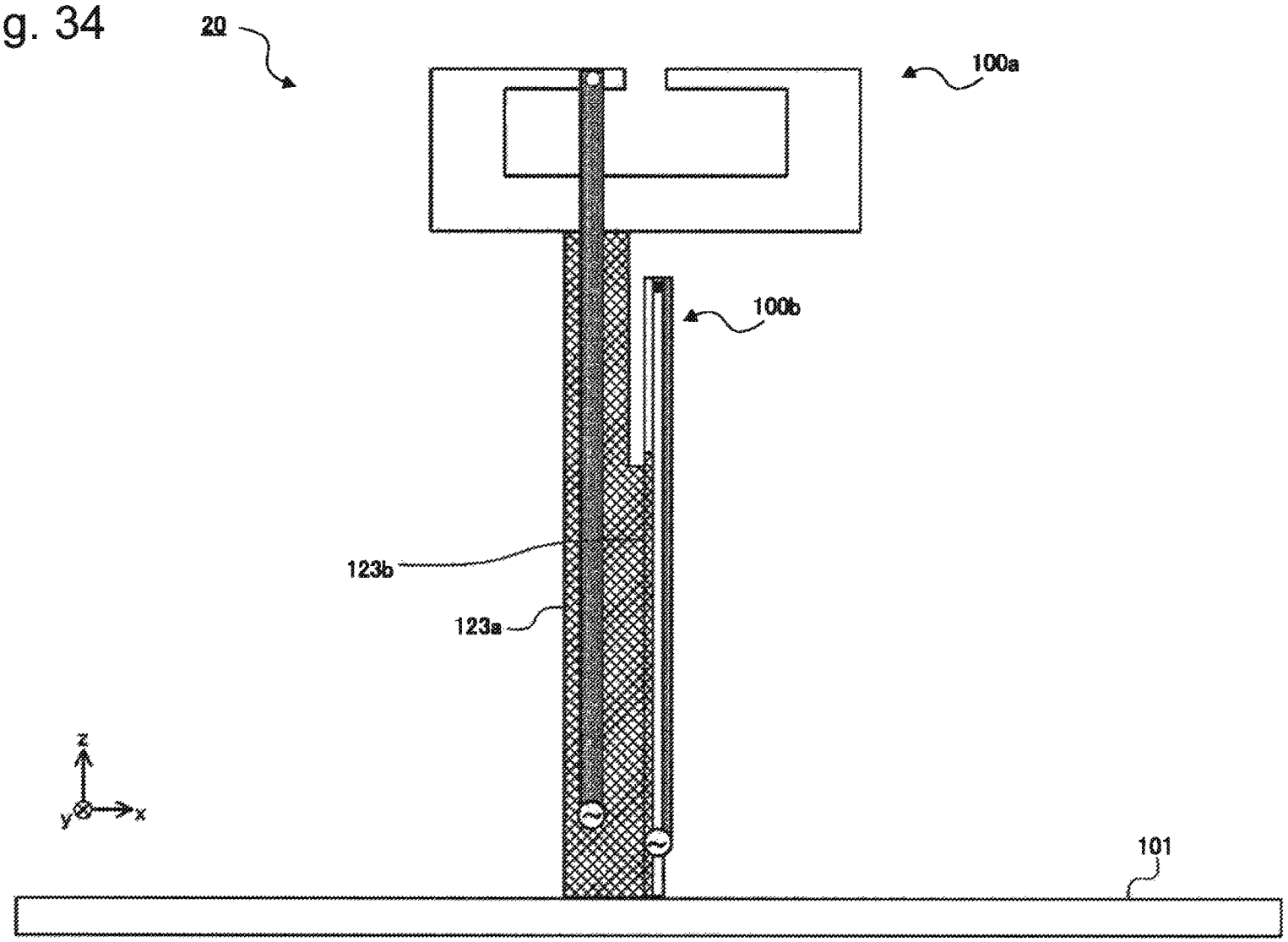
FIG. 34 is a side view of the antenna 20 modified so that a conductor power feed unit 123*a* does not overlap an antenna element 100*b*.

Further, in the above-described example embodiments, as illustrated in FIG. 30 and FIG. 31, a configuration in which the conductor power feed units 123*a* and 123*b* coupled with the antenna elements 100*a* and 100*b*, respectively, are in contact with each other and one conductor power feed unit 123*a* and the other conductor power feed unit 123*b* overlap each other is made. However, to ease production or prevent a characteristic change of an antenna element, as illustrated in FIG. 34, for example, it is preferable to arrange shapes of the conductor power feed unit 123*a* of the antenna element 100*a* and a dielectric layer of the antenna element 100*a* so as not to overlap the other antenna element 100*b*. In an example illustrated in FIG. 34, a shape in which a cut is made in a portion, in the conductor power feed unit 123*a*, close to the C-shaped conductor 104*b* of the antenna element 100*b* is made. Further, in the same manner, also regarding the dielectric layer of the antenna element 100*a*, a shape in which a cut is made in a portion close to the C-shaped conductor 104*b* of the antenna element 100*b* is made.

Figure 35:
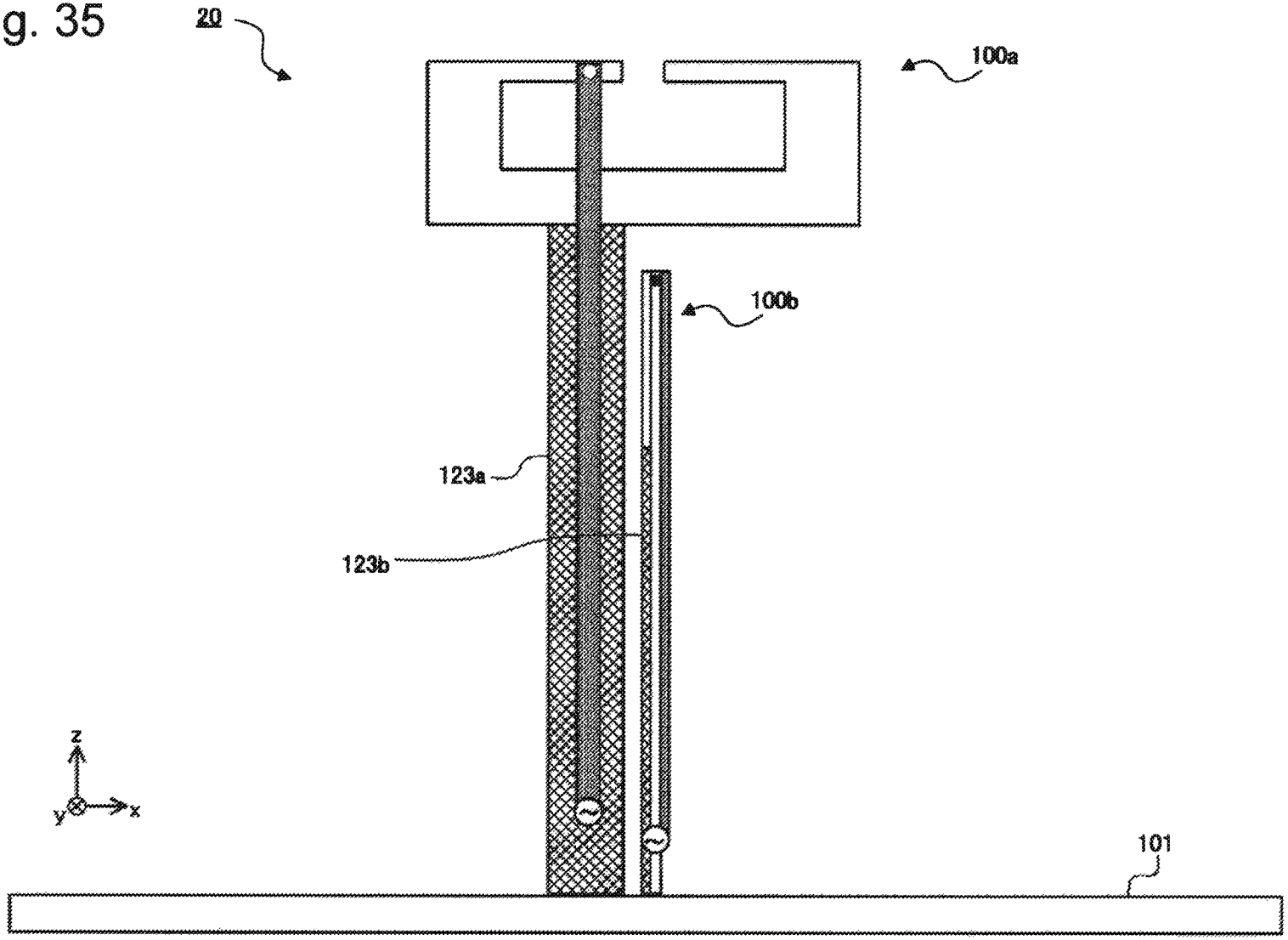
FIG. 35 is a side view of the antenna 20 modified so that the conductor power feed unit 123*a* does not overlap a conductor power feed unit 123*b*.
Figure 36:
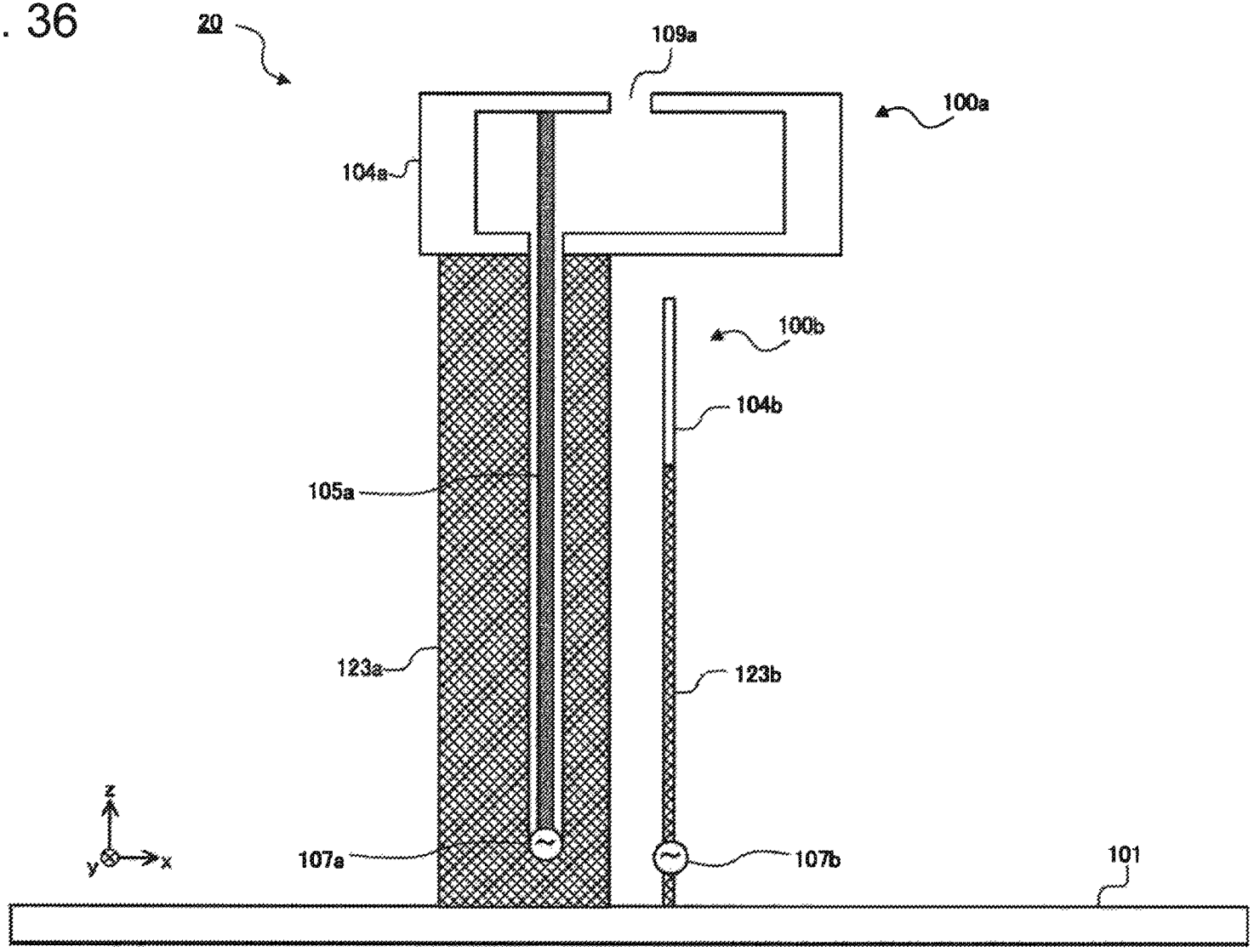
FIG. 36 is a side view of the antenna 20 in which a transmission line including a conductor power feed line 105 and a conductor power feed unit 123 is changed to a coplanar line.

Further, as illustrated in FIG. 35, to prevent the conductor power feed unit 123*a* coupled with the antenna element 100*a* and the conductor power feed unit 123*b* coupled with the antenna element 100*b* disposed in the conductor power feed unit 123*a* from overlapping each other, a gap may be further left between both conductor power feed units 123. The conductor power feed unit 123*a* and the conductor power feed unit 123*b* are electrically conductive to each other via the conductor reflection plate 101.

Further, an input impedance to an antenna viewed from the power feed point 107 depends on a connection position between the conductor via 106 (one end of the conductor power feed line 105 when the conductor via 106 is omitted) and the C-shaped conductor 104, as described in the description on the first example embodiment. However, in the antenna 20 according to the present example embodiment, the input impedance also depends on a characteristic impedance of a transmission line including the extended conductor power feed line 105 and the conductor power feed unit 123. When the characteristic impedance of the transmission line is matched with an input impedance of the split ring resonator, it becomes possible for the transmission line and the split ring resonator to feed wireless communication signals to the antenna without reflection. However, even when the impedances are not matched with each other, an essential effect of the present invention is not affected.

Further, the transmission line including by the extended conductor power feed line 105 and the conductor power feed unit 123 may be formed as a coplanar line. In an example illustrated in FIG. 36, the C-shaped conductor 104, the conductor power feed line 105, and the conductor power feed unit 123 is formed in the same layer. Further, as in FIG. 16 or FIG. 17 referred to in the description of the first example embodiment, in the antenna element 100, a cut is made in a portion of the C-shaped conductor 104 on a long side of a side (a side opposing the split part 109) close to the conductor reflection plate 101 in the C-shaped conductor 104. The conductor power feed line 105 passes through the cut portion, thereby extending the conductor power feed line 105 to a conductor reflection plate 101 side. Further, the conductor power feed unit 123 is coupled with the C-shaped conductor 104 of both sides of the cut portion. Further, in the conductor power feed unit 123, to dispose the extended conductor power feed line 105, a silt is formed in a position corresponding to the cut portion, and therefore, a U-shape is formed. Since the conductor power feed line 105 passes through the slit by extending to a direction of the conductor reflection plate 101, the above-described transmission line including the conductor power feed line 105 and the conductor power feed unit 123 can be formed as a coplanar line.

Figure 37:
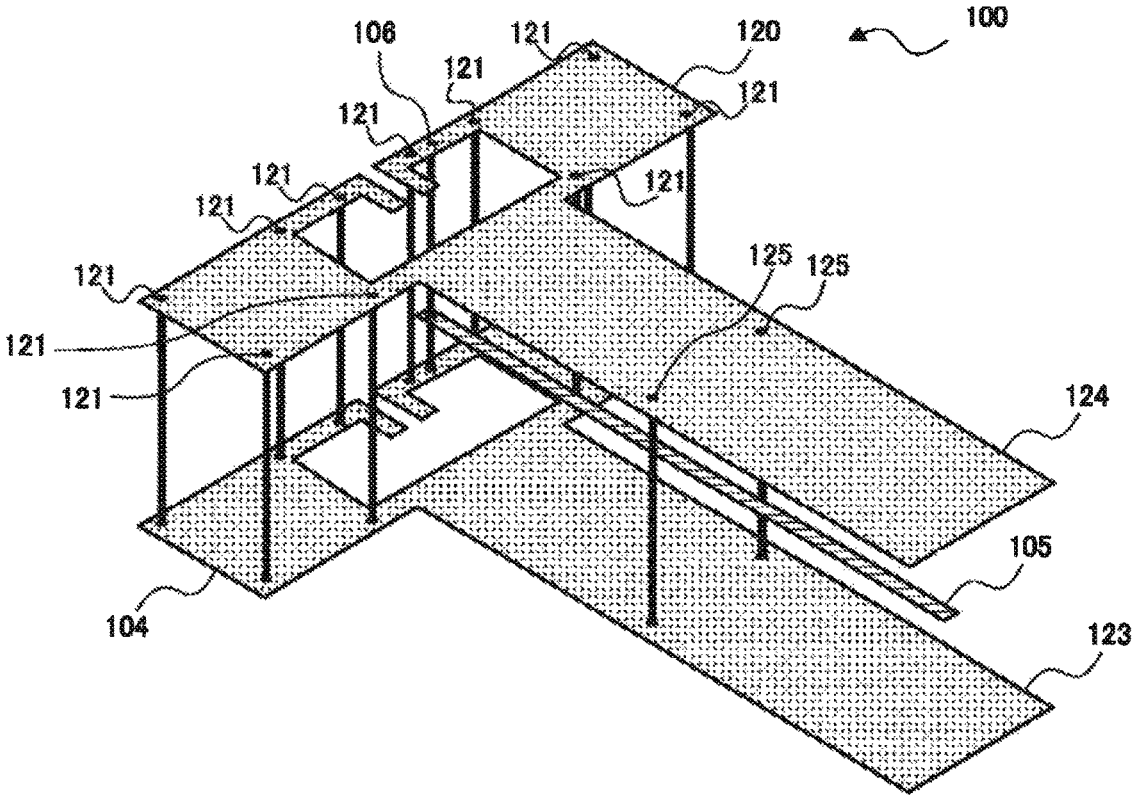
FIG. 37 is a perspective view of the antenna element 100 including two C-shaped conductors and conductor power feed units opposing each other.

Further, as illustrated in FIG. 37, the antenna 20 may be configured by providing, in addition to the C-shaped conductor 104, the C-shaped conductor 120 having the same configuration as the C-shaped conductor 104, as in FIG. 28 or FIG. 29 referred to in the description on the first example embodiment. In an example illustrated in FIG. 37, in a layer different from the C-shaped conductor 104 and the conductor power feed line 105, the C-shaped conductor 120 that is a second C-shaped conductor is disposed. Further, in the same manner as a state that the C-shaped conductor 104 is coupled with the conductor power feed unit 123, the C-shaped conductor 120 is coupled with a conductor power feed unit 124 of the same layer as the C-shaped conductor 120. Further, a configuration is made so that the layer of the C-shaped conductor 104 and the conductor power feed unit 123 and the layer of the C-shaped conductor 120 and the conductor power feed unit 124 sandwich the layer of the conductor power feed line 105. The conductor power feed line 105 opposes the conductor power feed unit 123 and the conductor power feed unit 124.

The C-shaped conductor 104 and the C-shaped conductor 120 are electrically connected to each other by a plurality of conductor vias 121. Further, the conductor power feed unit 123 and the conductor power feed unit 123 are electrically connected to each other by a plurality of conductor vias 125.

At this time, a significant portion of a circumference of the conductor power feed line 105 is surrounded by the C-shaped conductor 104 and the C-shaped conductor 120 that are conductors conductive to each other, a plurality of conductor vias 121, the conductor power feed unit 123 and the conductor power feed unit 124, and a plurality of conductor vias 125. This makes it possible to reduce radiation of unnecessary signal electromagnetic waves from the conductor power feed line 105.

Figure 38:
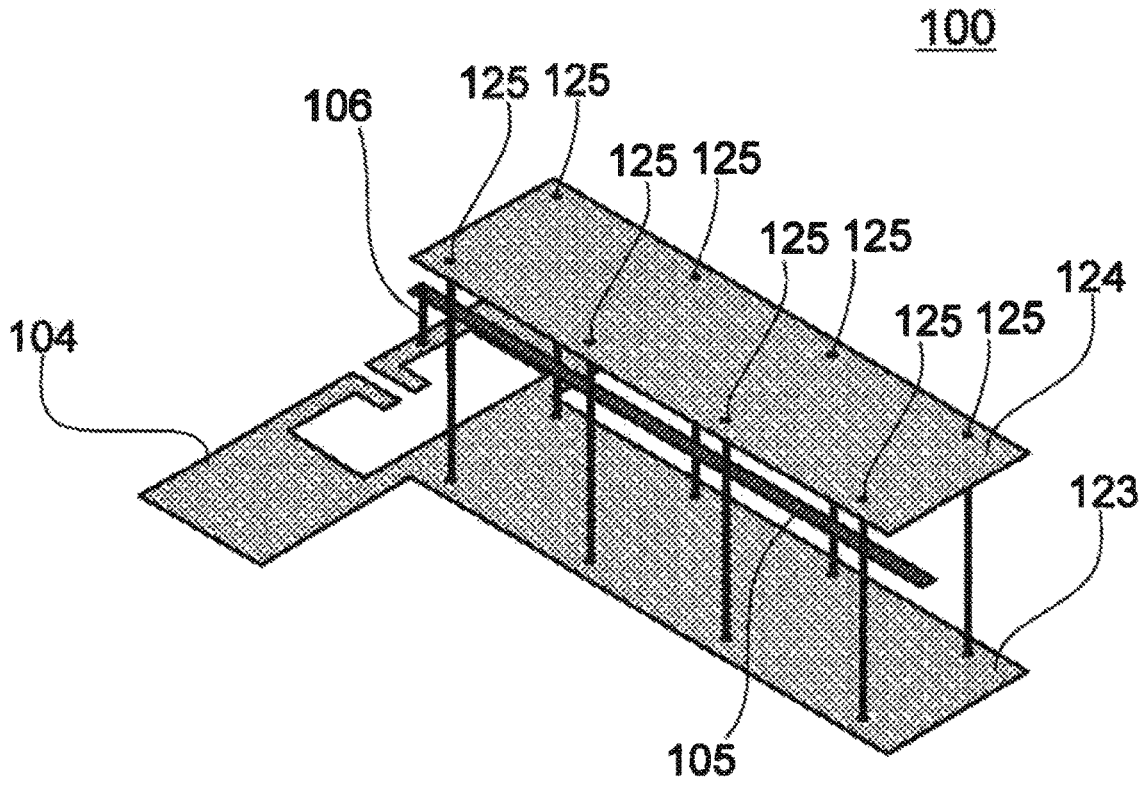
FIG. 38 is a perspective view of the antenna element 100 including only conductor power feed units opposing each other.

Further, a configuration is illustrated in FIG. 37 in which both the C-shaped conductor 120 and the conductor power feed unit 124 are added, but it goes without saying that a configuration is conceivable in which only either of the C-shaped conductor 120 and the conductor power feed unit 124 is added. As illustrated in FIG. 38, for example, in the case of a configuration in which only the conductor power feed unit 124 is added, in the same manner as the configuration of FIG. 37, electromagnetic waves transmitted by the conductor power feed line 105 can be confined by a plurality of conductor vias 125, the conductor power feed unit 123, and the conductor power feed unit 124, and therefore, it is possible to reduce radiation of unnecessary signal electromagnetic waves from the conductor power feed line 105.

Figure 39:
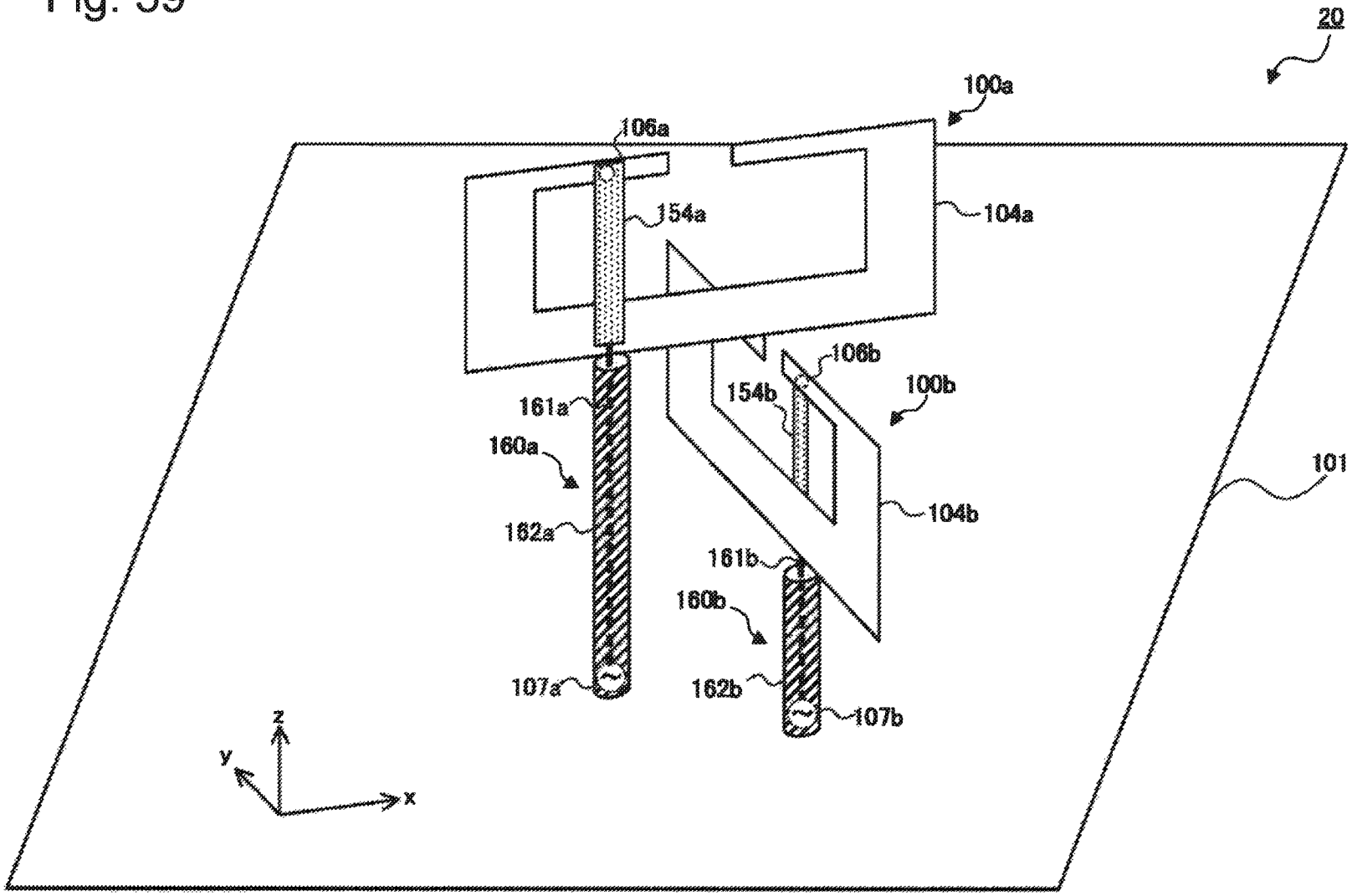
FIG. 39 is a perspective view of the antenna 20 in which a transmission line is changed to a coaxial line.

Further, the above-described transmission line including the conductor power feed line 105 and the conductor power feed unit 123 may be a coaxial line. FIG. 39 is a diagram illustrating one example of the antenna 20 in which a transmission line is changed to a coaxial line. Note that in FIG. 39, an illustration of the dielectric layer 108 is omitted to understand other components. In an example illustrated in FIG. 39, the antenna element 100 comprises a conductor power feed line 154 that is the same as in the first example embodiment. Further, the antenna element 100 is coupled with a coaxial cable 160. The coaxial cable 160 includes a core line 161 and an outer conductor 162. The core line 161 is connected to the conductor power feed line 154, and the outer conductor 162 is connected to a lower end of the C-shaped conductor 104. Further, the power feed point 107 is disposed so as to electrically perform excitation between the core line 161 and the outer conductor 162. The core line 161 and the conductor power feed line 154 are equivalent to the conductor power feed line 105, and the outer conductor 162 is equivalent to the conductor power feed unit 123.

Figure 40:
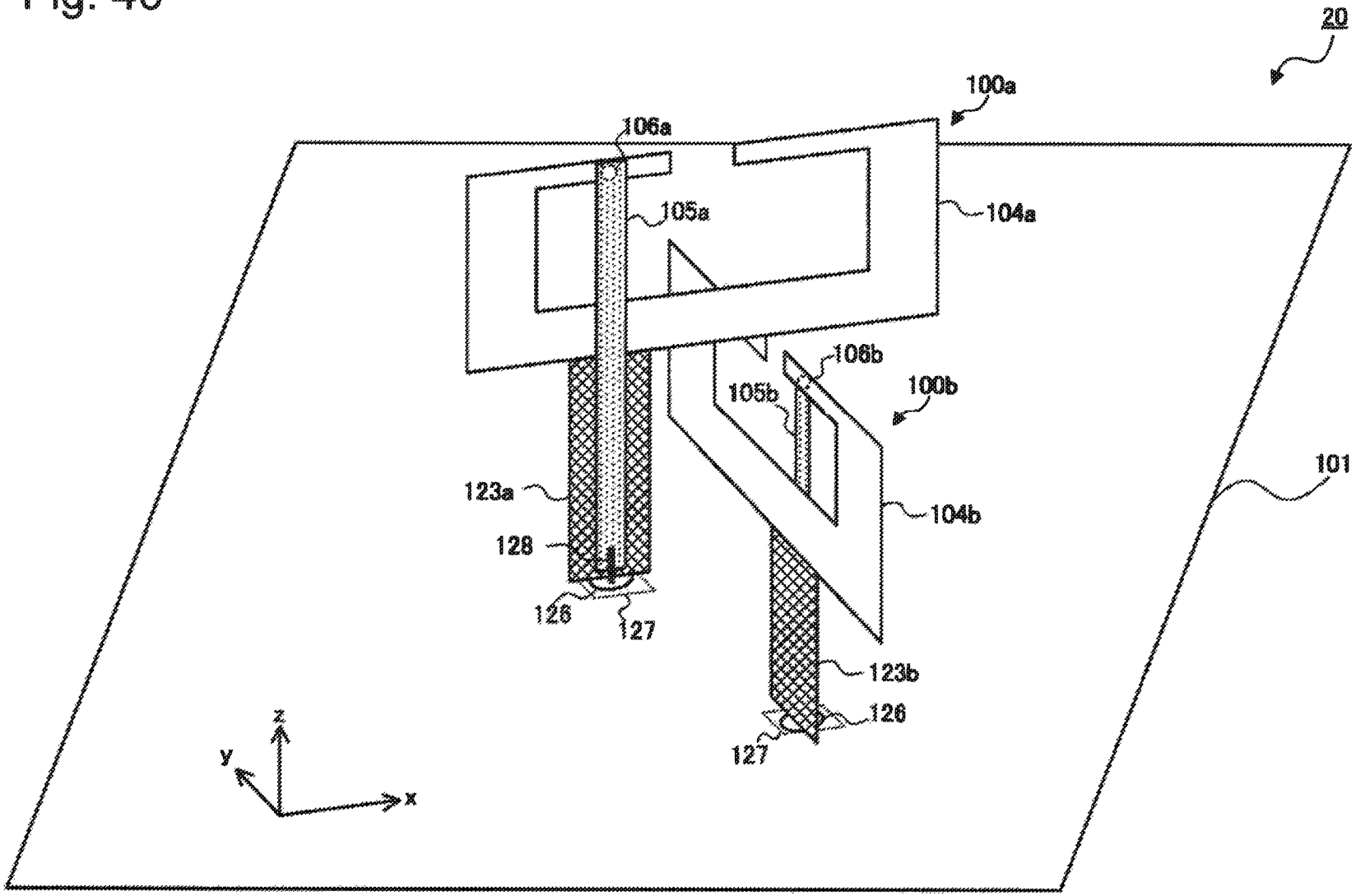
FIG. 40 is a perspective view of the antenna 20 modified to dispose a coaxial cable on a back side of the conductor reflection plate 101.
Figure 41:
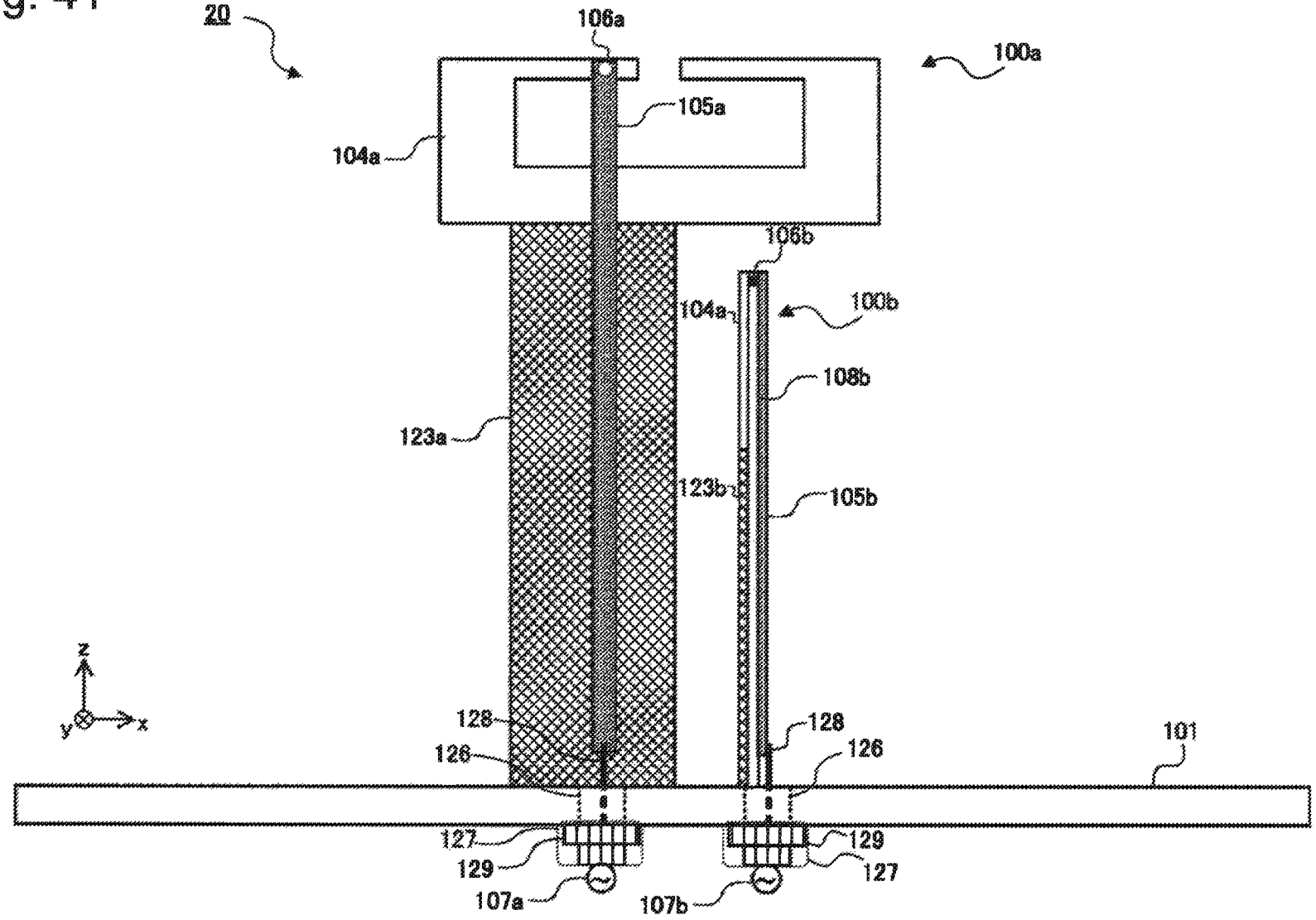
FIG. 41 is a side view of the antenna 20 modified to dispose a coaxial cable on a back side of the conductor reflection plate 101.

Further, when a coaxial cable is used, the coaxial cable may be disposed on a back side (a z-axis negative direction side) of the conductor reflection plate 101. FIG. 40 and FIG. 41 are diagrams illustrating one example of the antenna 20 in which a coaxial cable is disposed on a back side of the conductor reflection plate 101. Note that in order to understand other components, in FIG. 40, an illustration of the dielectric layer 108 is omitted, and in FIG. 41, an illustration of the dielectric layer 108*a* of the antenna element 100*a* is omitted. In the example illustrated in FIG. 40 and FIG. 41, a clearance 126 that is a through-hole is provided for the conductor reflection plate 101. Further, in a position of a back side (a z-axis negative direction side) of the conductor reflection plate 101 corresponding to a position of the clearance, a connector 127 is disposed. The connector 127 is a connector that connects a coaxial cable, not illustrated. An outer conductor 129 of the connector 127 is electrically connected to the conductor reflection plate 101. A core line 128 of the connector 127 passes through an inside of the clearance 126, penetrates to a front side (a z-axis positive direction side) of the conductor reflection plate 101, and is thereby electrically connected to the conductor power feed line 105 of the antenna element 100. Further, the power feed point 107 can electrically perform excitation between the core line 128 of the connector 127 and the outer conductor 129. Such a configuration makes it possible to feed power to the antenna element 100 of a front side of the conductor reflection plate 101 from a wireless communication circuit or a digital circuit disposed on a back side of the conductor reflection plate 101, and therefore, a wireless communication device can be configured without causing a large influence on a radiation pattern or radiation efficiency. Note that in the example illustrated in FIG. 40 and FIG. 41, while a coaxial cable is disposed on a back side of the conductor reflection plate 101, a conductor configuring a transmission line may be disposed on a back side of the conductor reflection plate 101 and it is not always necessary to form a coaxial cable.

Still further, in the same manner as in the first example embodiment, the conductor reflection plate 101 is a short-circuited plane with respect to the antenna elements 100*a* and 100*b*. Therefore, to suppress an influence on resonance characteristics of the antenna element, a distance Z between the antenna elements 100*a* and 100*b* and the conductor reflection plate 101 in FIG. 30 is preferably substantially a quarter of a wavelength observed when an electromagnetic wave having a frequency that is a resonance frequency of the antenna element travels in a material with which an area is filled. However, even in a case of being not substantially a quarter of the wavelength, an essential effect of the present invention is not affected. Further, the antenna elements 100*a* and 100*b* may have a different value for the distance Z.

Third Example Embodiment

Figure 42:
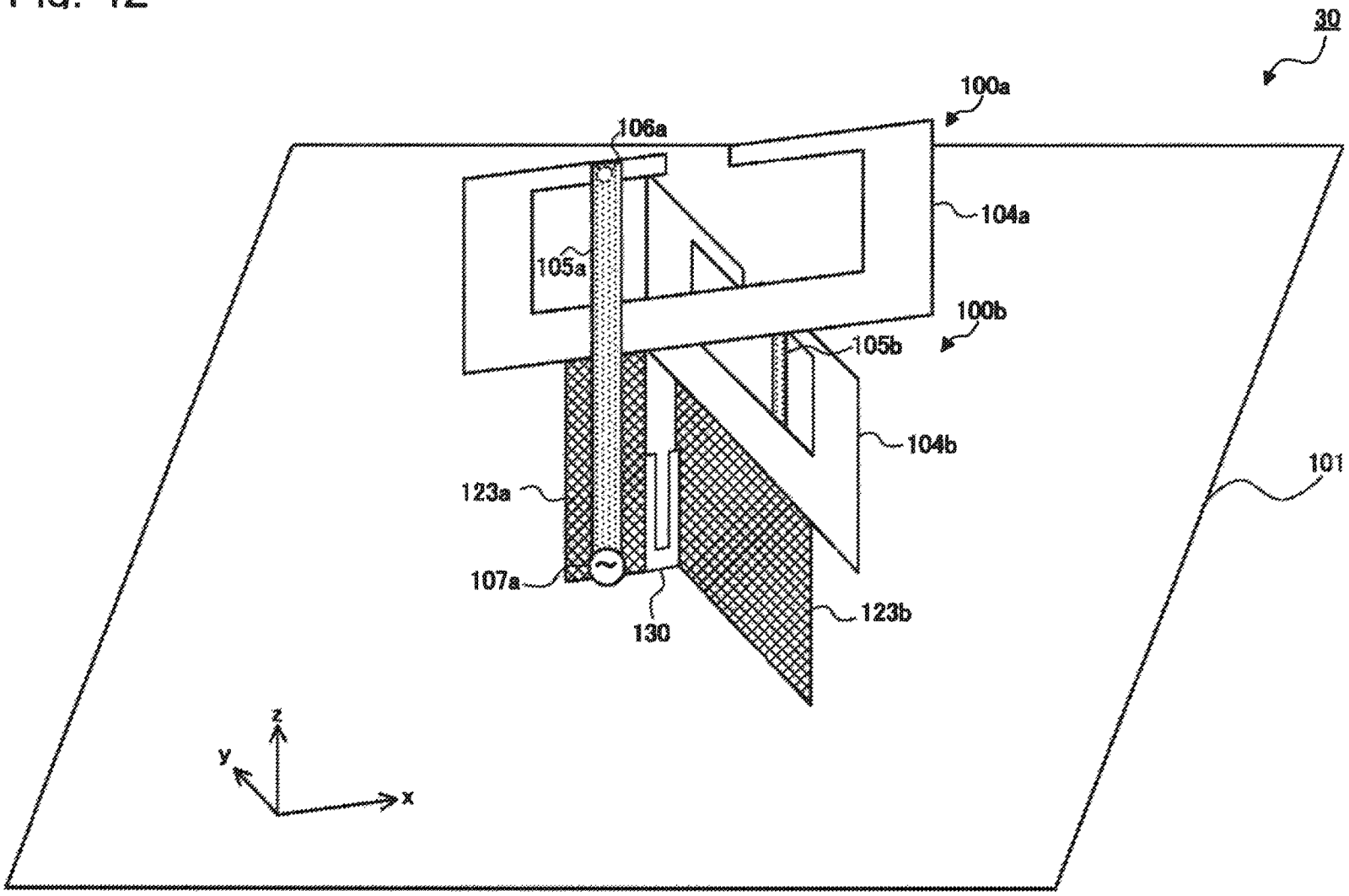
FIG. 42 is a perspective view of an antenna 30 according to a third example embodiment.
Figure 43:
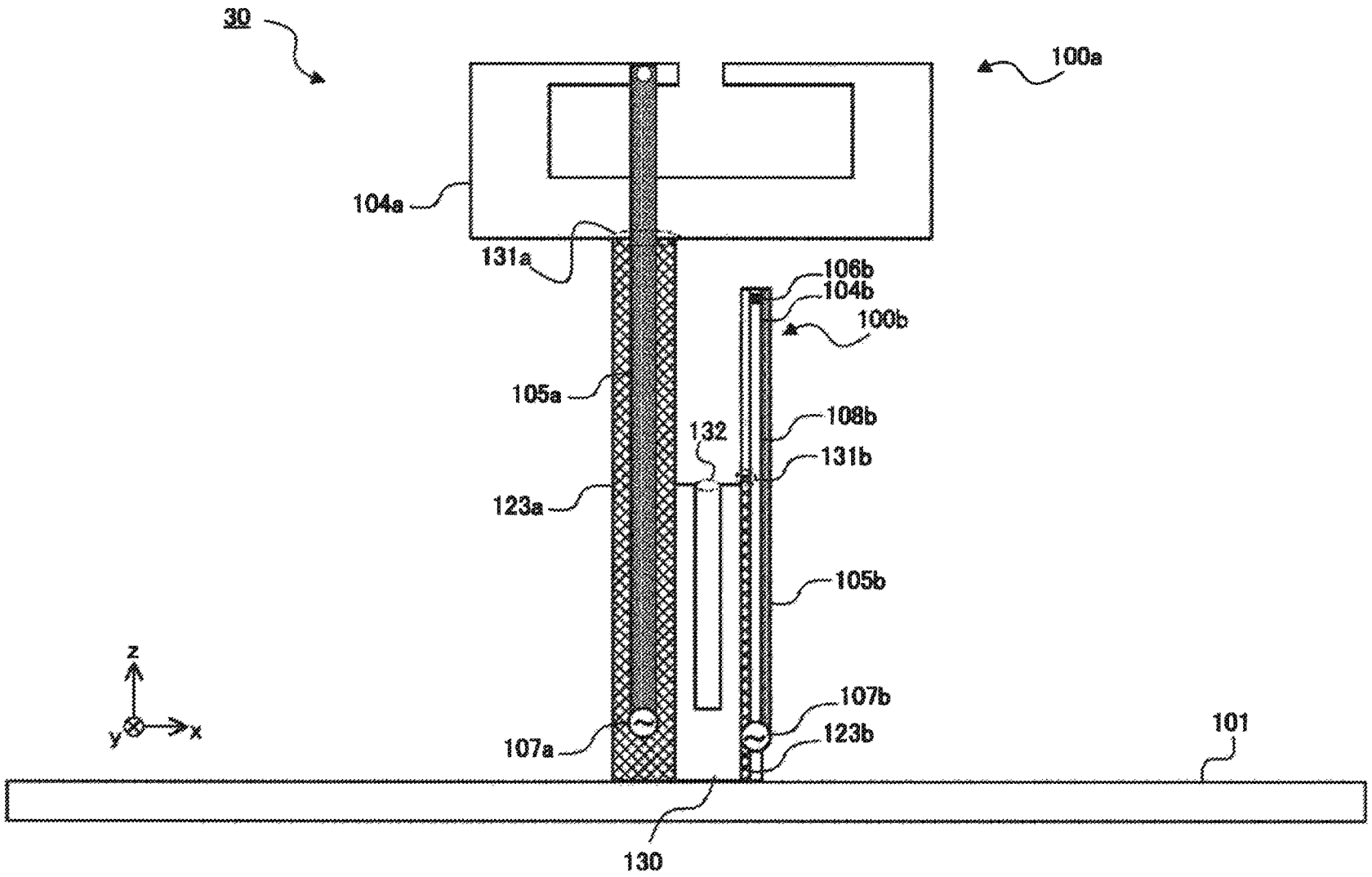
FIG. 43 is a front view of the antenna 30 according to the third example embodiment.

Next, an antenna 30 according to a third example embodiment of the present invention will be described. In the following description, the same components as the above-described components are assigned with the same reference signs, and therefore, description thereof will be omitted, as appropriate. FIG. 42 is a perspective view of the antenna 30, and FIG. 43 is a front view of the antenna 30. Note that in FIG. 42, an illustration of a dielectric layer 108 is omitted. Further, in FIG. 43 and FIG. 45 to FIG. 48 to be described later, an illustration of a dielectric layer 108*a* of an antenna element 100*a* is omitted.

The antenna 30 according to the third example embodiment is different from the antenna 20 according to the second example embodiment in a point that a slit part is disposed between a conductor power feed unit 123*a* coupled with an antenna element 100*a* and a conductor power feed unit 123*b* coupled with an antenna element 100*b*.

More specifically, in the antenna 30, conductor power feed units 123 of the respective antenna elements are not coupled with each other and are disposed by leaving a gap. A slit conductor 130 in which a portion of an end thereof is open and a slit is formed is disposed between the conductor power feed units 123 of the antenna elements. The slit formed in the slit conductor 130 is open toward a direction of a connection point 131 that is a connection portion of the conductor power fed unit 123 and a C-shaped conductor 104. In other words, an open end 132 that is an open portion of the slit of the slit conductor 130 is located on a connection point 131 side. Each of the conductor power feed units 123*a* and 123*b* is coupled with the slit conductor 130 by electric conduction so as to sandwich the slit. In other words, in a portion creating left and right sides of a certain side of the open end 132 in an outer edge of the slit conductor 130, the conductor power feed units 123*a* and 123*b* are coupled with each other. The antenna 30 is different from the antenna 20 according to the second example embodiment in the above-described configuration, but other configurations are the same. Note that in FIG. 42 and FIG. 43, the slit conductor 130 is coupled with a conductor reflection plate 101, but does not always need to be coupled with the conductor reflection plate 101.

Hereinafter, an effect of the antenna 30 according to the third example embodiment will be described.

When a communication signal from a power feed point 107 is transmitted to the antenna element via the connection point 131, a part of the communication signal creeps, from one connection point 131, into the other connection point 131 and the antenna element via the conductor power feed unit 123, or the conductor power feed unit 123 and a conductor (e.g. the conductor reflection plate 101) coupled with the conductor power feed unit 123. In other words, it is conceivable that when, for example, a communication signal from a power feed point 107*a* is transmitted to the antenna element 100*a* via the connection point 131*a*, a part of the communication signal makes a turn at the 131*a* and creeps into the antenna element 100*b* in order of the conductor power feed unit 123*a*, the conductor power feed unit 123*b*, and the connection point 131*b*. In such a case, coupling between both antenna elements may be increased.

In contrast, in the antenna 30, a slit formed in the slit conductor 130 reduces current flowing between the connection points 131*a* and 131*b*. Therefore, coupling between the connection points 131*a* and 131*b* can be suppressed.

The above makes it possible to provide a dual polarization wave antenna in which coupling between dual polarization wave antenna elements is further suppressed, in addition to the effect according to the first example embodiment and the effect according to the second example embodiment. Further, when in the same manner as in the first example embodiment, using the antenna 30, a wireless communication device, an antenna array, or a base station device is configured, it is possible to provide a wireless communication device, an antenna array, or a base station device in which an influence of a transmission line on resonance characteristics of an antenna element is suppressed.

Note that all the modified examples of the antenna element 100 described in the first example embodiment are appropriately applied also in the antenna element 100 of the present example embodiment. Hereinafter, further modified examples of the present example embodiment will be described.

Figure 44:
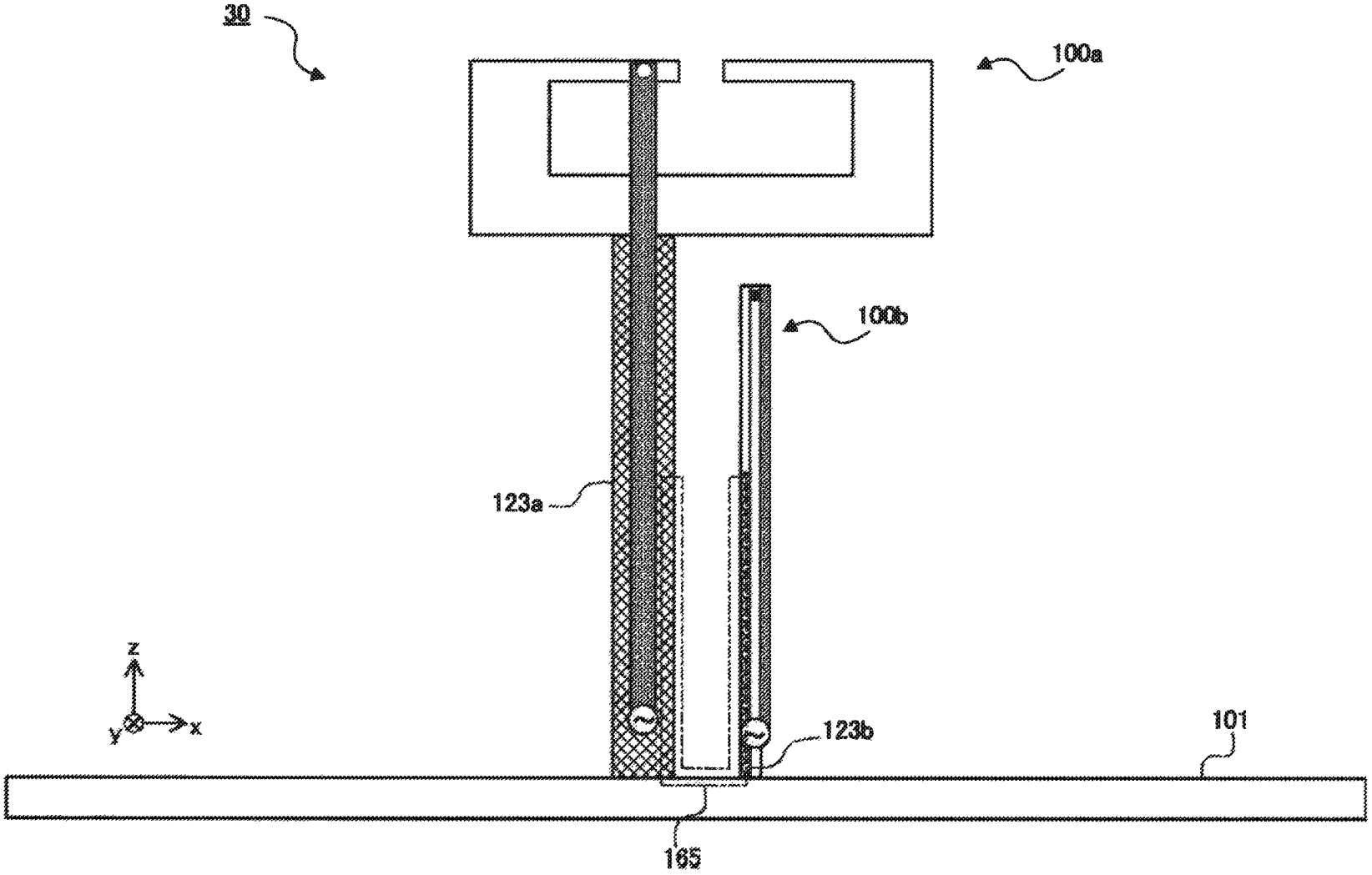
FIG. 44 is a front view of the antenna 30 modified to include a slit part without including a slit conductor 130.

In formation of a slit part, it is not always necessary to provide the slit conductor 130. FIG. 44 is a schematic diagram illustrating one example of the antenna 30 in which a slit part is provided without providing the slit conductor 130. In the example illustrated in FIG. 44, a configuration is made in which the conductor power feed units 123 of respective antenna elements are not made conductive on an upper side of the conductor reflection plate 101 but are electrically made conductive via the conductor reflection plate 101. In other words, the same configuration as the configuration illustrated in FIG. 35 in the second example embodiment is made. Such a configuration also makes it possible to form a slit part 165 by two ends of the conductor power feed units 123*a* and 123*b* and the conductor reflection plate 101.

Further, when a length of the slit is λ/4, the slit electromagnetically resonates at a frequency equivalent to k, and the above-described open end 132 becomes an electrically open end. This makes it possible to further suppress current between the connection points 131*a* and 131*b*. Therefore, a length of the slit in the present example embodiment or the above-described modified example is preferably λ/4. However, the length of the slit does not always need to be λ/4 and may be smaller or larger than λ/4 in an allowable range of inter-antenna element coupling.

Figure 45:
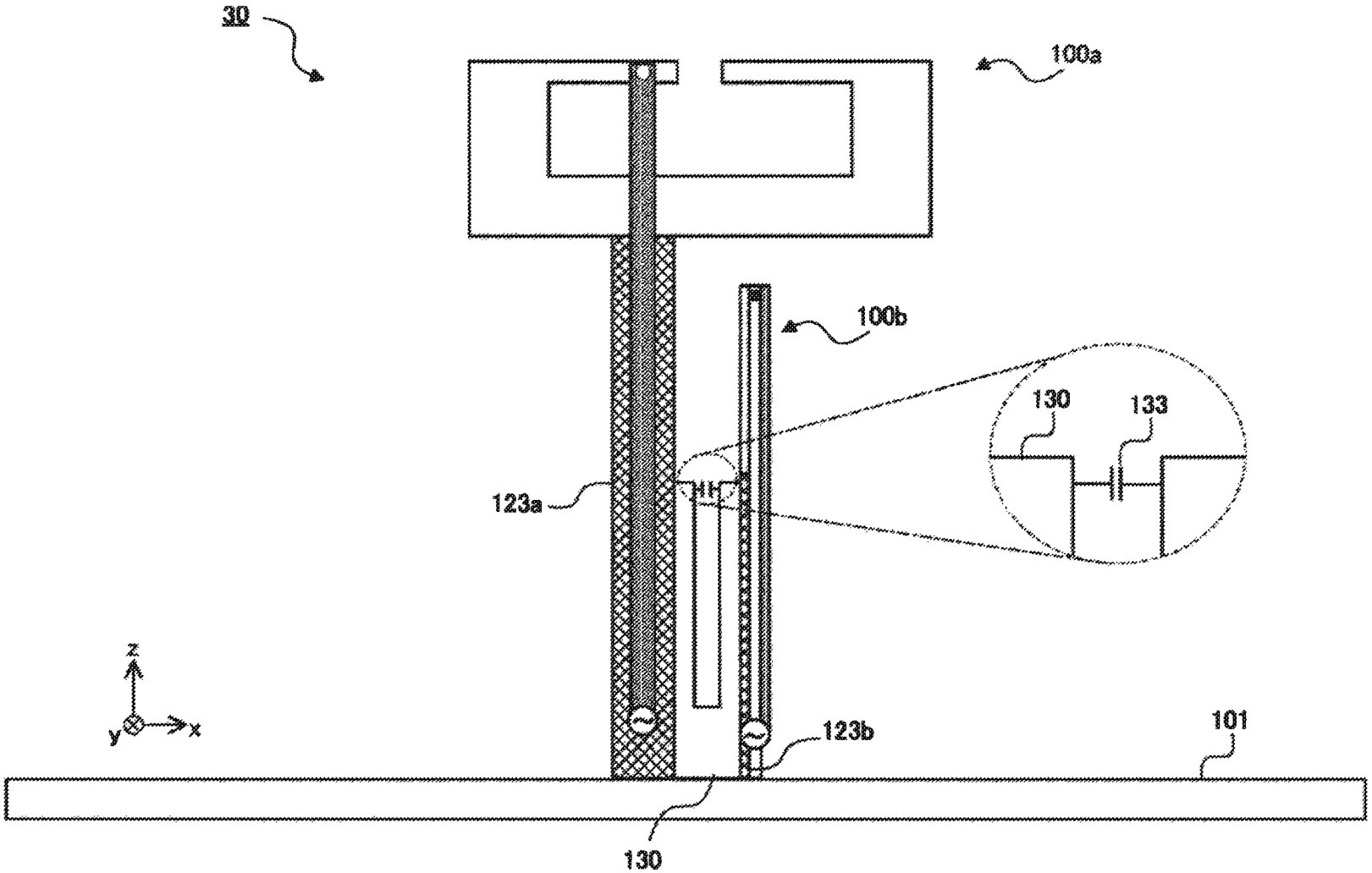
FIG. 45 is a front view of the antenna 30 modified so that a capacitor component 133 is mounted between two points across a slit and an enlarged view of the capacitor component 133.

Further, when it is difficult to produce a slit having a desired length, an effective electric length of the slit may be extended without changing an actual length of the slit. As illustrated in FIG. 45, for example, between two points straddling a slit of an open end 132 vicinity of the slit conductor 130 formed with the slit, a capacitor component 133 may be mounted.

Figure 46:
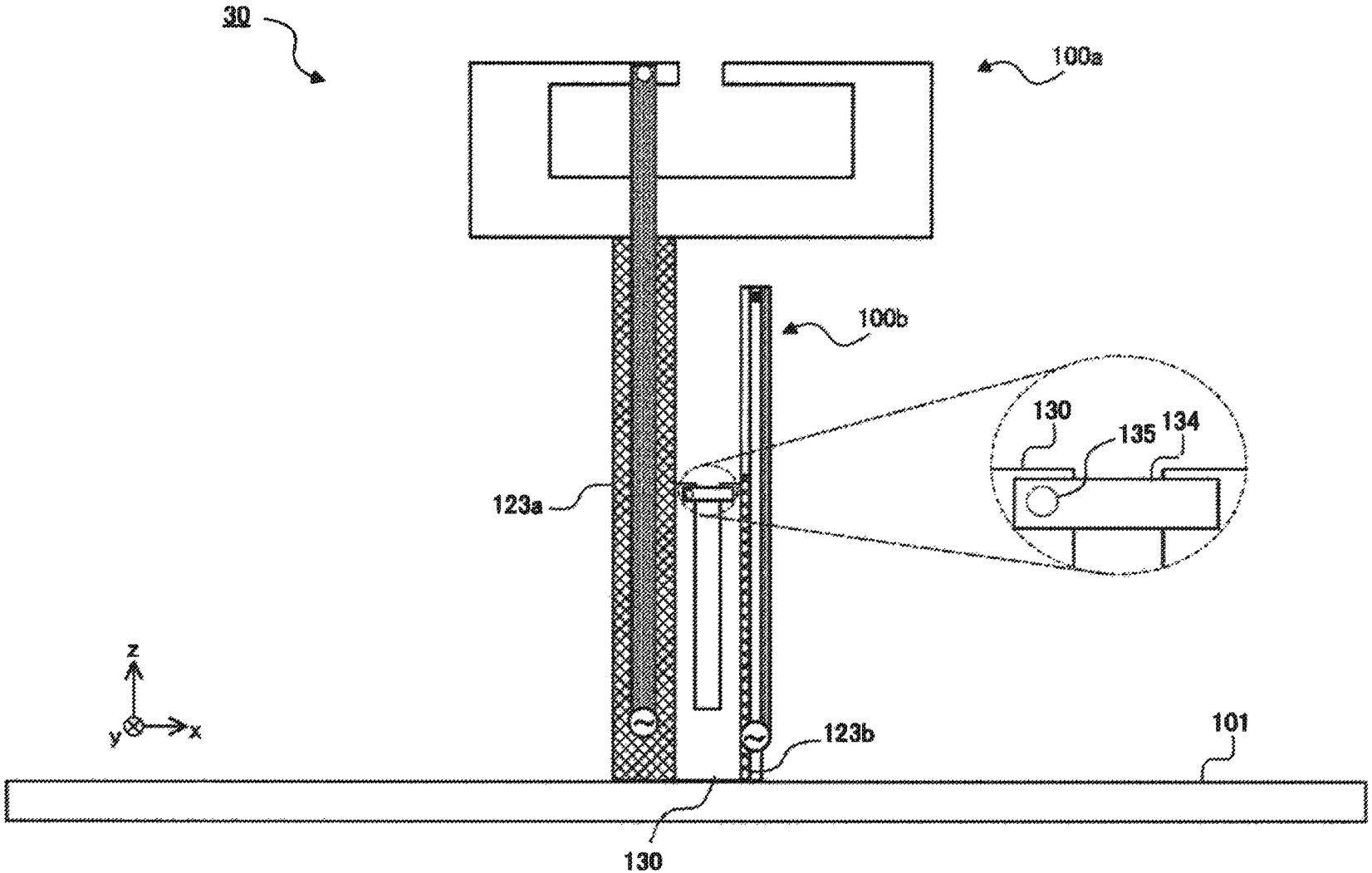
FIG. 46 is a front view of the antenna 30 modified so that an auxiliary conductor 134 opposing a slit in a straddle manner is disposed and an enlarged view of the auxiliary conductor 134.

Alternatively, as illustrated in FIG. 46, instead of the capacitor component 133, an auxiliary conductor 134 may be used. In an example illustrated in FIG. 46, in an open end 132 vicinity, the auxiliary conductor 134 opposing the slit conductor 130 is disposed so as to straddle a slit of the slit conductor 130. The auxiliary conductor 134 is electrically conductive to one conductor part of conductor parts of the slit conductor 130 on both sides of the slit via a conductor via 135.

In the modifies examples illustrated in FIG. 45 and FIG. 46, the capacitor component 133 or the auxiliary conductor 134 adds capacitance between conductors close to both sides of the open end 132 of the slit conductor 130. Therefore, frequency reduction is performed for a resonance frequency of the slit. As a result, an electric length of the slit is effectively extended.

Figure 47:
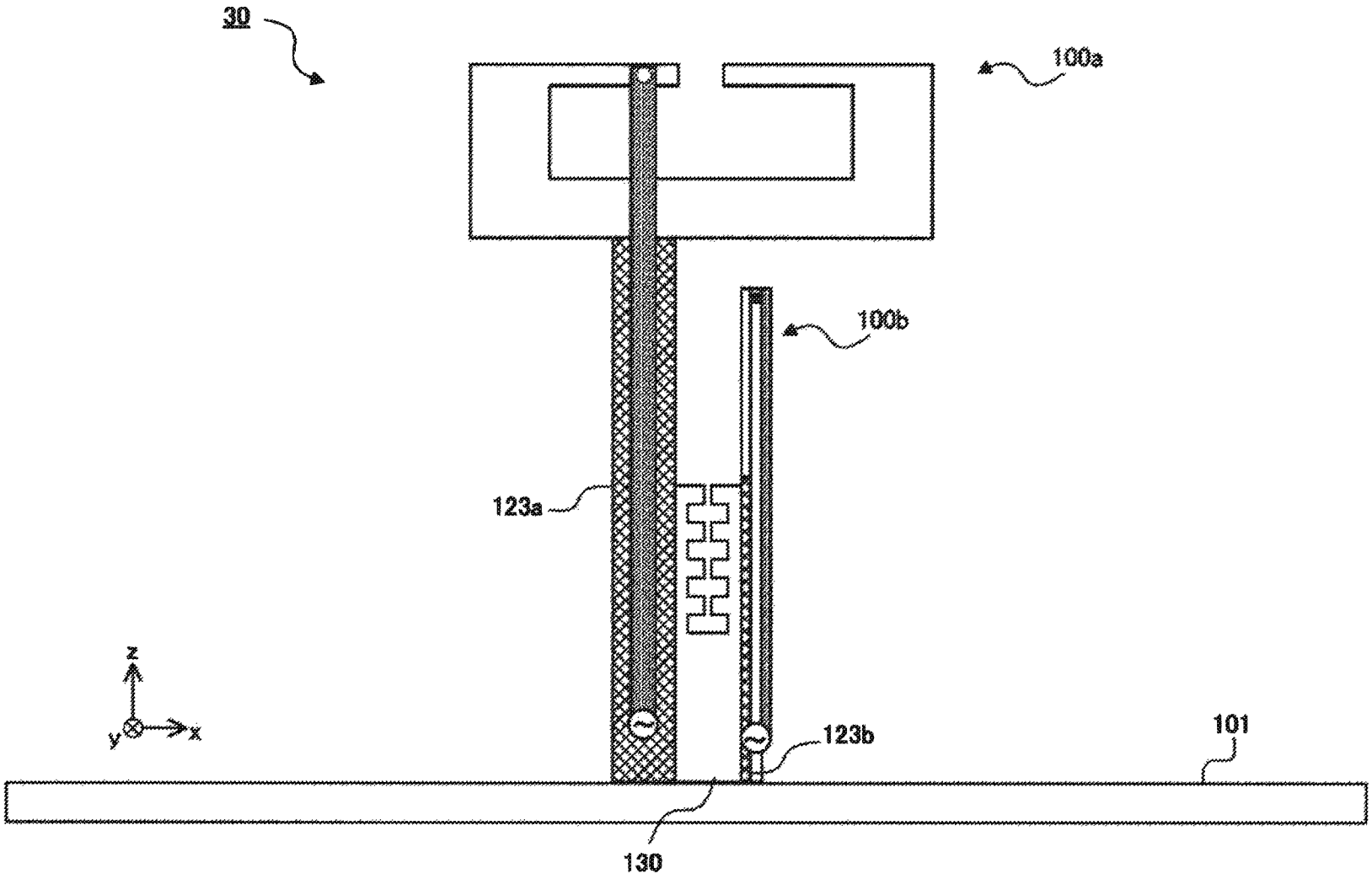
FIG. 47 is a front view of the antenna 30 in which a shape of a slit is changed.
Figure 48:
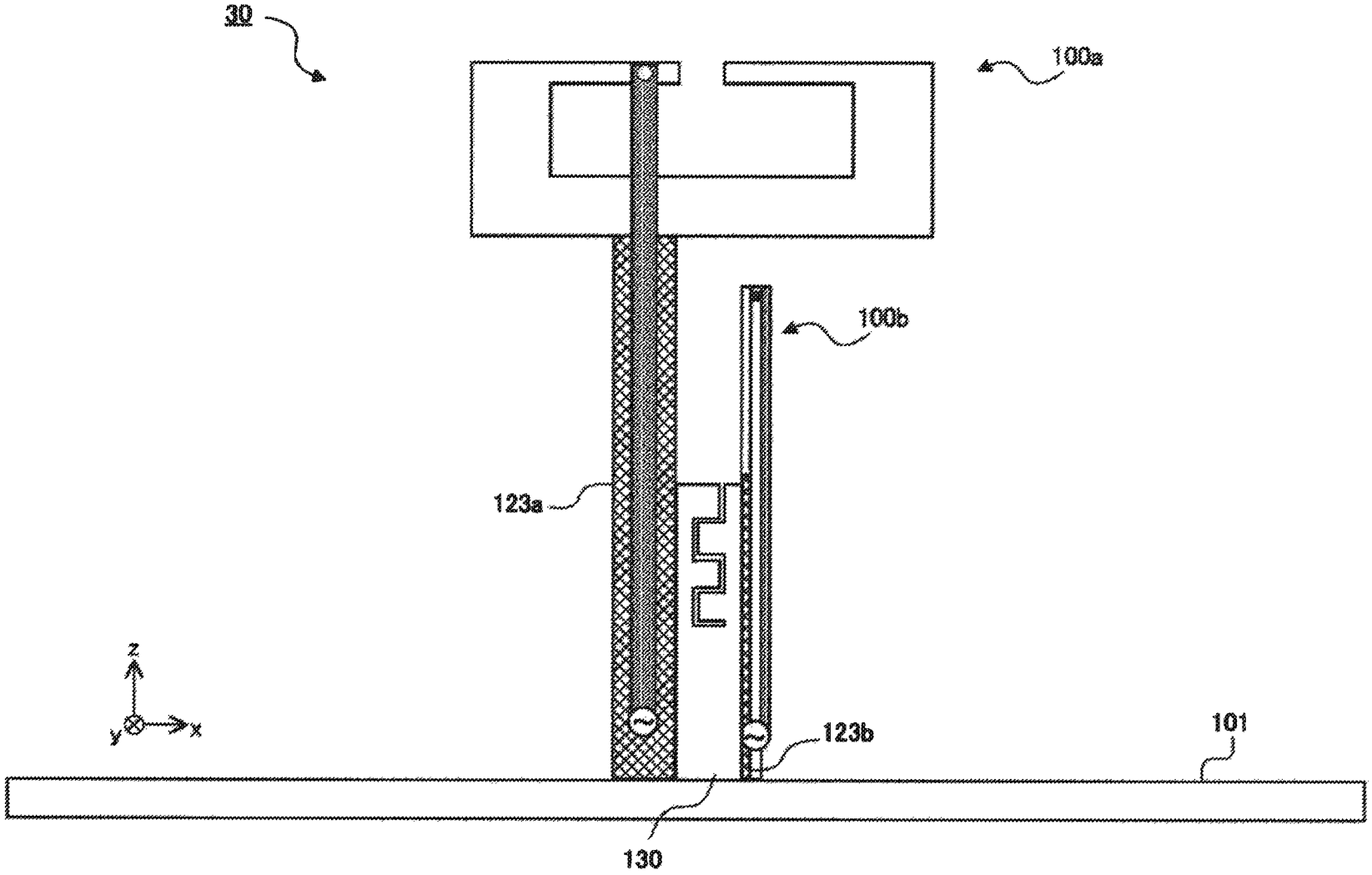
FIG. 48 is a front view of the antenna 30 in which a shape of a slit is changed.

Further, as illustrated in FIG. 47, for example, an outer edge of the slit conductor 130 that forms a slit may have a meander shape. In an example illustrated in FIG. 47, in an outer edge of the silt conductor 130, a portion formed with a slit has a repetitive concave-convex shape. Further, in the formed slit, concave portions oppose each other, and convex portions oppose each other. Alternatively, as illustrated in FIG. 48, a slit itself has a meander shape.

In these cases, a meander shape increases an inductance of a circumference direction of the slit and performs frequency reduction for operations of the slit conductor 130. As a result, an electric length of the slit is effectively extended. The slit shape may be a shape different from the meander shapes illustrated in FIG. 47 and FIG. 48 to increase an inductance of a circumference direction of the slit.

Further, various types of dielectric materials or magnetic materials that assist the above-described capacitance increase or inductance increase may be loaded in a slit conductor 130 vicinity.

Further, the slit conductor 130 is coupled with the conductor power feed unit 123 in the present example embodiment, but the same slit conductor 130 may be configured between ground portions of a transmission line, not illustrated, connected to the power feed point 107 according to the first example embodiment.

In the above, various example embodiments and various modified examples of the present invention have been described, but it goes without saying that a plurality of example embodiments and a plurality of modified examples described above may be combined in a scope where these contents do not conflict. Further, in the above-described example embodiments and modified examples, functions and the like of the components have been specifically described, but the functions and the like can be subjected to various modifications in a scope satisfying the present invention.

Further, the above-described example embodiments are merely examples for applications of technical ideas obtained by the present inventors. In other words, it goes without saying that the technical ideas are not limited only to the example embodiments and can be subjected to various modifications.

A part or all of the example embodiments can be described, for example, as the following supplementary notes, but the present invention is not limited to the following.

(Supplementary Note 1)

An antenna comprising:

two antenna elements; and a conductor reflection plate, each of the antenna elements including a C-shaped conductor that is a substantially C-shaped conductor formed with a split part so that a portion of an annular conductor is made discontinuous, and a conductor power feed line that is electrically connected to one part of both parts of the C-shaped conductor opposing each other across the split part and configures a current path for feeding power to the C-shaped conductor, the two antenna elements being disposed substantially orthogonally so that one of the antenna elements and the other of the antenna elements partially overlap each other when projected on the conductor reflection plate.

(Supplementary Note 2)

The antenna according to Supplementary Note 1, wherein a distance between any of the antenna elements and the conductor reflection plate is a length of substantially a quarter of a wavelength of an electromagnetic wave having a frequency that is a resonance frequency of the antenna element.

(Supplementary Note 3)

The antenna according to Supplementary Note 1 or 2, wherein the two antenna elements are disposed substantially orthogonally so that substantially central portions of one of the antenna elements and the other of the antenna elements overlap each other when the antenna elements are projected on the conductor reflection plate.

(Supplementary Note 4)

The antenna according to any one of Supplementary Notes 1 to 3, wherein the two antenna elements are disposed substantially in parallel with the conductor reflection plate.

(Supplementary Note 5)

The antenna according to any one of Supplementary Notes 1 to 4, wherein the C-shaped conductor further comprises a cut portion, and the conductor power feed line is passed through an inside of the cut portion.

(Supplementary Note 6)

The antenna according to any one of Supplementary Notes 1 to 5, wherein both portions of the C-shaped conductor opposing each other across the split part have a shape bent in a direction substantially orthogonal to an opposing direction.

(Supplementary Note 7)

The antenna according to any one of Supplementary Notes 1 to 6, wherein each of the antenna elements includes two C-shaped conductors opposing each other.

(Supplementary Note 8)

The antenna according to any one of Supplementary Notes 1 to 7, further comprising a conductor power feed unit configuring another current path for feeding power to the C-shaped conductor, the conductor power feed unit including one end coupled with an outer edge portion of the C-shaped conductor and the other end coupled with the conductor reflection plate and being disposed side-by-side with the conductor power feed line.

(Supplementary Note 9)

The antenna according to Supplementary Note 8, wherein one end of the conductor power feed unit is coupled with a portion located in a vicinity of the central portion of the C-shaped conductor in the outer edge portion of the C-shaped conductor.

(Supplementary Note 10)

The antenna according to Supplementary Note 8 or 9, wherein the conductor power feed unit coupled with one of the antenna elements and the conductor power feed unit coupled with the other of the antenna elements are disposed by leaving a gap, the antenna further comprises a slit conductor that is a conductor coupled, by electric conduction, with the conductor power feed unit coupled with one of the antenna elements and the conductor power feed unit coupled with the other of the antenna elements and is a conductor including a slit, and an opening of the slit faces a connection point side of the conductor power feed unit and the C-shaped conductor.

(Supplementary Note 11)

The antenna according to Supplementary Note 10, wherein an electric length of the slit is a length of substantially a quarter of a wavelength of an electromagnetic wave having a frequency that is a resonance frequency of the antenna elements.

(Supplementary Note 12)

The antenna according to Supplementary Note 10 or 11, wherein a capacitor component is mounted between two conductors of an open-end vicinity of the slit.

(Supplementary Note 13)

The antenna according to any one of Supplementary Notes 10 to 12, further comprising a slit auxiliary conductor that straddles the slit in an open-end vicinity of the slit and opposes the slit conductor, wherein any one of conductor parts of both sides of the slit in the slit conductor is electrically connected to the slit auxiliary conductor.

(Supplementary Note 14)

The antenna according to any one of Supplementary Notes 10 to 13, wherein the slit has a meander structure.

(Supplementary Note 15)

The antenna according to any one of Supplementary Notes 1 to 14, wherein each of the antenna elements further includes at least one auxiliary conductor that is electrically connected to one part of both parts of the C-shaped conductor opposing each other across the slit part and opposes the other part.

(Supplementary Note 16)

The antenna according to any one of Supplementary Notes 1 to 15, wherein each of the antenna elements further includes at least one conductor radiation unit that is electrically connected to an outer edge of an end of the C-shaped conductor in a direction where both parts of the C-shaped conductor opposing each other across the spit part oppose each other.

(Supplementary Note 17)

The antenna according to any one of Supplementary Notes 1 to 16, wherein the C-shaped conductor has a substantially rectangular shape, and the slit part is located on a long side of the substantially rectangular shape.

(Supplementary Note 18)

An antenna array including a plurality of the antennas according to any one of Supplementary Notes 1 to 17.

(Supplementary Note 19)

A wireless communication device mounted with the antenna according to any one of Supplementary Notes 1 to 17 or the antenna array according to Supplementary Note 18.

While the present invention has been described with reference to example embodiments thereof, the present invention is not limited to the example embodiments. The constitution and details of the present invention can be subjected to various modifications which can be understood by those skilled in the art, without departing from the scope of the invention.

This application is based upon and claims the benefit of priority from Japanese patent application No. 2014-142484, filed on Jul. 10, 2014, the disclosure of which is incorporated herein in its entirety by reference.

REFERENCE SIGNS LIST

10 antenna
11 wireless communication device
12 antenna array
13 base station device
14 antenna array
20 antenna
30 antenna
100*a*, 100*b* antenna element
101 conductor reflection plate
104*a*, 104*b* C-shaped conductor
105*a*, 105*b* conductor power feed line
106 conductor via
107*a*, 107*b* power feed point
108*a*, 108*b* dielectric layer
109*a*, 109*b* split part
110, 111 conductor part
112 dielectric radome
113 transmission line
114 wireless communication circuit unit
115 wireless communication circuit unit
116 cross-linked conductor
117 conductor radiation unit
118 auxiliary conductor pattern
119 conductor via
120 C-shaped conductor
121 conductor via
122 split part
123*a*, 123*b* conductor power feed unit
124 conductor power feed unit
125 conductor via
126 clearance
127 connector
128 core line
129 outer conductor
130 slit conductor
131*a*, 131*b* connection point
132 open end
133 capacitor component
134 auxiliary conductor
135 conductor via
150 substantially central portion
151 conductor power feed line
152 conductor power feed line
154 conductor power feed line
160 coaxial cable
161 core line
162 outer conductor
165 slit part
170 baseband circuit

The invention claimed is:

1. An antenna comprising:

two antenna elements;

a conductor reflection plate and a conductor power feed unit, each of the antenna elements including a C-shaped conductor that is a substantially C-shaped conductor formed with a split part so that a portion of an annular conductor is made discontinuous, and a conductor power feed line that is electrically connected to one part of both parts of the C-shaped conductor opposing each other across the split part and configures a current path for feeding power to the C-shaped conductor, wherein the conductor power feed unit configures another path for feeding power to the C-shaped conductor, and includes one end coupled with an outer edge portion of the C-shaped conductor, and is disposed side by side with the conductor power feed line, the two antenna elements being disposed substantially orthogonally so that one of the antenna elements and the other of the antenna elements partially overlap each other when projected on the conductor reflection plate.

2. The antenna according to claim 1, wherein the conductor power feed unit includes another end coupled with the conductor reflection plate.

3. The antenna according to claim 2, wherein one end of the conductor power feed unit is coupled with a portion located in a vicinity of the central portion of the C-shaped conductor in the outer edge portion of the C-shaped conductor.

4. The antenna according to claim 2, wherein the conductor power feed unit coupled with one of the antenna elements and the conductor power feed unit coupled with the other of the antenna elements are disposed by leaving a gap, the antenna further comprises a slit conductor that is a conductor coupled, by electric conduction, with the conductor power feed unit coupled with one of the antenna elements and the conductor power feed unit coupled with the other of the antenna elements and is a conductor including a slit, and an opening of the slit faces a connection point side of the conductor power feed unit and the C-shaped conductor.

5. The antenna according to claim 4, wherein an electric length of the slit is a length of substantially a quarter of a wavelength of an electromagnetic wave having a frequency that is a resonance frequency of the antenna elements.

6. The antenna according to claim 4, wherein a capacitor component is mounted between two conductors of an open-end vicinity of the slit.

7. The antenna according to claim 4, further comprising a slit auxiliary conductor that straddles the slit in an open-end vicinity of the slit and opposes the slit conductor, wherein any one of conductor parts of both sides of the slit in the slit conductor is electrically connected to the slit auxiliary conductor.

8. The antenna according to claim 4, wherein the slit has a meander structure.

9. The antenna according to claim 1, wherein each of the antenna elements further includes at least one auxiliary conductor that is electrically connected to one part of both parts of the C-shaped conductor opposing each other across the slit part and opposes the other part.

10. The antenna according to claim 1, wherein each of the antenna elements further includes at least one conductor radiation unit that is electrically connected to an outer edge of an end of the C-shaped conductor in a direction where both parts of the C-shaped conductor opposing each other across the spit part oppose each other.

11. The antenna according to claim 1, wherein the C-shaped conductor has a substantially rectangular shape, and the slit part is located on a long side of the substantially rectangular shape.

12. An antenna array comprising a plurality of the antennas according to claim 1.

13. A wireless communication device mounted with the antenna array according to claim 12.

14. A wireless communication device mounted with the antenna according to claim 1.

15. The antenna according to claim 1, wherein a distance between any of the antenna elements and the conductor reflection plate is a length of substantially a quarter of a wavelength of an electromagnetic wave having a frequency that is a resonance frequency of the antenna element.

16. The antenna according to claim 1, wherein the two antenna elements are disposed substantially orthogonally so that substantially central portions of one of the antenna elements and the other of the antenna elements overlap each other when the antenna elements are projected on the conductor reflection plate.

17. The antenna according to claim 1, wherein the two antenna elements are disposed substantially in parallel with the conductor reflection plate.

18. The antenna according to claim 1, wherein the C-shaped conductor further includes a cut portion, and the conductor power feed line is passed through an inside of the cut portion.

19. The antenna according to claim 1, wherein both portions of the C-shaped conductor opposing each other across the split part have a shape bent in a direction substantially orthogonal to an opposing direction.

20. The antenna according to claim 1, wherein each of the antenna elements includes two C-shaped conductors opposing each other.

* * * * *